US008416971B1

(12) United States Patent
Salehi

(10) Patent No.: US 8,416,971 B1
(45) **Date of Patent: *Apr. 9, 2013**

(54) LOUDSPEAKER DRIVER

(76) Inventor: Kourosh Salehi, New York, NY (US)

( * ) Notice: Subject to any disclaimer, the term of this patent is extended or adjusted under 35 U.S.C. 154(b) by 442 days.

This patent is subject to a terminal disclaimer.

(21) Appl. No.: 12/759,830

(22) Filed: Apr. 14, 2010

Related U.S. Application Data

(63) Continuation-in-part of application No. 12/322,969, filed on Feb. 9, 2009, now Pat. No. 8,175,301, which is a continuation-in-part of application No. 11/732,393, filed on Apr. 3, 2007, now Pat. No. 7,515, 724.

(60) Provisional application No. 61/169,458, filed on Apr. 15, 2009, provisional application No. 61/063,881, filed on Feb. 7, 2008, provisional application No. 61/192,968, filed on Sep. 23, 2008, provisional application No. 60/789, 256, filed on Apr. 5, 2006, provisional application No. 60/875,089, filed on Dec. 15, 2006.

(51) Int. Cl.
*H04R 25/00* (2006.01)

(52) U.S. Cl. ..... 381/182; 381/386; 381/396

(58) Field of Classification Search ..... 381/152, 381/182, 186, 386, 396, 398, 400, 401, 402, 381/403, 404, 421, 423, 424, 432; 181/144, 181/147, 163, 171, 172
See application file for complete search history.

(56) References Cited

U.S. PATENT DOCUMENTS

| | | | | |
|---|---|---|---|---|
| 2,551,556 | A | 5/1951 | Brennan | 181/164 |
| 3,125,647 | A | 3/1964 | Rouy | 381/432 |
| 4,590,333 | A | 5/1986 | Strohbeen | 381/186 |
| 5,073,946 | A | 12/1991 | Satoh et al. | 381/349 |
| 5,295,194 | A | 3/1994 | Christensen | 381/190 |
| 5,604,815 | A | 2/1997 | Paddock | 381/396 |
| 5,682,436 | A | 10/1997 | Sakamoto et al. | 381/408 |
| 5,841,880 | A | 11/1998 | Sakamoto | 381/401 |
| 6,236,733 | B1 | 5/2001 | Kato et al. | 381/423 |
| 6,496,586 | B1 | 12/2002 | Hayes et al. | 381/152 |
| 6,973,194 | B2 | 12/2005 | Iwasa et al. | 381/412 |
| 7,197,154 | B2 | 3/2007 | Sahyoun | 381/404 |
| 7,236,607 | B2 * | 6/2007 | D'Hoogh | 381/396 |
| 7,515,724 | B2 | 4/2009 | Salehi | 381/182 |
| 8,175,301 | B2 | 5/2012 | Salehi | 381/182 |
| 2004/0202347 | A1 | 10/2004 | Koike | 381/431 |
| 2005/0286729 | A1 | 12/2005 | Harwood et al. | 381/152 |
| 2007/0286439 | A1 | 12/2007 | Salehi | 381/182 |
| 2009/0252369 | A1 | 10/2009 | Salehi | 381/182 |

OTHER PUBLICATIONS

International Search Report mailed Oct. 2, 2008.

* cited by examiner

*Primary Examiner* — Huyen D Le

(57) ABSTRACT

A loudspeaker driver that includes a suspended diaphragm and at least one voice coil disposed lateral to the suspended diaphragm, suspended in a magnetic field and coupled to the diaphragm.

5 Claims, 61 Drawing Sheets

Fig. 51B
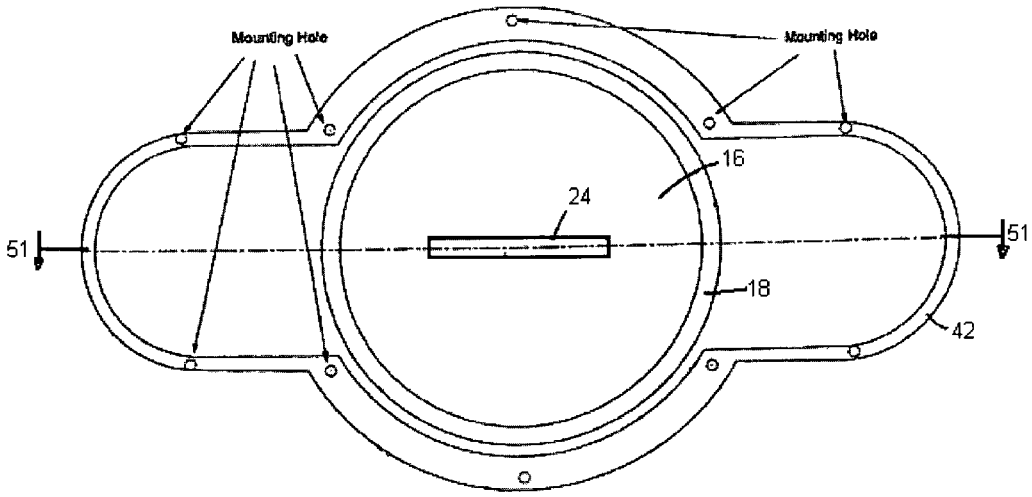
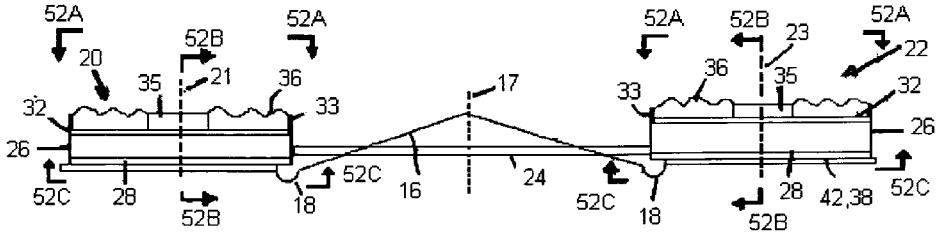
Fig. 51C

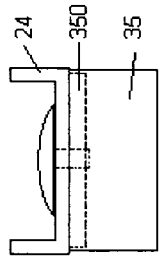
Fig. 60F
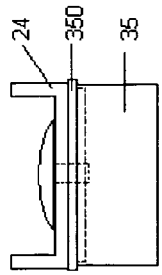
Fig. 60G
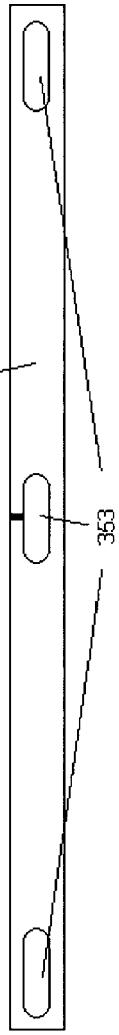
Fig. 60A
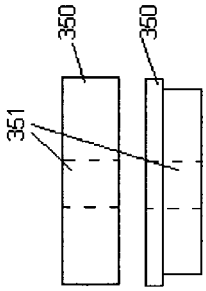
Fig. 60C
Fig. 60D
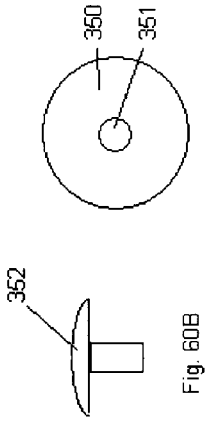
Fig. 60B
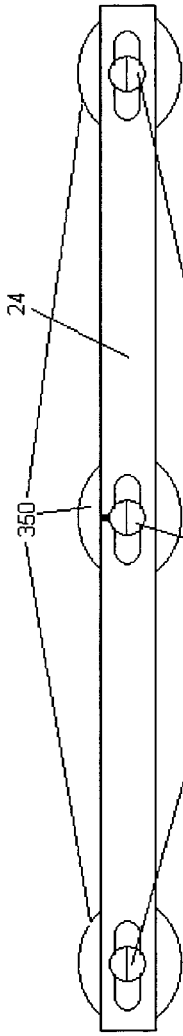
Fig. 60E

LOUDSPEAKER DRIVER

CLAIM OF PRIORITY AND CROSS-REFERENCE

The present application claims priority to U.S. Provisional Patent Application 61/169,458, entitled Loudspeaker Driver, the entire disclosure of which is incorporated by reference. The present application further claims priority to U.S. patent application Ser. No. 12/322,969, entitled Loudspeaker Driver, which claims priority to and incorporates by reference the entire content of U.S. patent application Ser. No. 11/732,393, and claims priority to and incorporates by reference U.S. Provisional Patent Application No. 61/063,881, entitled Loudspeaker Driver, to Kourosh Salehi, filed Feb. 7, 2008, and claims priority to and incorporates by reference U.S. Provisional Patent Application No. 61/192,968, entitled Loudspeaker Driver, to Kourosh Salehi, filed Sep. 23, 2008. The present application further claims priority to U.S. patent application Ser. No. 11/732,393, entitled Loudspeaker Driver, which claims priority to U.S. Provisional Patent Application No. 60/789,256, entitled Electronic Presentation System and Method & Loudspeaker, to Kourosh Salehi et al. filed on Apr. 5, 2006, the entire disclosure of which is incorporated by reference, and also claims priority to U.S. Provisional Application No. 60/875,089, entitled Multi-motor Loudspeaker Driver to Kourosh Salehi filed on Dec. 15, 2006, the entire disclosure of which is incorporated by reference.

BACKGROUND OF THE INVENTION

Referring to FIG. 1, a typical loudspeaker driver includes a cone-shaped diaphragm 1 that is movably suspended (using a surround 6 or the like) in a basket 2 for motion along central axis thereof, and a single motor 3 mounted on the basket that includes a voice coil 4 having a central axis 5 in substantial alignment with the central axis of diaphragm 1, which is coupled directly to the back of diaphragm 1 in order to move the diaphragm axially in response to an AC signal.

It is well known that as the size of the diaphragm increases and/or when more power is desired the size of the magnet required for driving the voice coil increases. Also, as the size of the diaphragm increases the size of the basket is increased, which in turn increases the profile (i.e. the front to back thickness) of the driver. Thus, woofers (drivers used for reproducing sound in the bass range, e.g. 20 Hz to 3000 Hz), which typically include larger diaphragms (compared to tweeters), require large motors and typically have larger profiles.

The profile of the driver directly affects the size of the speaker cabinet that receives the driver. A speaker cabinet that receives a woofer, therefore, requires a relatively large cabinet having a relatively large profile (i.e. front to back thickness).

SUMMARY OF THE INVENTION

It is an object of the present invention to provide a loudspeaker driver.

In one group of embodiments according to the present invention, a loudspeaker driver includes a movable diaphragm having an open mouth defined by a terminal boundary residing at its outermost lateral edge and surrounding the entire interior surface area thereof, and a plurality of driver arrangements each including a voice coil suspended in a magnetic field, mechanically coupled to the movable diaphragm and disposed lateral to its outermost lateral edge.

Because of the arrangement in a loudspeaker driver according to the present invention, the diameter of the open mouth of the diaphragm does not necessarily lead to the enlargement of the profile (i.e. the front to back depth) of the driver.

Moreover, multiple motors of lower power rating each including a smaller magnet compared to a single motor having a power rating equal to the total power of the multiple motors can be used, which may lead to the reduction in the cost of a loudspeaker driver for a given power rating.

In another group of embodiments according to the present invention, a loudspeaker driver according to the present invention includes a plurality of movable diaphragms each having an open mouth defined by a terminal boundary residing at its outermost lateral edge and surrounding the entire interior surface area thereof, and at least one driver arrangements including a voice coil suspended in a magnetic field, mechanically coupled to the movable diaphragms and disposed therebetween lateral to the outermost lateral edge thereof.

Other features and advantages of the present invention will become apparent from the following description of the invention which refers to the accompanying drawings.

BRIEF DESCRIPTION OF THE FIGURES

FIG. 51B illustrates a variation of the loudspeaker driver according to the embodiment of FIG. 51A assembled on a support instead of a front board.

FIG. 51C shows a cross-section view of the loudspeakers of FIGS. 51A and 51B along line 51-51 viewed in the direction of the arrows.

FIGS. 60A-60G illustrate a method for the mechanical coupling of a transmission frame to former(s). Specifically, FIG. 60A shows a top plan view of a transmission body, FIG. 60B shows a screw used for mechanical coupling, FIG. 60C shows a side plan view of a coupling, FIG. 60D shows a side plan view of another coupling, FIG. 60E shows a top plan view of transmission body of FIG. 60A as coupled to couplings shown by FIGS. 60C and 60D using the screw shown by FIG. 60B, FIG. 60F shows a view in the direction of arrows 60E-60F using the coupling of FIG. 60C, and FIG. 60G shows a view in the direction of arrows 60E-60F using the coupling shown by FIG. 60D.

FIG. 61A shows a side plan view of a transmission body, FIG. 61B shows one end of transmission body of FIG. 61A coupled to a former, FIG. 61C shows a top plan view of a coupling, FIG. 61D shows a side plan view of a screw used for coupling, FIG. 61E shows an end view of transmission body of FIG. 61A as received in the groove provided in the longitudinal portion of screw of FIG. 61E, FIG. 61F shows one end of transmission body of FIG. 61A coupled to a former according to an alternative method, FIG. 61G shows a view in the direction of arrows 61G.

DESCRIPTION OF THE EMBODIMENTS

Figure 1:
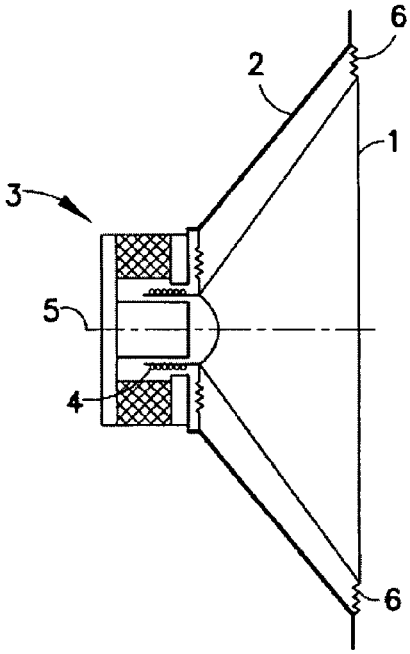
FIG.1 PRIOR ART
FIG. 1 illustrates a loudspeaker driver according to the prior art.

Unless otherwise indicated, it is intended for like numerals to identify like features in each embodiment disclosed herein. In the interest of brevity and efficiency in disclosing the invention like features are not repeatedly described. The presence of like features in each embodiment is clear, however, by reference numerals and the general appearance of like features in the attached figures.

Figure 2A:
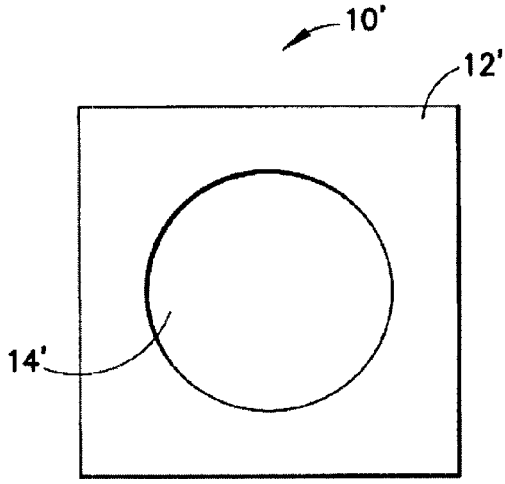
FIG. 2A is a front view of a speaker cabinet that includes a loudspeaker driver according to the present invention.
Figure 2B:
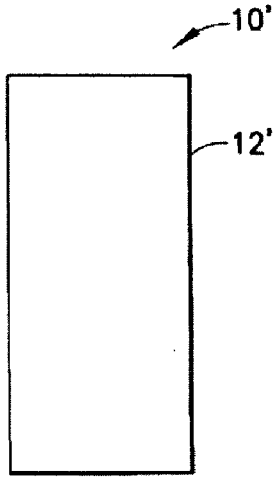
FIG. 2B is a side view of the speaker cabinet of FIG. 2A.

Referring to FIGS. 2A and 2B, a loudspeaker that includes a loudspeaker driver according to the present invention includes a speaker cabinet 10' having a front board 12' with a sound hole 14'. Cabinet 10' may be fully or partially enclosed. Specifically, speaker cabinet 10' may be an acoustic suspension speaker cabinet (fully enclosed) or a ported acoustic suspension cabinet, or the like. Cabinet 10' may be fabricated with medium density fiberboard (MDF), particle board, or any other suitable material.

Figure 3A:
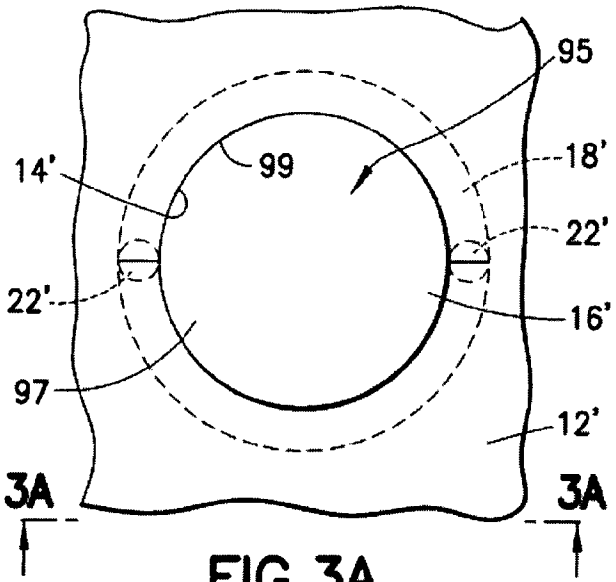
FIG. 3A shows a front (facing the outside of the cabinet) of a loudspeaker driver according to the first embodiment of the present invention.
Figure 3B:
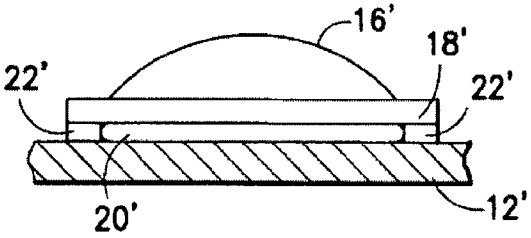
FIG. 3B shows a side view of the driver shown in FIG. 3A as seen along line 3A-3A in the direction of the arrows.
Figure 5C:
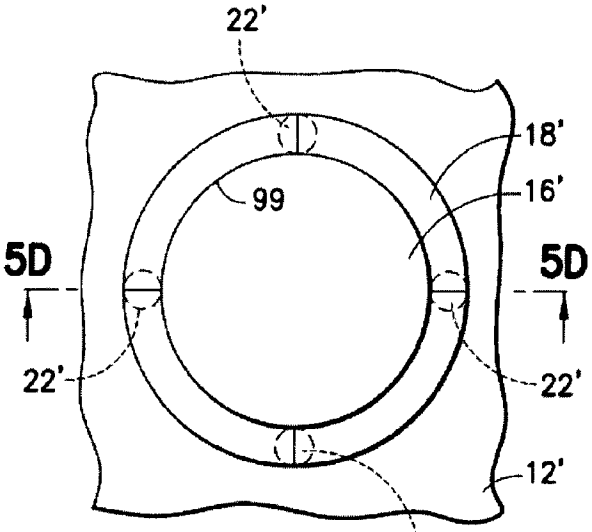
FIG. 5C shows a back (facing the interior of the cabinet) of the loudspeaker driver according to the second embodiment.
Figure 5D:
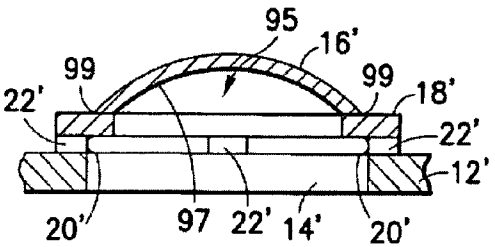
FIG. 5D is a cross-sectional view along line 5D-5D in FIG. 5C seen in the direction of the arrows.
Figure 3C:
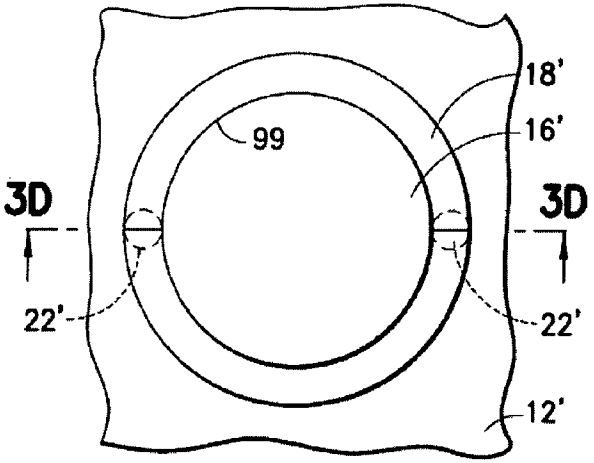
FIG. 3C shows a back (facing the interior of the cabinet) of a loudspeaker driver according to the first embodiment.
Figure 3D:
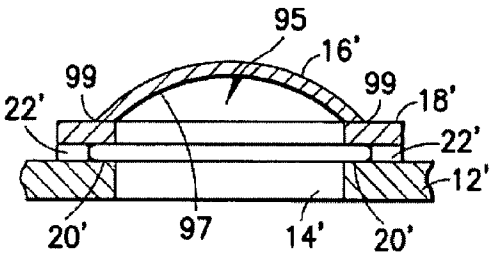
FIG. 3D is a cross-sectional view along line 3D-3D in FIG. 3C seen in the direction of the arrows.

Referring to FIGS. 3A and 3B, a loudspeaker driver according to the first embodiment of the present invention includes a diaphragm portion 16', a transmission portion (transmission frame) 18', which is preferably a ring, coupled to and disposed around the outer perimeter at the open mouth (described below) of diaphragm 16', a suspension member 20' which is fixed to the back side (the side facing the interior of cabinet 10') of front board 12' (serving as a support body) and transmission portion 18', and a plurality of preferably oppositely disposed drivers 22' each driver 22' being coupled between the backside of front board 12' and transmission portion 18'. The function of each driver 22' is to drive transmission portion 18' in a direction that is essentially perpendicular to front board 12'. Each driver 22' may be a transducer or a motor that includes a voice coil suspended in a magnetic field provided by a magnet, which may receive an electronic signal from a signal source such as an audio amplifier. Note that for the sake of simplicity the signal wires of the voice coils are not shown.

Figure 4A:
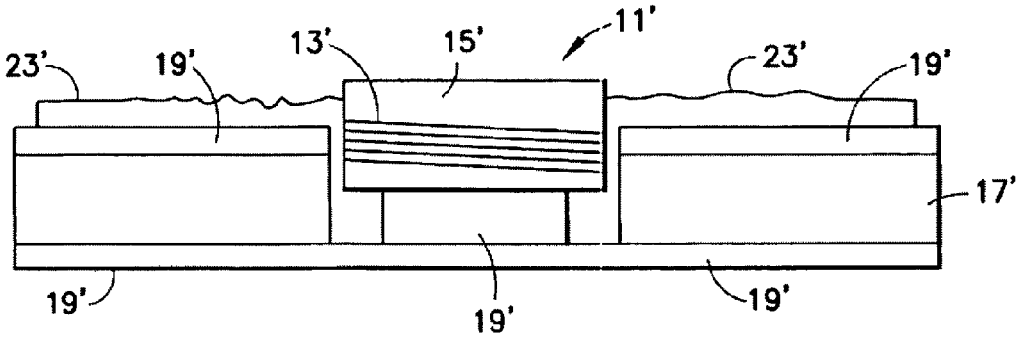
FIG. 4A shows an example of a motor arrangement for driving a voice coil in a loudspeaker driver according to the present invention.
Figure 4B:
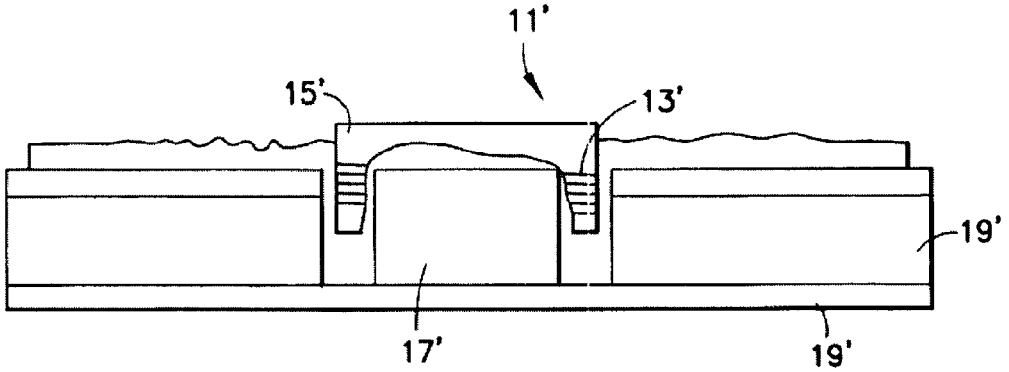
FIG. 4B shows another example of a motor arrangement for driving a voice coil in a loudspeaker driver according to the present invention.

Referring to FIGS. 4A and 4B, in the preferred embodiment, a voice coil arrangement suspended in a magnetic field is used as a driver 22'. Each voice coil 11' arrangement may be the same as those used in conventional loudspeaker drivers. Each voice coil 11', for example, includes a voice coil wire 13' that is wrapped around a bobbin 15' which can be induced to move by an AC signal when suspended in the magnetic field of a permanent magnet 17' projected by a magnetic circuit formed by metallic bodies 19' coupled to permanent magnet 17' similar to a conventional loudspeaker motor. Permanent magnet 17' is preferably coupled (directly or indirectly) to the back side (the surface facing the interior of the cabinet) of front board 12', and bobbin 15' of voice coil 11' may be attached to transmission portion 18', whereby voice coil 11' is suspended (in mid air) in the vicinity of and in the magnetic field of permanent magnet 17'. When operating, the electronic signals are transmitted to voice coil 11', which results in voice coil 11' being pushed away, or pulled toward permanent magnet 17'. Permanent magnet 17' may include an opening wide enough to receive the voice coil therein (FIG. 4A), or alternately, bobbin 15' may have an opening wide enough to receive magnet 17' (FIG. 4B). Note that each driver 22' may further include a spider 23' disposed around and coupled to voice coil 11' and attached to front board 12' or a metallic body 19' for additional stability.

Each voice coil 11' is suspended in mid air because of suspension 20'. Specifically, suspension 20' attaches transmission portion 18' to the back side of front board 12' such that the concave surface of diaphragm 16' faces outwardly (outside of cabinet 10') through sound hole 14'. Preferably, suspension 20' is disposed around sound hole 14' completely to prevent air from escaping cabinet 10'. Note that suspension 20' should be rigid enough so that it does not sag substantially under the weight of transmission portion 18', diaphragm 16', and voice coils 11'. However, diaphragm 16' should be compliant enough so that it will allow movement of transmission portion 18'. One suitable body for suspension 20' may be an incomplete tube (a tube which has a portion thereof removed lengthwise) made from a flexible polymer such as silicone. A full tube may also work if it satisfies the criteria set forth above. Other suspension materials used in conventional loudspeakers may also be used without deviating from the scope and the spirit of the present invention. Such conventional suspensions are typically made from paper based materials, reinforced fabric or foam.

Note that diaphragm 16' is shown to be a semisphere (not quite a hemisphere) having preferably a circular open mouth (as defined below) the circumference of which is the outer perimeter that is fixed to transmission portion 18'. Diaphragm 16' may be made from a paper based material used for forming conventional diaphragms. It has also been found that Styrofoam based materials may be suitable. Note that transmission portion 18' may be made of the same material as diaphragm 16'. That is, diaphragm 16' and transmission portion 18' may be a unitary body. For example, as shown, transmission portion 18' may flange outwardly from the circumference of the mouth of diaphragm 16'. Transmission portion 18' and diaphragm 16' may be made from different materials and fixed to one another using any suitable method—for example, adhesively joined—without deviating from the scope and the spirit of the present invention. Note that the joint between diaphragm 16' and transmission portion 18' does not allow free flow of air to ensure air is pushed efficiently by diaphragm 16'.

Note further that drivers 22' are preferably aligned along the diameter of the circular mouth of diaphragm 16' in order to ensure even movement of diaphragm 16' along an axis that is perpendicular to front board 12'.

Figure 4C:
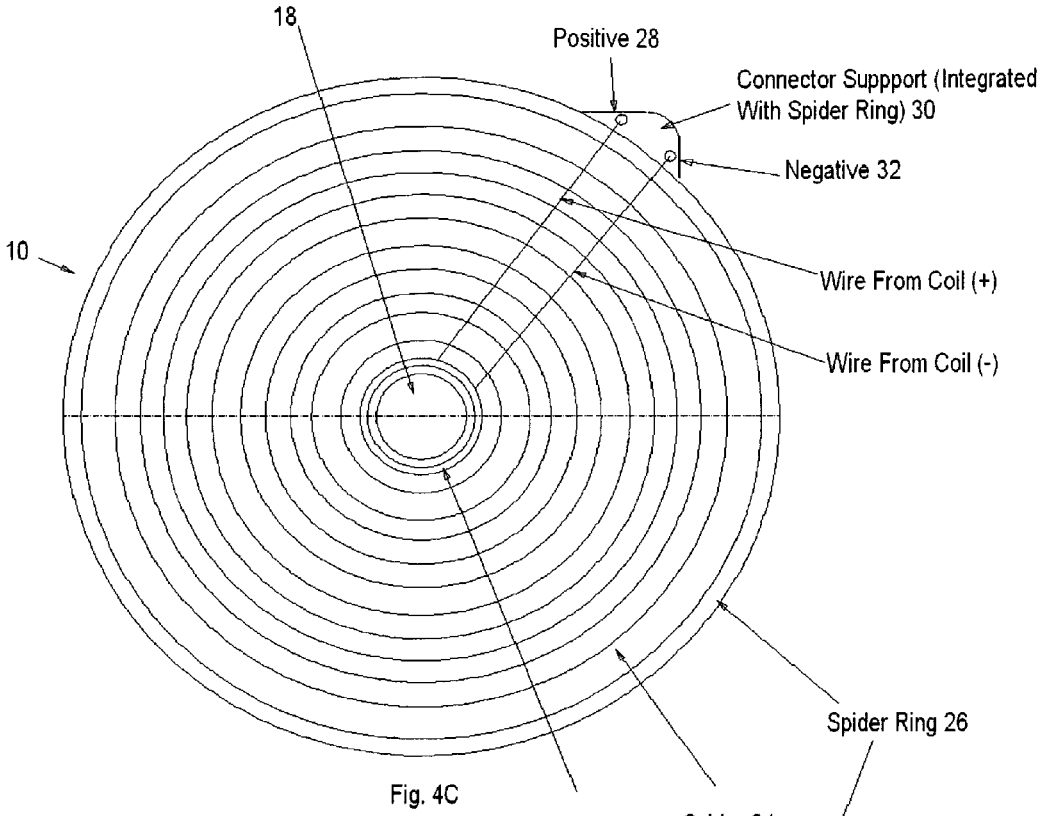
FIG. 4C shows a top plan view of a motor used in a driver according to another embodiment of the present invention.
Figure 4D:
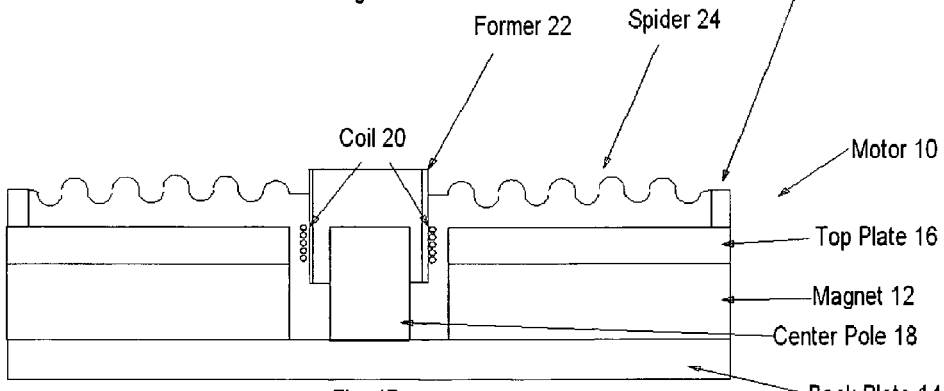
FIG. 4D shows a cross-sectional view of a motor used in a driver according to the present invention as shown by FIG. 4C along the broken like shown therein.

Alternatively, each loudspeaker driver according to the present invention could include one or a plurality (at least two) motors as depicted by FIGS. 4C and 4D. Each motor 100 in the preferred embodiment could include a donut-shaped magnet 120 (i.e. a disk having a central hole therein), a back plate 140 comprised of a suitable metallic material coupled to one surface (back surface) of magnet 120 and preferably closing the hole therein, a donut-shaped top plate 160 coupled to another opposing surface of magnet 120 (front surface) also comprised of a suitable metallic material having a hole therein in registration with the hole in magnet 120, and a center pole piece 180 formed with a suitable metallic material extending from back plate 140 through the hole in magnet 120 and reaching through at least the hole in top plate 160 to form a magnetic circuit. Each motor 100 further includes a coil 200 wrapped around a cylindrical former 220. Former 220 is coupled to the center of a spider 240 such that coil 200 is suspended between at least top plate 160 and center pole piece 180. The outer periphery of spider 240 is coupled to a spider ring 260 which is in turn coupled to top plate 160 whereby spider 240 is secured in place. Spider ring 260 can be a metallic ring the height of which can be used to set how far former 220 can move axially, and thus how far coil 200 can move axially in response to the signal it receives. The positive end of coil 200 is coupled to a positive connector 280 residing on a connector support plate 300, which is preferably integral with spider ring 260, and negative end of coil 200 is coupled to negative connector 320 residing on connector support plate 300. Positive and negative connectors 280, 320 are then used for connection to an external signal source.

Figure 5A:
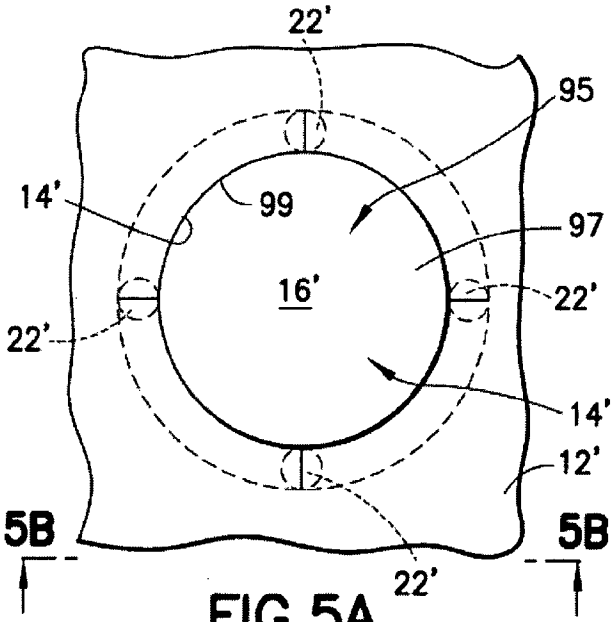
FIG. 5A shows a front (facing the outside of the cabinet) of a loudspeaker driver according to the second embodiment of the present invention.
Figure 5B:
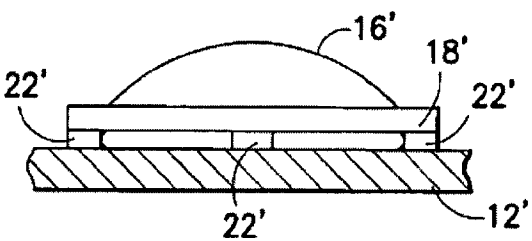
FIG. 5B shows a side view of the loudspeaker driver shown in FIG. 5A as seen along line 5B-5B in the direction of the arrows.

Referring now to FIGS. 5A and 5B, in a second embodiment of the present invention, four drivers 22' are used instead of two. Each pair of drivers 22' lie along a diameter of the circular base (open mouth as defined below) of diaphragm 16'. Also, drivers 22' are evenly spaced angularly (ninety degree apart in this case) in order to ensure even driving movement of diaphragm 16'.

Note that a speaker arrangement according to the present invention is not limited to two or four drivers 22', and that three drivers 22' or more than four drivers 22' can be added as needed without deviating from the scope and the spirit of the present invention.

Figure 6B:
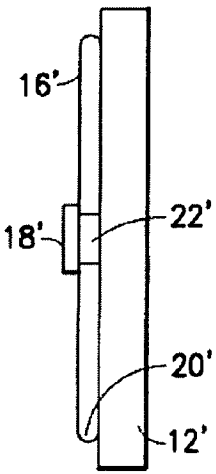
FIG. 6B is a side view along line 6B-6B in the direction of the arrows.
Figure 6A:
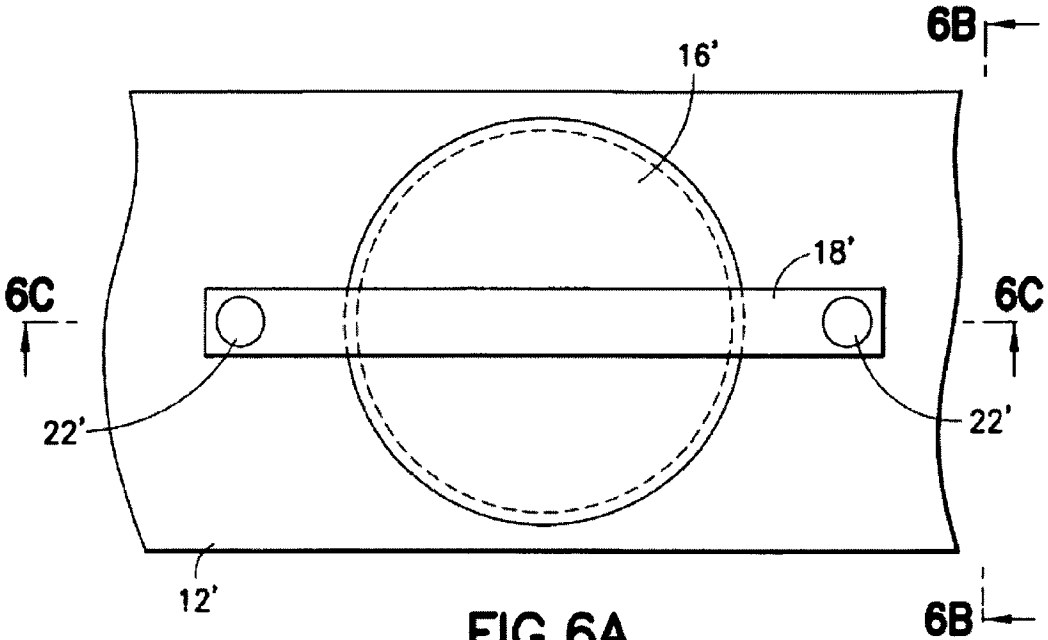
FIG. 6A shows a back view of a loudspeaker driver according to the third embodiment.
Figure 6C:
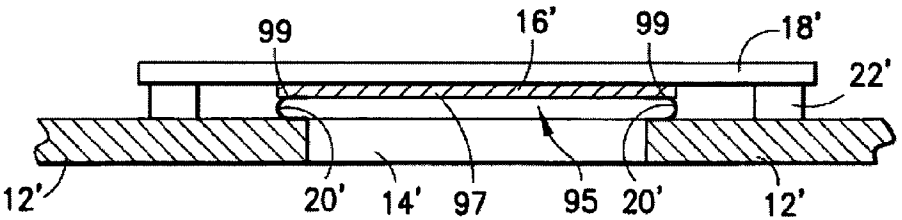
FIG. 6C is a cross-sectional view along line 6C-6C in the direction of the arrows.

Referring to FIGS. 6A-6C, in a third embodiment of the present invention, a transmission portion 18' is attached to the back of diaphragm 16', and each driver 22' is attached to either end of transmission portion 18'. In this embodiment, transmission frame 18' is an elongated rigid body that is capable of transmitting motion from drivers 22' to the back of diaphragm 16'. In alternative embodiments more than two drivers 22' can be used. For example, a cross-shaped transmission frame 18' may be used with four drivers 22' each disposed at a free end of the cross.

Figure 7:
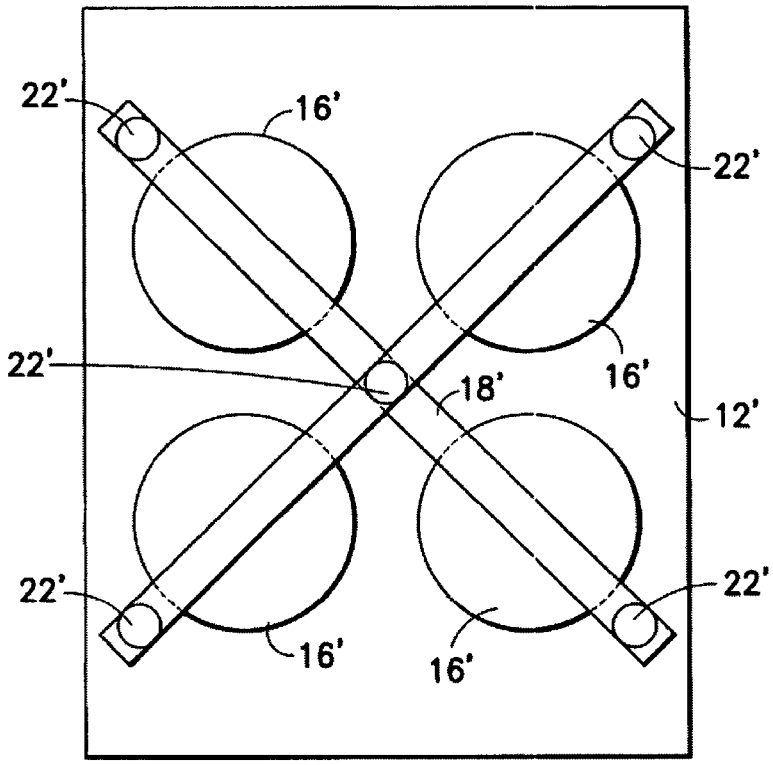
FIG. 7 is a back view of a loudspeaker driver according to the fourth embodiment.

Referring to FIG. 7, in a fourth embodiment, transmission portion 18' may be a cross-shaped body that is attached to the back of a plurality of diaphragms 16' (illustrated in abstract by a cross-like marking) and driven by a plurality of drivers 22' as shown.

Figure 8:
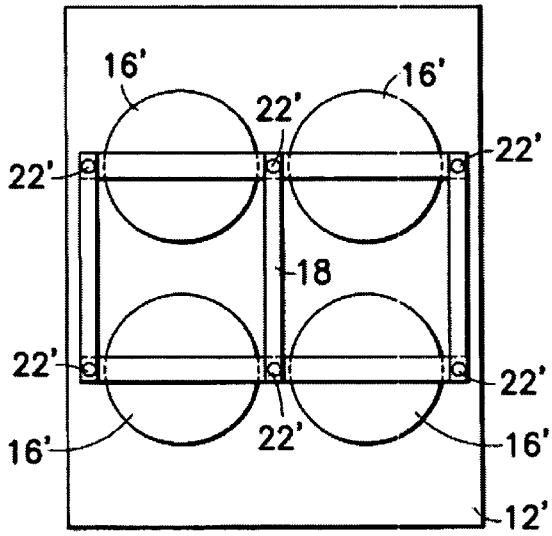
FIG. 8 is a back view of a loudspeaker driver according to the fifth embodiment.

Referring to FIG. 8, in a fifth embodiment of the present invention, transmission portion 18' is a lattice-shaped body that is attached to the back of a plurality of diaphragms 16', and driven by a plurality of drivers 22'.

A speaker arrangement according to the present invention is advantageous in that it can have a plurality of lower power rated drivers delivering the same power as a higher power rated speaker. For example, two 25 watt drivers can be used to replace a 50 watt driver.

Furthermore, due to the multi-driver arrangement, it is now possible to turn some of the drivers off or on selectively. Thus, the speaker power rating can be changed as desired.

It should be noted that drivers 22' and suspension 20' need not be mounted on front board 12' directly. Rather, a flat board or the like may be provided as a platform for receiving drivers 22' and suspension 20' and the board can then be mounted on the back surface of front board 12'. The board should include an opening that coincides with sound hole 14'.

It should also be noted that a loudspeaker driver according to the present invention is not limited to a cabinet environment, but may be adapted to other enclosures without deviating from the scope and the spirit of the present invention.

The voice coils in a loudspeaker driver according to the present invention may be series connected or parallel connected and connected together to a single AC source in order to operate in unison. Alternatively, one or more of the voice coils can be connected to a different AC source than the others, whereby the voice coils can be operated independently.

Figure 9:
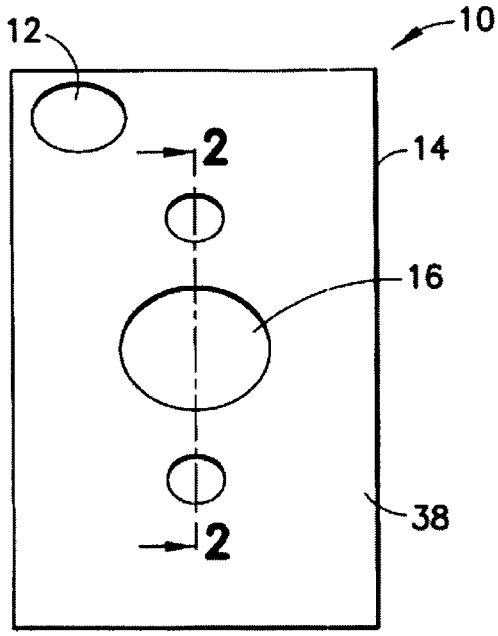
FIG. 9 illustrates a front plan view of another loudspeaker that includes a loudspeaker driver according to the present invention.

FIG. 9 illustrates a front plan view of a loudspeaker 10 that includes a loudspeaker driver arrangement according to the fifth embodiment of the present invention. For illustrative purposes loudspeaker 10 is a two way system that includes a tweeter 12 as well as a loudspeaker driver according to the present invention mounted in a closed cabinet 14. It should be understood that a loudspeaker according to the present invention is not limited to two way systems, but may be a three way system or only include a loudspeaker driver according to the present invention. Furthermore, a loudspeaker according to the present invention is not limited to sealed cabinet type arrangements, but may be implemented in other arrangements, for example, ported cabinets.

Figure 10A:
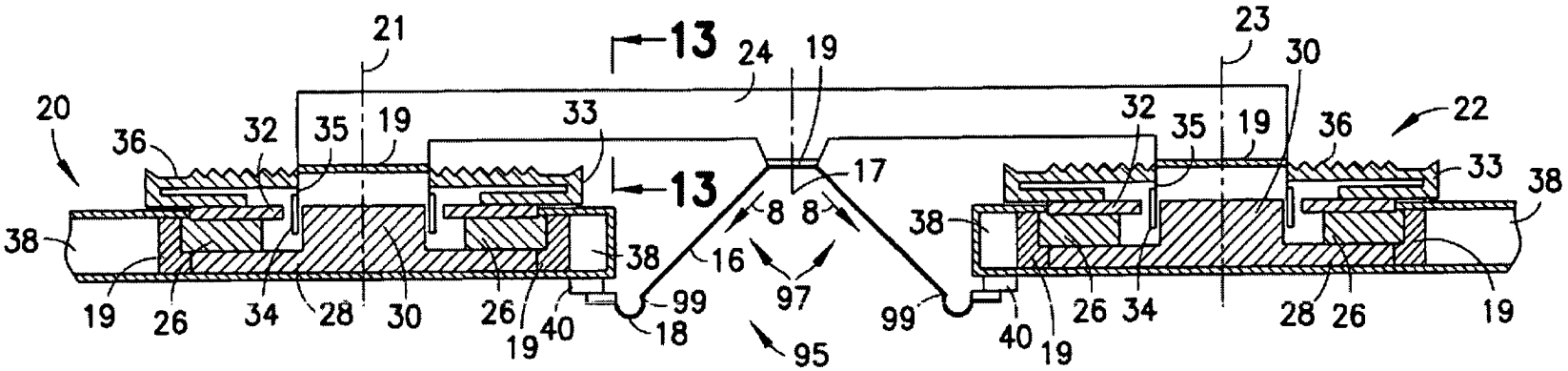
FIG. 10A illustrates a cross-sectional view of a loudspeaker driver according to an embodiment of the present invention as would be seen along line 2-2 viewed in the direction of the arrows.

Referring to FIG. 10A, which illustrates a cross-sectional view of a driver according to the present invention as would be seen along line 2-2, a loudspeaker driver according to the present invention includes a diaphragm 16 received in a diaphragm opening in front board 38 (serving as a support body) of cabinet 14, which is cone-shaped and made from any appropriate material such as paper, a surround 18, two motors 20, 22, and a transmission frame 24 operatively coupled to motors 20, 22 and diaphragm 16, whereby diaphragm 16 can be moved along its central axis 17 in order to generate sound waves.

According to one aspect of the present invention, each motor 20, 22 is disposed lateral to and outside the outer boundaries of diaphragm 16. Preferably, the axis of motion 21, 23 of each motor 20, 22 is parallel to the central axis 17 of diaphragm 16.

Each motor 20,22 preferably includes a magnet 26, a back plate 28, a center pole piece 30 extending through a central opening in magnet 26, a top plate 32, a coil 34 wound around a former (bobbin) 35, and a spider 36. Spider 36 includes a central opening which receives and is coupled to former 35 and is secured to top plate 32 directly or indirectly (through a base plate 33 attached to top plate 32), whereby coil 34 is suspended in the magnetic field present in the gap between a top portion of pole piece 30 and top plate 32. Each motor 20, 22 operates in the conventional manner. That is, by applying an AC signal to a coil 34, coil 34 and former 35 move along motion axis 20,23 of the motor.

According to one aspect of the present invention, each end of transmission frame 24 is mechanically secured to a former 35 through an adhesive body 19 formed with, for example, an epoxy glue, and a middle portion of transmission frame 24 is mechanically secured to a central portion of the back of (the surface facing the interior of cabinet 12) diaphragm 16 also through an adhesive body formed with, for example, epoxy glue or the like.

In this embodiment of the present invention, each motor 20,22 is received in a respective opening in the front board 38 of cabinet 12 and mechanically secured to front board 38. One preferred way to secure each motor 20, 22 is through the use of an adhesive such as glue. Further, note that in this embodiment each motor 20,22 is exposed through a respective opening in front board 38. Preferably, the back of each motor 20, 22 is coplanar with the front surface (the surface of the exterior of front board 38) of front board 38 as illustrated by FIG. 10A.

Figure 10B:
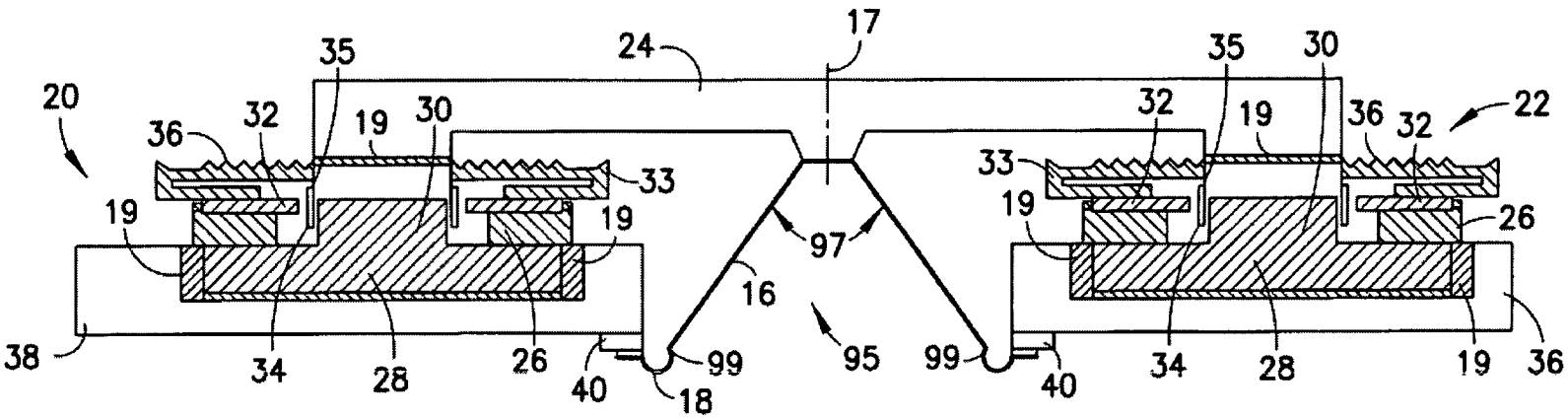
FIG. 10B illustrates a cross-sectional view of a loudspeaker driver according to an embodiment of the present invention as would be seen along line 2-2 viewed in the direction of the arrows.

Referring to FIG. 10B, note that it may not be necessary to have a through opening in front board 38 for receiving a motor, and each motor 20, 22 may be received instead in a respective recess (which extends only partially through the body of front board 38) in front board 38 and then secured to front board 38 with glue 19 or the like without deviating from the scope and spirit of the present invention.

In the first variation of the fifth embodiment, surround 18 is adhesively attached to a frame 40. Frame 40 is then secured to front face of front board 38 with screws or the like mounting hardware. Frame 40 is preferably a metallic or plastic ring which receives in the interior opening thereof diaphragm 16, and is attached to front face of the front board 38 by screws or the like.

Figure 11A:
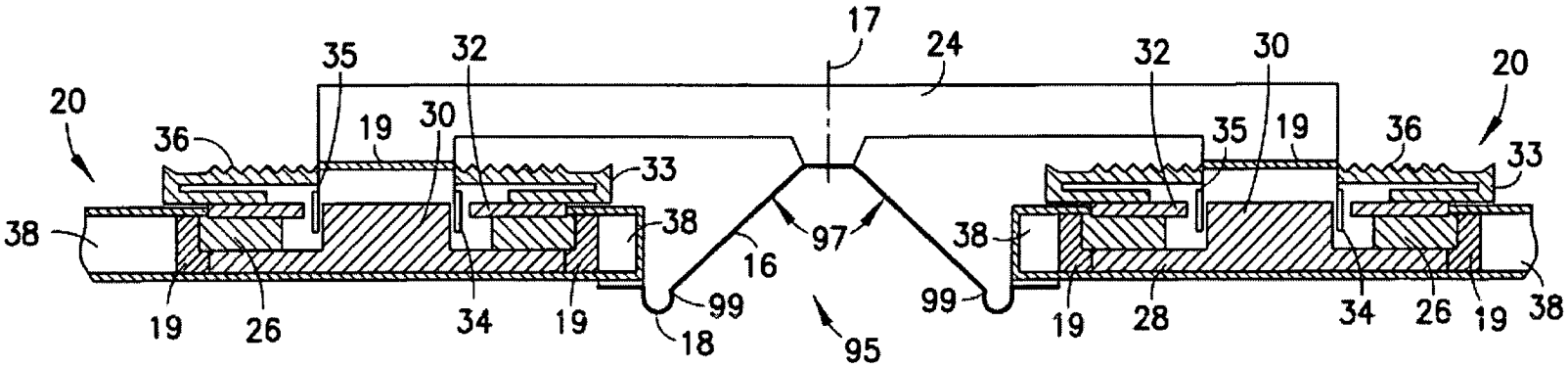
FIG. 11A illustrates a cross-sectional view of a loudspeaker driver according to an embodiment of the present invention as would be seen along line 2-2 viewed in the direction of the arrows.
Figure 11B:
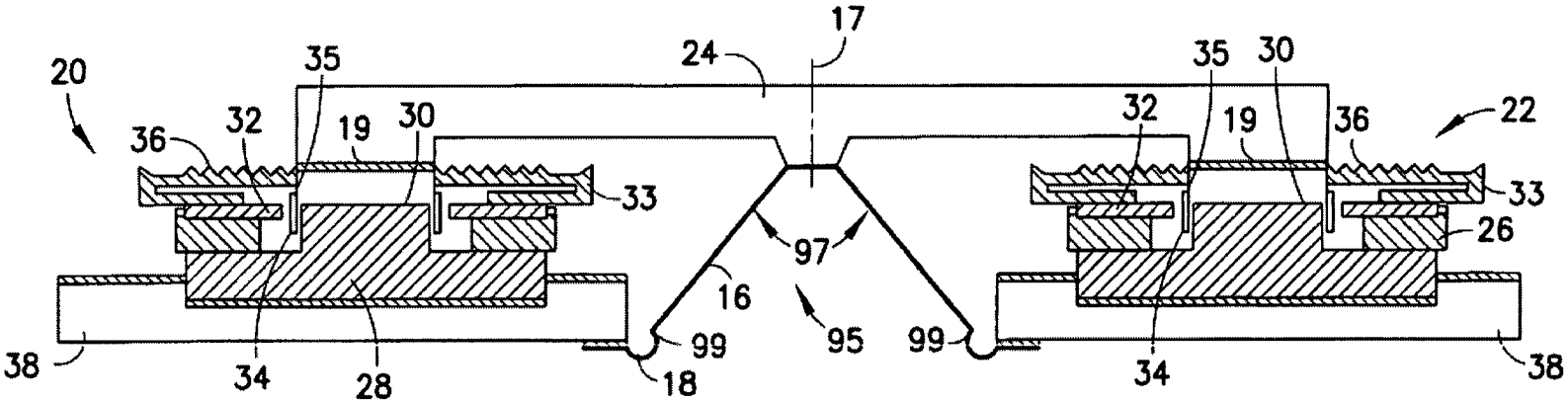
FIG. 11B illustrates a cross-sectional view of a loudspeaker driver according to an embodiment of the present invention as would be seen along line 2-2 viewed in the direction of the arrows.

Referring to FIG. 11A, which illustrates another variation of the fifth embodiment, surround 18 is secured directly to front face of front board 38, for example, by glue or the like adhesive. FIG. 11B shows the same variation except in this variation each motor 20,22 is received inside a recess which extends only partially through the body of front board 38.

Figure 12:
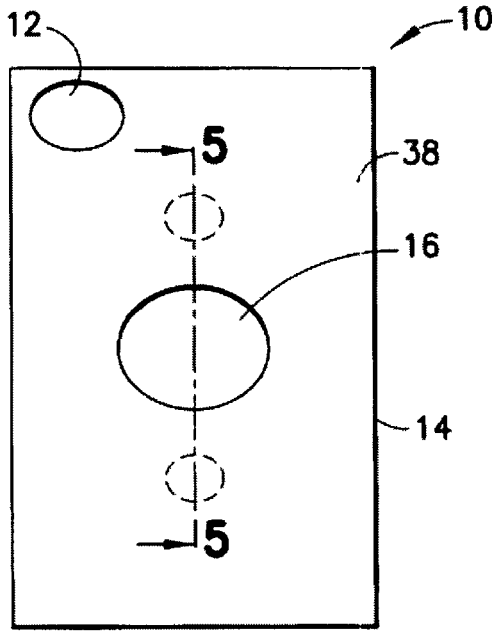
FIG. 12 illustrates a front plan view of a loudspeaker that includes a loudspeaker driver according to the present invention.
Figure 13:
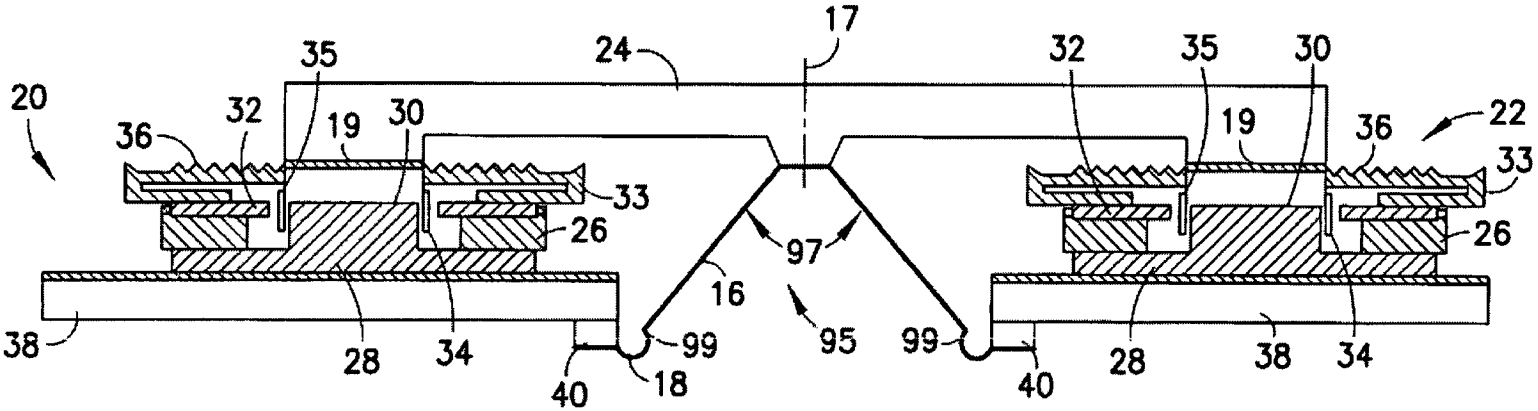
FIG. 13 illustrates a cross-sectional view of a loudspeaker driver according to an embodiment of the present invention as would be seen along line 5-5 viewed in the direction of the arrows.
Figure 14:
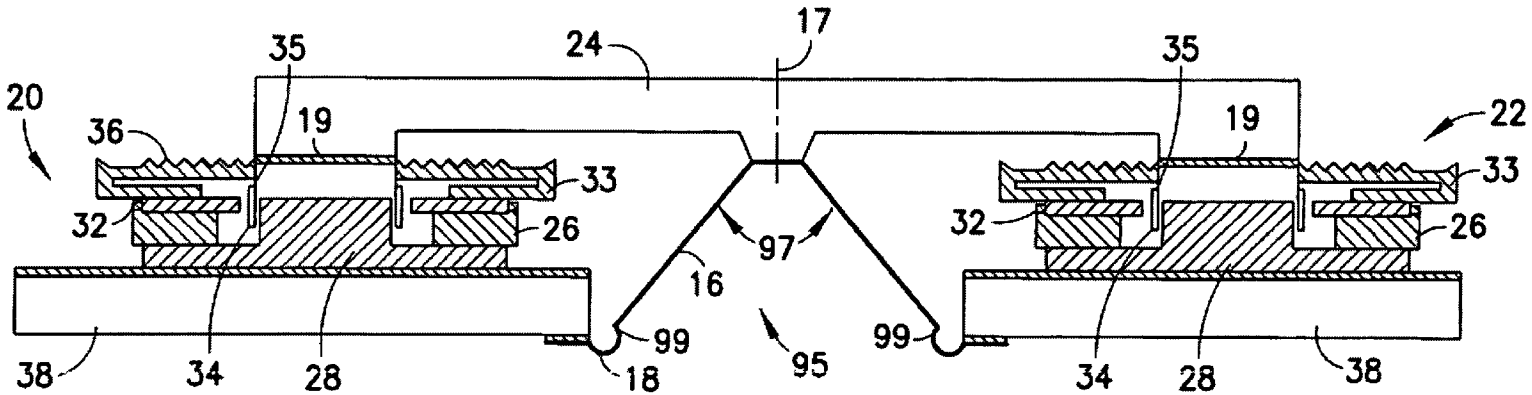
FIG. 14 illustrates a cross-sectional view of a loudspeaker driver according to an embodiment of the present invention as would be seen along line 5-5 viewed in the direction of the arrows.

Referring now to FIGS. 12 and 13, in which like numerals identify like features, in a loudspeaker driver according to the sixth embodiment of the present invention each motor 20, 22 is disposed on and secured to the back surface (the surface facing the interior of the cabinet) of front board 38. Glue or the like adhesive may be used to secure each motor in the manner described. FIG. 13 illustrates a variation in which a frame 40 (similar to frame 40 in the previous embodiment) is used to secure surround 18 to the front surface of front board 38. Referring to FIG. 14, in which like numerals identify like features, in another variation of the sixth embodiment surround 18 is secured to front board 38 directly with an adhesive such as glue or the like without an intervening frame 40.

Figure 15:
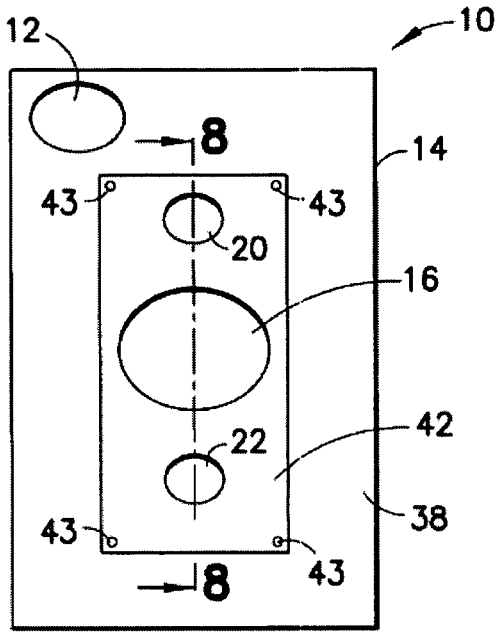
FIG. 15 illustrates a front plan view of a loudspeaker that includes a loudspeaker driver according to the present invention.
Figure 16:
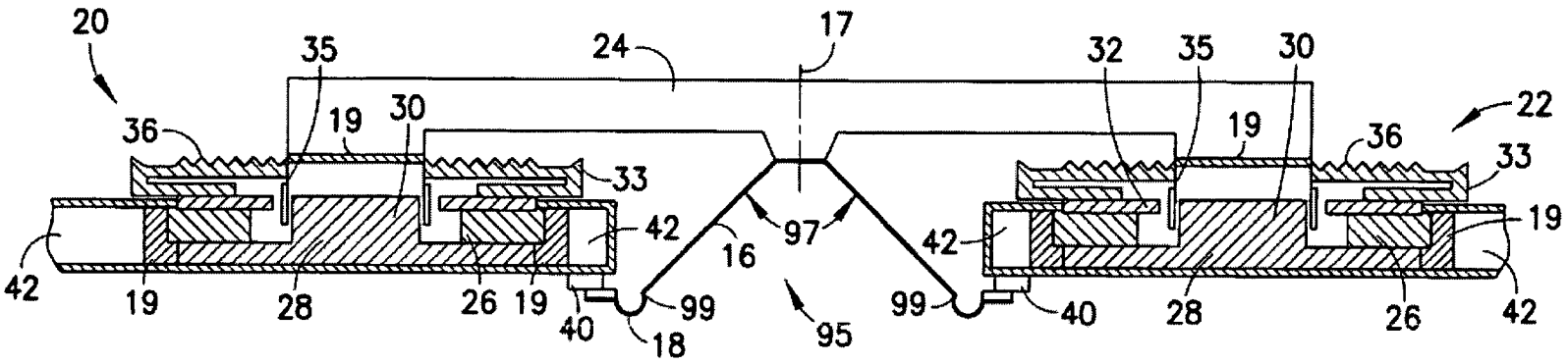
FIG. 16 illustrates a cross-sectional view of a loudspeaker driver according to an embodiment of the present invention as would be seen along line 8-8 viewed in the direction of the arrows.
Figure 17A:
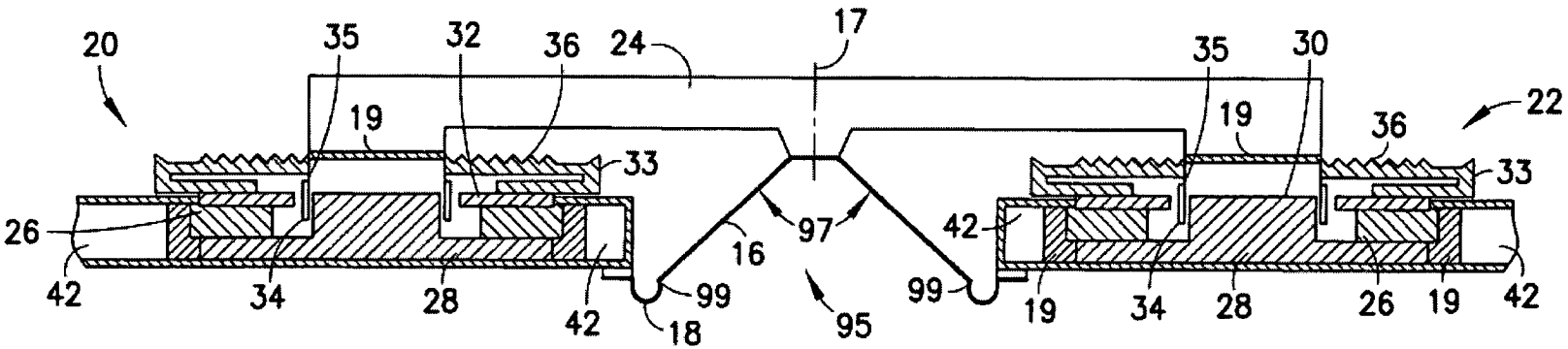
FIG. 17A illustrates a cross-sectional view of a loudspeaker driver according to an embodiment of the present invention as would be seen along line 8-8 viewed in the direction of the arrows.

Referring now to FIGS. 15 and 16, a loudspeaker driver according to the seventh embodiment includes a support frame 42 (serving as a support body instead of the front board of the cabinet). Support frame 42 may be stamped out of a sheet of metal of an appropriate thickness and includes openings for receiving motors 20,22. Thus, unlike the fifth and the sixth embodiments, a loudspeaker driver according to the seventh embodiment is not assembled on front board 38 of the cabinet. Rather, it is assembled onto support frame 42 (using an adhesive such as glue, or if appropriate through welding or brazing). Support frame 42 is then secured mechanically to front board 38 using, for example, screws 43 or the like mounting hardware. Note that in the variation shown by FIG. 16 surround 18 is secured to support frame 42 using a frame 40 (similar to frame 40 described above). Note that front board 38 is opened to receive the driver arrangement inside cabinet 12, thereby allowing the free motion of diaphragm 16. Referring now to FIG. 17A, alternatively, surround 18 may be adhesively attached using glue or the like to support frame 42 directly.

Figure 17B:
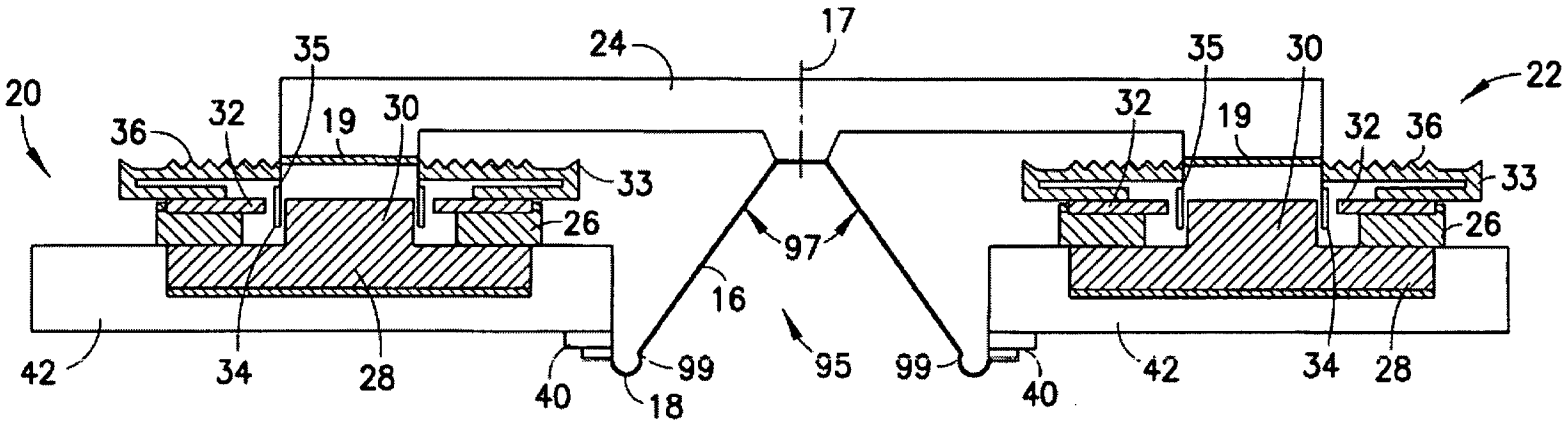
FIG. 17B illustrates a cross-sectional view of a loudspeaker driver according to an embodiment of the present invention as would be seen along line 8-8 viewed in the direction of the arrows.
Figure 17C:
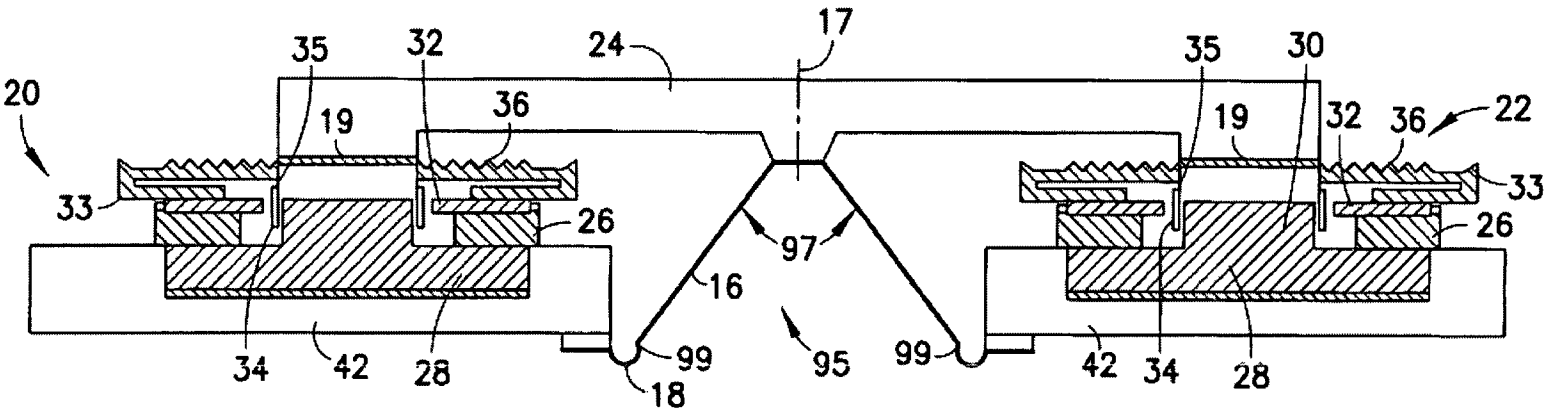
FIG. 17C illustrates a cross-sectional view of a loudspeaker driver according to an embodiment of the present invention as would be seen along line 8-8 viewed in the direction of the arrows.

Note that openings are not required in frame 42, rather a recess may be provided to receive each motor 20,22, without allowing the back surface of each motor to be exposed. FIGS. 17B and 17C illustrate such variations. FIG. 17B shows an example with frame 40 and FIG. 17C shows an example without frame 40 in which surround 18 is directly attached to frame 42 using glue or the like.

Figure 18:
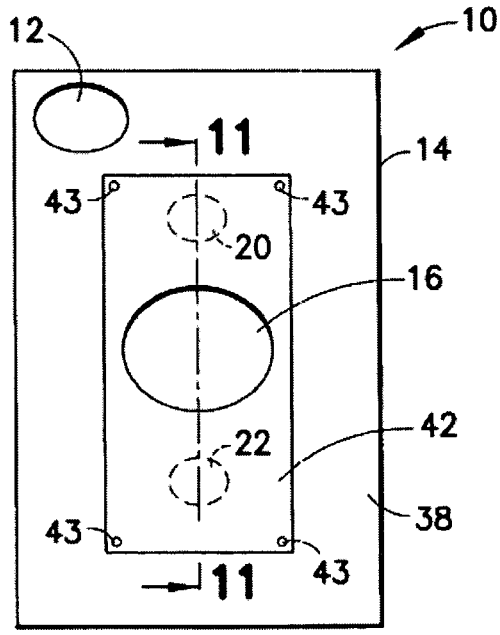
FIG. 18 illustrates a front plan view of a loudspeaker that includes a loudspeaker driver according to the present invention.
Figure 19:
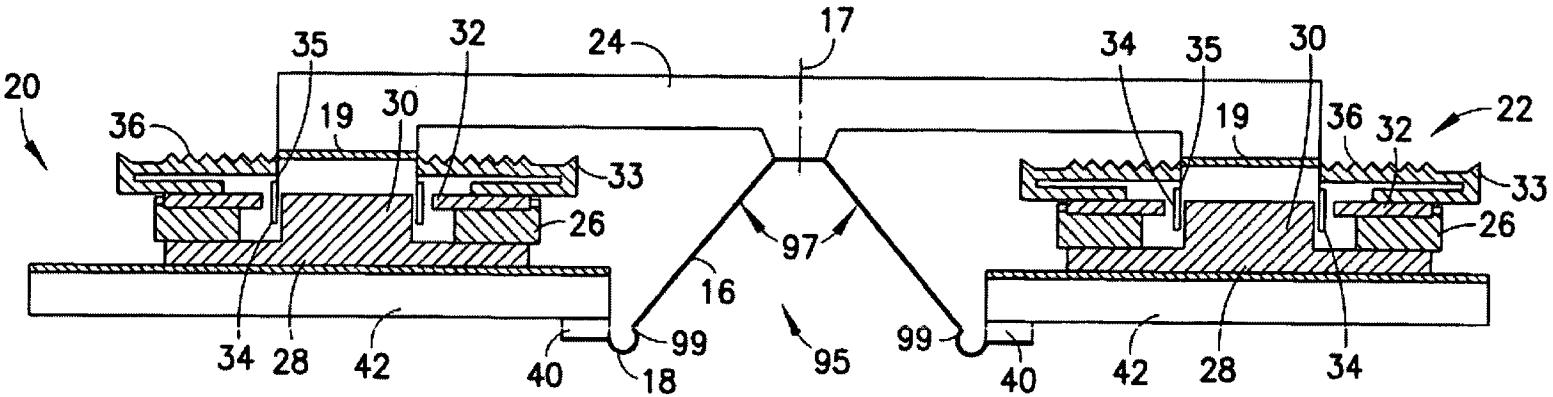
FIG. 19 illustrates a cross-sectional view of a loudspeaker driver according to an embodiment of the present invention as would be seen along line 11-11 viewed in the direction of the arrows.

Referring now to FIGS. 18 and 19, in which like numerals identify like features, a loudspeaker driver according to the eighth embodiment of the present invention includes motors 20,22 attached to a back surface of support frame 42. Thus, unlike the seventh embodiment, openings are not required to receive each motor 20,22.

Figure 20:
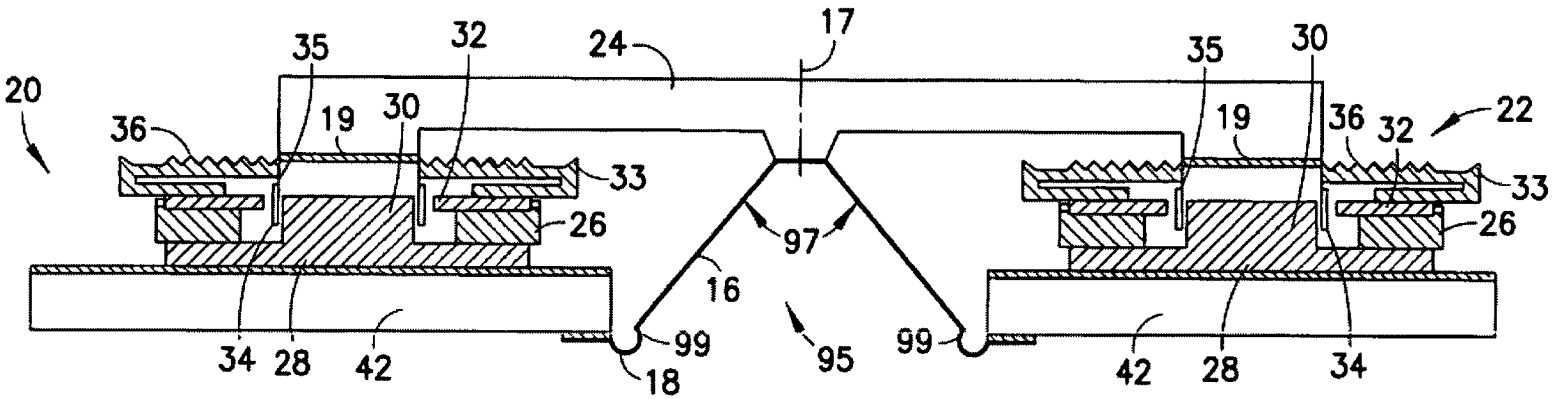
FIG. 20 illustrates a cross-sectional view of a loudspeaker driver according to an embodiment of the present invention as would be seen along line 8-8 viewed in the direction of the arrows.

Note that in the variation shown by FIG. 19, surround 18 is secured to support frame 42 using a frame 40 (similar to frame 40 described above). FIG. 20 shows another variation in which surround 18 is adhesively attached using glue or the like to support frame 42 directly.

Figure 21:
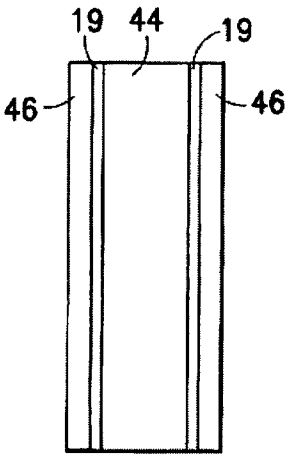
FIG. 21 is a cross-sectional view of transmission frame 24 along line 13-13 (FIG. 10A) viewed in the direction of the arrows.

Referring to FIG. 21, in the preferred embodiment of the present invention, transmission frame 24 includes a soft core 44, and a relatively rigid outer clad 46 on each side thereof and attached thereto with glue or the like adhesive 19. The soft core 44 may be made from foam board (e.g. foam board sold under the U.S. registered trademark FOME-COR) or the like material while outer clad 26 may be made from a sheet of aluminum or the like material. It has been found that such an arrangement provides high rigidity and is light enough to serve as an appropriate transmission frame 24 particularly when transmission frame 24 is coupled to diaphragm 16 such that axis 17 is parallel to the plane that run parallel to soft core 44, and clads 46. It has also been found that such an arrangement does not exhibit excessive vibration that my color the reproduction of sound.

Figure 22B:
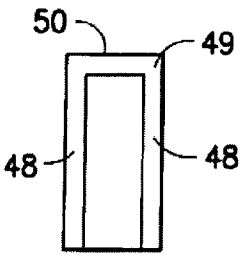
FIG. 22B shows a cross-sectional view of the transmission frame of FIG. 22A along line 14B-14B viewed in the direction of the arrows.
Figure 22A:
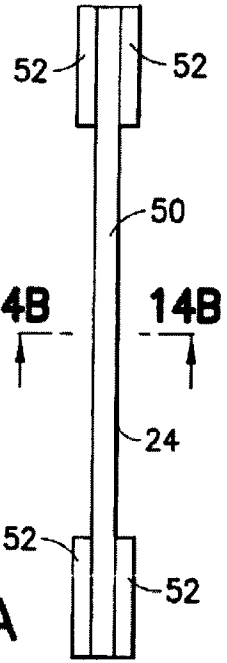
FIG. 22A illustrates a top plan view of another transmission frame.

Referring to FIGS. 22A and 22B, a transmission frame 24 according to an alternative design may include a metallic sheet, e.g. aluminum sheet 49, bent (see FIG. 22B) through stamping or the like to have two parallel walls 48 linked through a central spine portion 50. The space between parallel walls 48 may or may not be filled with a soft core such as foam board or the like material. Note that transmission frame 24 according to the variation shown by FIG. 22A includes feet portions 52 at each end thereof. Each feet 52 may provide additional surface area for attachment to a respective former of a voice coil.

Figure 22C:
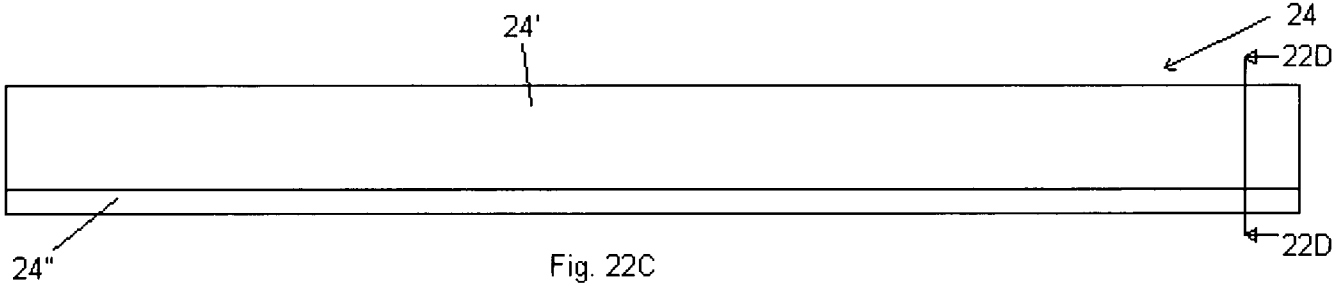
FIG. 22C illustrates a side plan view of another transmission frame.
Figure 22E:
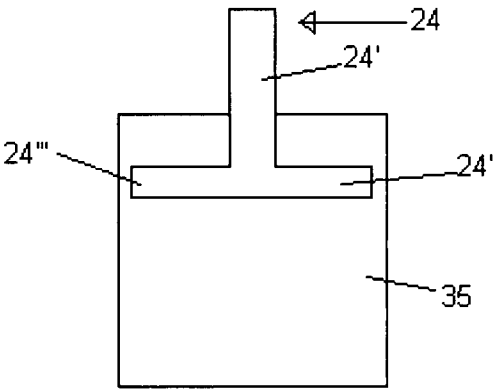
FIG. 22E shows a side view of the transmission frame according to FIGS. 22D and 22E as embedded in a former of a voice coil of a motor.
Figure 22D:
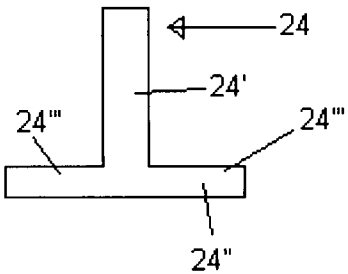
FIG. 22D shows a cross-sectional view of the transmission frame of FIG. 22C along line 22D-22D viewed in the direction of the arrows.

Referring now to FIGS. 22C and 22D, according to yet another variation, transmission frame 24 can be a metallic bar (e.g. an aluminum bar) having a generally T-shaped cross-section as illustrated by FIG. 22D. Thus, the transmission frame according to the variation depicted by FIGS. 22C and 22D includes a vertically oriented central portion 24' and a horizontally oriented portion 24" (i.e. the head of the T) disposed at one side of portion 24'. Portion 24" provide two flanges 2" each extending away from the vertically oriented portion 24' and both extending in opposite directions relative to one another.

Referring to FIG. 22D, each former 35 of a respective voice coil in a respective motor 20,22 may be provided with an upside down T-shaped cutout to receive a respective portion of a respective end of a transmission frame 24 according to FIGS. 22C and 22D. As a result, flanges 24" allow transmission frame 24 to be anchored into the body of former 35 leading to better mechanical coupling between the two bodies. Glue or the like may also be used to adhere transmission frame 24 to each former 35 to strengthen the mechanical coupling between the two bodies. Note that, alternatively, a feet 52 of the transmission frame 24 of FIGS. 22A and 22B can also be received in T-shaped cutout outs of formers 35 of motors 20,22 in the same manner shown in FIG. 22E.

Figure 23A:
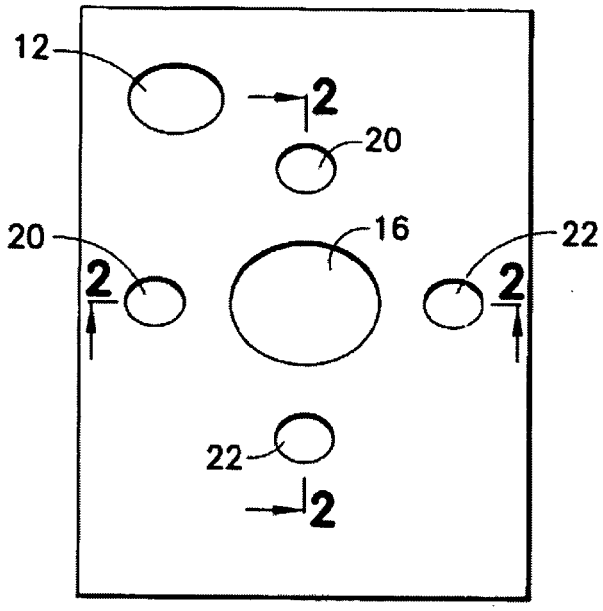
FIG. 23A shows a front plan view of a speaker that includes a loudspeaker driver according to the present invention.
Figure 23B:
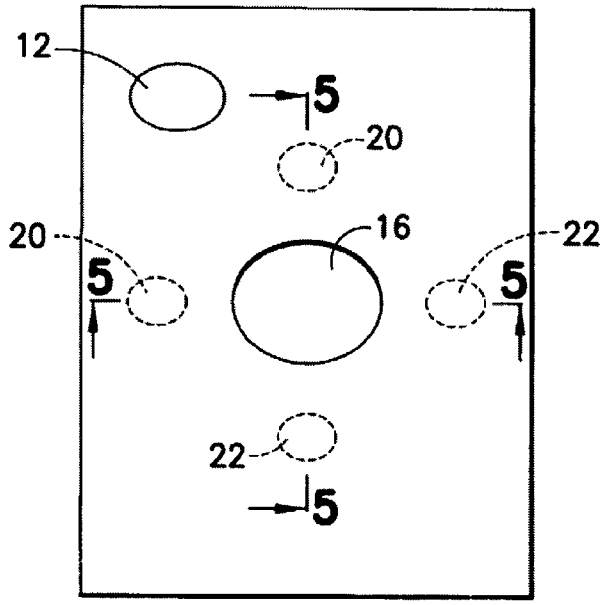
FIG. 23B shows a front plan view of a speaker that includes a loudspeaker driver according to the present invention.

Referring to FIGS. 23A and 23B, it should be noted that a loudspeaker driver according to the present invention may include more than two motors. For example, a loudspeaker driver according to the present invention may include a driver with four motors coupled to a diaphragm through a transmission frame as described above without deviating from the present invention.

Figure 23C:
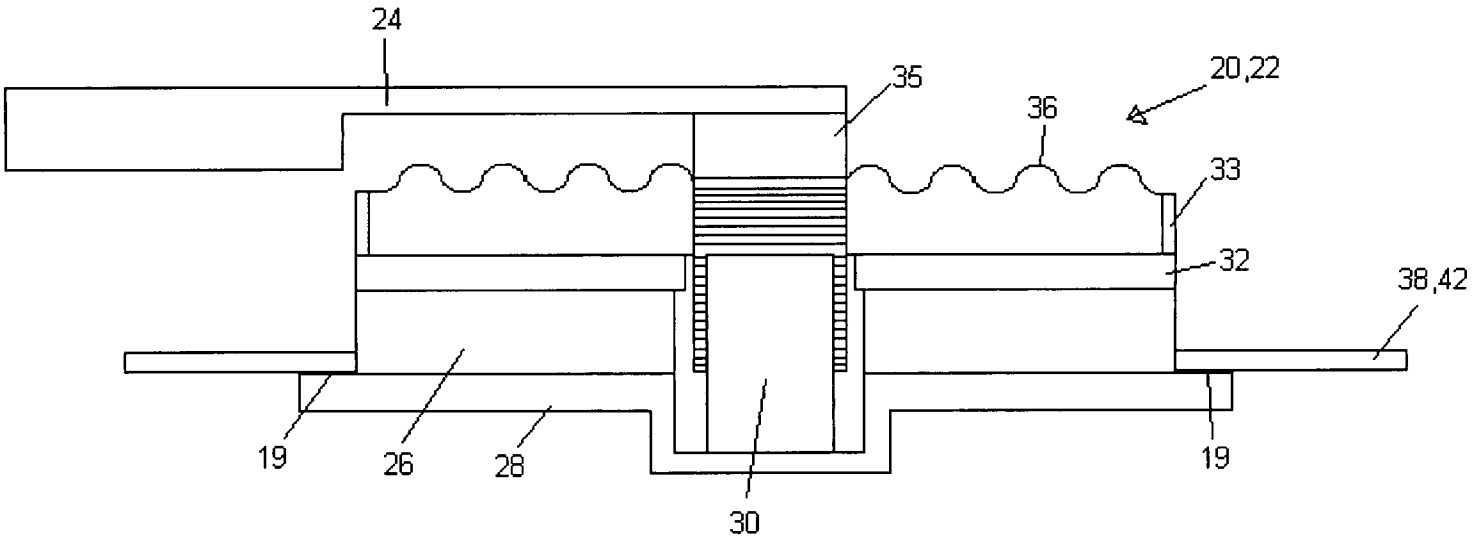
FIG. 23C illustrates a variation of a motor for a loudspeaker according to the present invention.

Referring to FIG. 23C, in which like numerals identify like features, each motor 20, 22 may include a back plate 28 which is wider than the opening in front board 38 (or support frame 42) in which the motor is received. As a result, glue 19 or the like may be disposed between the back plate of each motor and the exterior surface of front board 38 (or support frame 42) to mechanically secure the motor to the same.

Figure 23D:
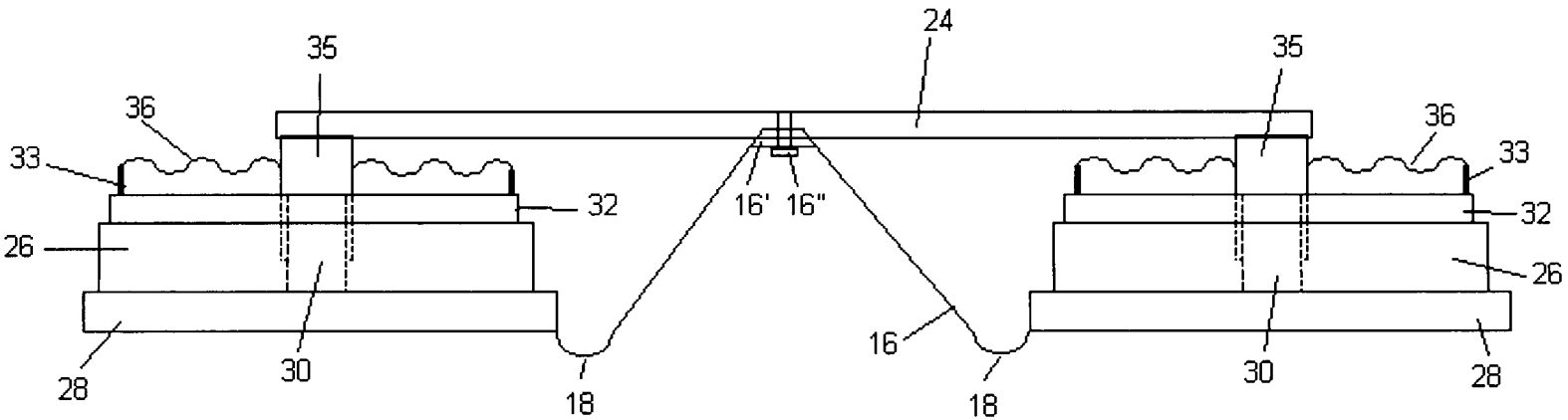
FIG. 23D illustrates another embodiment of a loudspeaker driver according to the present invention.

Referring now to FIG. 23D, in which like numerals identify like features, according to yet another embodiment of the present invention, the back plate of each motor can be omitted and instead the magnets may be mounted onto support frame 42, the thickness and material for which can be selected to function as a back plate of the motors. Furthermore, according to yet another improvement, which can be applied to any of the embodiments herein, a coupling arrangement may be employed to further improve the mechanical connection of diaphragm 16 to the transmission frame 24. Specifically, the coupling arrangement may include a plate 16' (or a plurality of plates), e.g. a circular metallic plate, having a central opening therein, e.g. a washer like plate, disposed in the interior of diaphragm 16, and coupled mechanically to transmission frame 24 using a screw 16" or the like fastener that extends through the central opening in plate 16', diaphragm 16, and at least partially or preferably fully through transmission frame 24. Glueor the like adhesive can be used to further strengthen the mechanical connection between plate 16' and the interior surface of diaphragm 16. Advantageously, the weight of plate 16' and/or fastener 16" can be selectively changed as a way to trim the performance of the driver by changing the weight of the moving parts of the driving, namely, diaphragm 16 and transmission 24. For example, plate 16' can replaced with a heavier or lighter plate or, if a plurality of plates are used, the number of plates can be increased or decreased to obtain the desired weight.

Figure 24A:
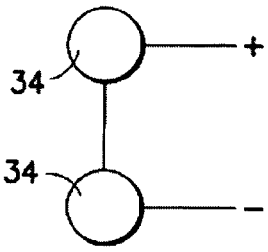
FIGS. 24A-24E illustrate various wiring configurations for the coils of a multi-motor loudspeaker driver according to the present invention.
Figure 24B:
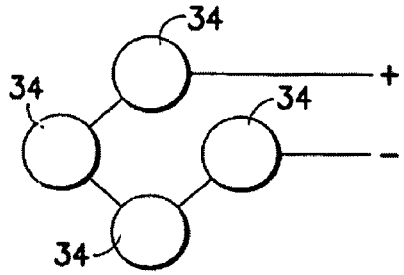
Figure 24C:
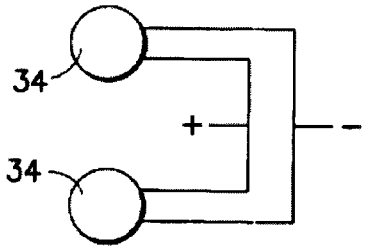
Figure 24E:
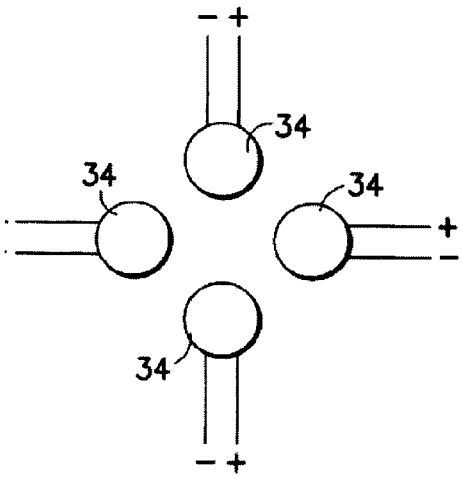
Figure 24D:
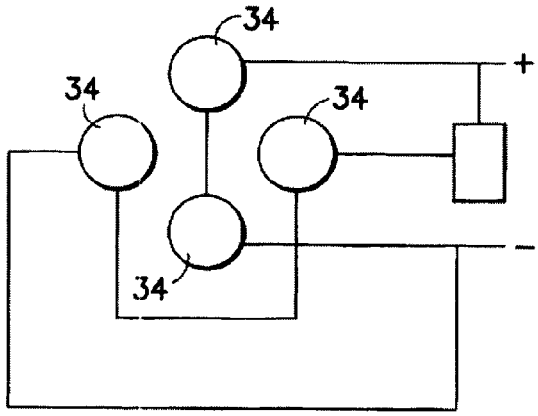

The coils in each motor in a multi-motor driver according to the present invention may be series connected as illustrated by FIG. 24A (a loudspeaker driver with two motors) and FIG. 24B (four motors), parallel connected (FIG. 24C), a combination of two series connected two motor circuits parallel connected (FIG. 24D), or each motor can be individually connected to a signal source without being connected to another motor (FIG. 24E).

One advantage of a driver arrangement according to the present invention is that the same mechanical power can be transmitted to the diaphragm using two or more smaller motors as a single large motor. Given that large magnets are expensive, the cost of the loudspeaker driver may be reduced without sacrificing performance.

Another advantage of the present invention is that the depth of the loudspeaker driver can be reduced thus allowing the depth of the cabinet to be reduced. As a result low profile (thickness) speaker cabinets can be used with a loudspeaker driver according to the present invention.

Moreover, a driver arrangement according to the present invention allows for widening the diaphragm without increasing the depth of the driver. Thus, a driver having a large area diaphragm can have the same depth as a smaller area diaphragm.

Figure 25:
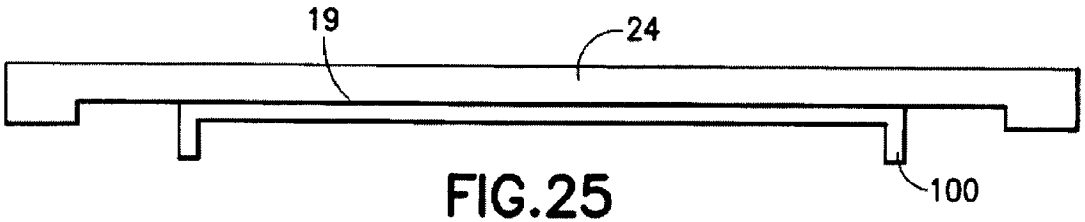
FIG. 25 illustrates a cylindrical diaphragm in combination with a transmission frame according to another embodiment of the present invention.

FIG. 25 illustrates a cylindrical diaphragm 100 in combination with a transmission frame 24 according to the present invention which can replace the combination of a cone-shaped diaphragm and a transmission frame 24 in each embodiment disclosed herein. The replacement of a cone-shaped diaphragm with a cylindrical diaphragm 100 allows for more volume of air to be moved without changing the diameter given an equal height. Furthermore, it may allow for the same volume of air that is moved by a cone of a certain diameter with a shallower depth. Thus, the height of the diaphragm and transmission frame combination may be reduced, thereby allowing for further reduction of the depth of the loudspeaker driver. Note also that frame 24 may be connected with adhesive 19 or the like to a larger area at the back surface of the cylindrical diaphragm 100 which may result in a more secure coupling and better transmission of the mechanical force from motors 20, 22 to cylindrical diaphragm 100.

Note further that according to the present invention, in each embodiment disclosed herein, the voice coil of each driver that is suspended in a magnetic field is disposed lateral to and outside the open mouth of the diaphragm. The open mouth of the diaphragm in each embodiment is defined by a terminal boundary 99 residing at the outermost lateral edge of the diaphragm (which in some embodiments shown herein is coupled to the surround/suspension) surrounding the entire interior surface area 97 of the diaphragm. Thus, each voice coil in each embodiment disclosed herein is disposed lateral to and outside of the interior region 95 defined by the outermost edge of the diaphragm.

According to another aspect of the present invention, rather than having two motors lateral to the outer to and outside the open mouth of the diaphragm one or more motors are disposed between two motors and connected to the back of the two diaphragms using a transmission frame as disclosed above.

Referring, for example, to FIGS. 26-34, in which like numerals identify like features disclosed herein, a motor 20 is disposed lateral to the outer edge of at least two diaphragms 16 on a support body 42. Motor 20 may be secured to support body 42 using an adhesive or the like. A transmission frame 24 is then coupled to former 35 of motor 20 using an adhesive 19' or the like and coupled at each terminal free end thereof to a back surface of a respective diaphragm 16 using an adhesive or the like as specifically illustrated by FIG. 34. As disclosed earlier, the motion of former 35 along the central axis thereof causes the motion of transmission 24 along the same axis which in turn causes the motion of diaphragms 16 along the central axis 17 thereof.

Figure 26:
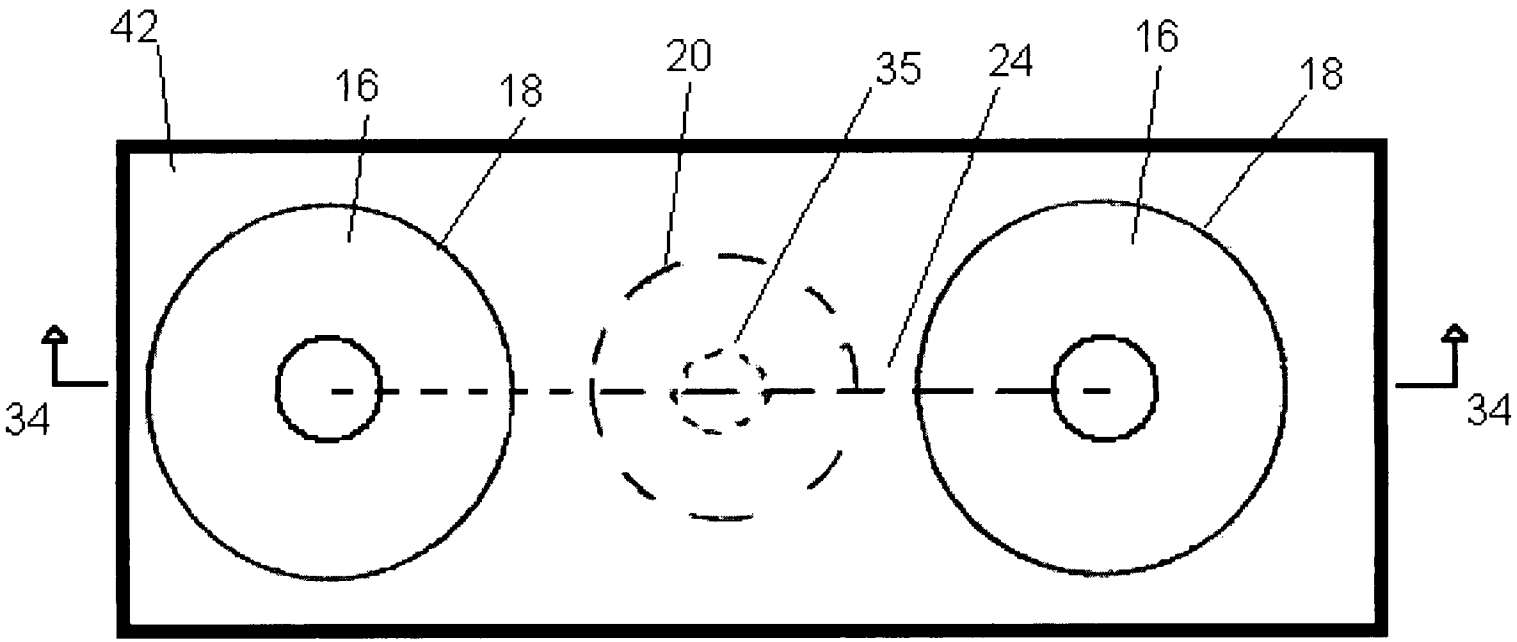
FIG. 26 illustrates a front plan view of a loudspeaker driver according to another embodiment of the present invention.
Figure 27:
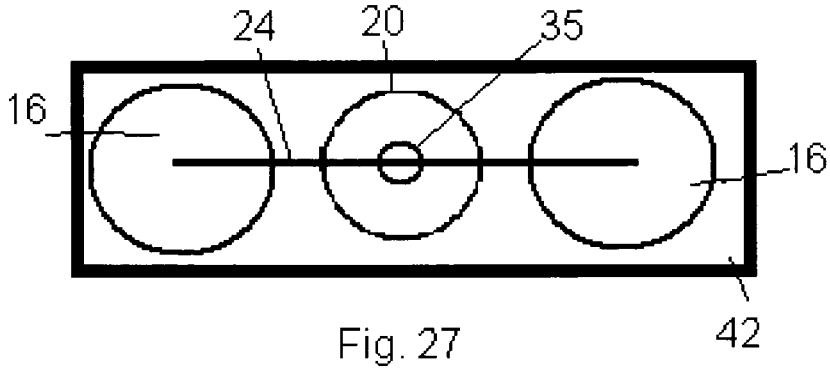
FIG. 27 illustrates a back plan view of a loudspeaker driver according to FIG. 26.
Figure 28:
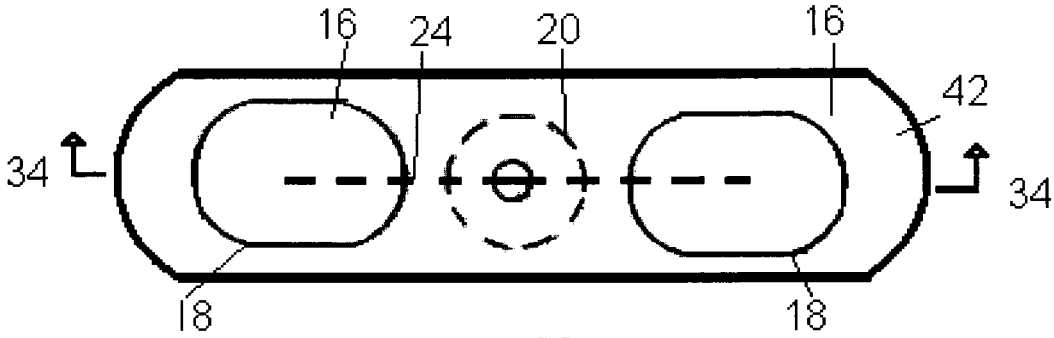
FIG. 28 illustrates a front plan view of a loudspeaker driver according to another embodiment of the present invention.
Figure 29:
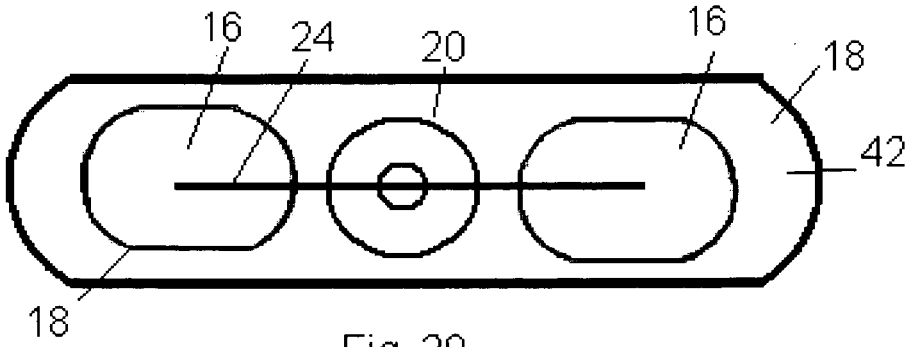
FIG. 29 illustrates a back plan view of a loudspeaker driver according to FIG. 28.

In the embodiment illustrated by FIGS. 26 and 27 conically shaped diaphragms are used while in the embodiment illustrates by FIGS. 28 and 29 oval or race track shaped diaphragms 16 are used. Furthermore, in the embodiments disclosed by FIGS. 26-29 two diaphragms 16 and an elongated bar shaped transmission frame 24 are used.

Figure 30:
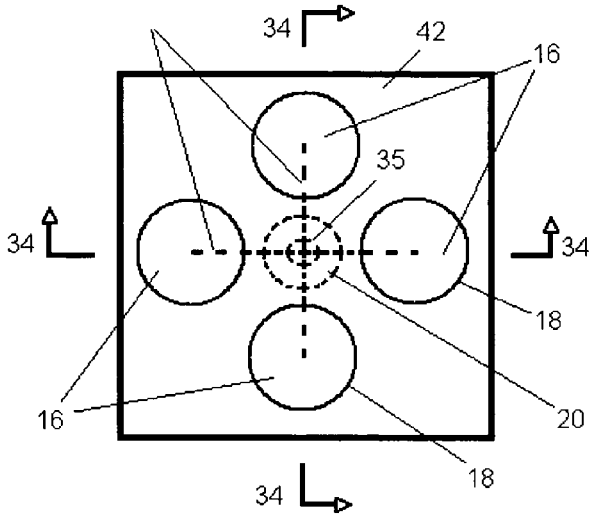
FIG. 30 illustrates a front plan view of a loudspeaker driver according to another embodiment of the present invention.
Figure 31:
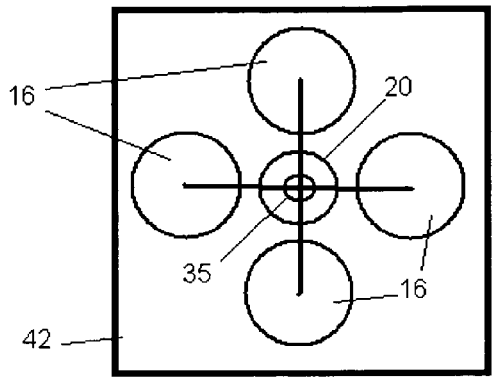
FIG. 31 illustrates a back plan view of a loudspeaker driver according to FIG. 30.

Referring now to FIGS. 30 and 31, in which like numerals identify like features, four diaphragms are used instead of two. Furthermore, former 35 is coupled to respective back surfaces of diaphragms 16 using a cross-shaped transmission which is coupled using an adhesive or the like at the central portion thereof to former 35 and coupled at terminal free ends thereof to respective back surfaces of diaphragms 16.

Figure 32:
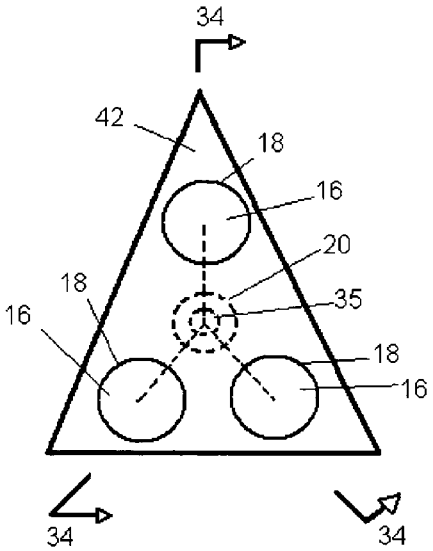
FIG. 32 illustrates a front plan view of a loudspeaker driver according to another embodiment of the present invention.
Figure 33:
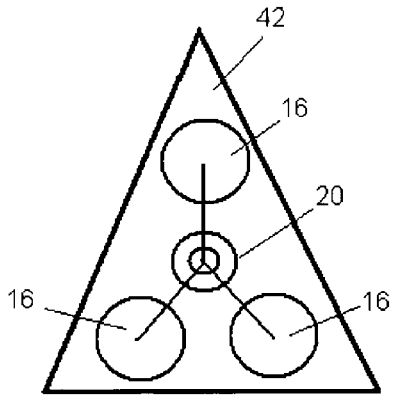
FIG. 33 illustrates a back plan view of a loudspeaker driver according to FIG. 32.
Figure 34:
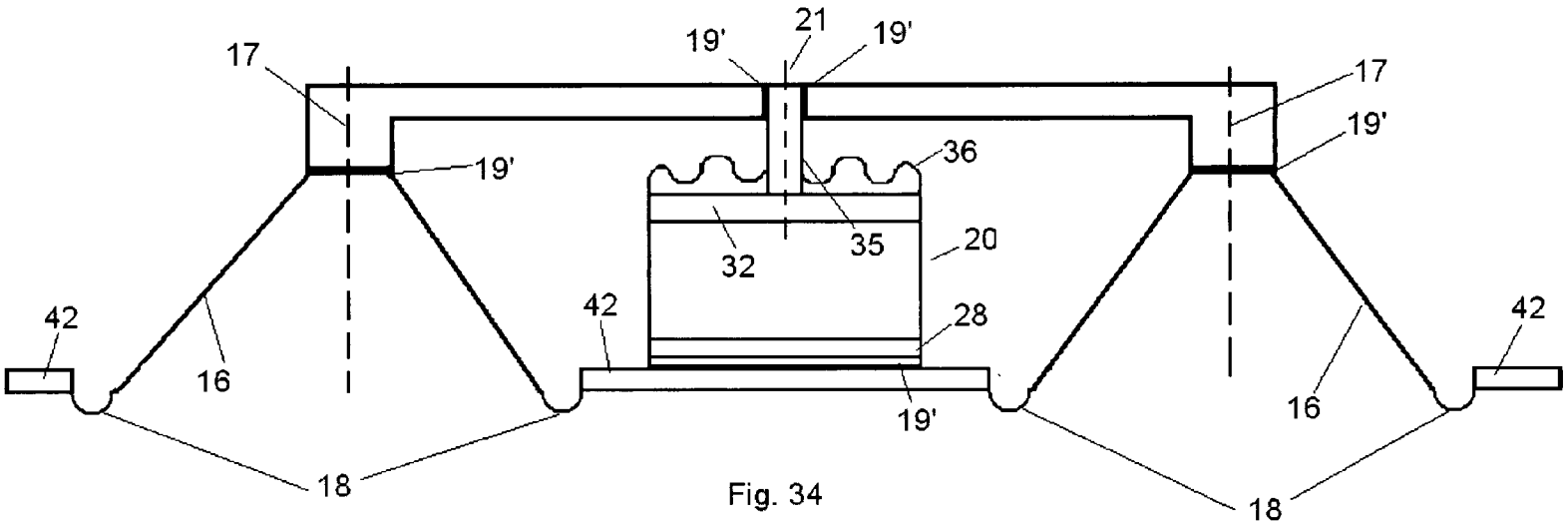
FIG. 34 is a cross-sectional view along line 34 in each one of the embodiments illustrated in FIGS. 26-33 viewed in the direction of the arrows.

Referring now to FIGS. 32 and 33, in yet another embodiment, three diaphragms 16 are arranged around motor 20 each preferably at an equal angular spacing from the other two diaphragms. A three-legged transmission 24 is coupled using adhesive or the like at the center thereof to former 35 of motor 20, while each free terminal end of each leg of transmission 24 is coupled to the back of a respective diaphragm.

Referring now to FIGS. 35-38, and 46-47, in which like numerals identify like features, according to another aspect of the present invention two motors 20, 22 are disposed on a support frame 42 between at least two diaphragms 16. Motors 20 and 22 can be secured to support frame 42 using an adhesive 19' or the like. A cross-shaped transmission 24 can couple the two motors to the back surface of diaphragms 16. Specifically, cross-shaped transmission 24 includes two bar portions 24' crossing one another. Each bar portion 24' includes a terminal free end. Terminal free ends of one bar portion 24' are coupled using adhesive 19' or the like to former 35 of motors 20 and 22 respectively (see FIG. 47), while terminal free ends of the other bar portion 24' is coupled to respective back surfaces of diaphragms 16 (see FIG. 46) using adhesive 19' or the like.

Figure 37:
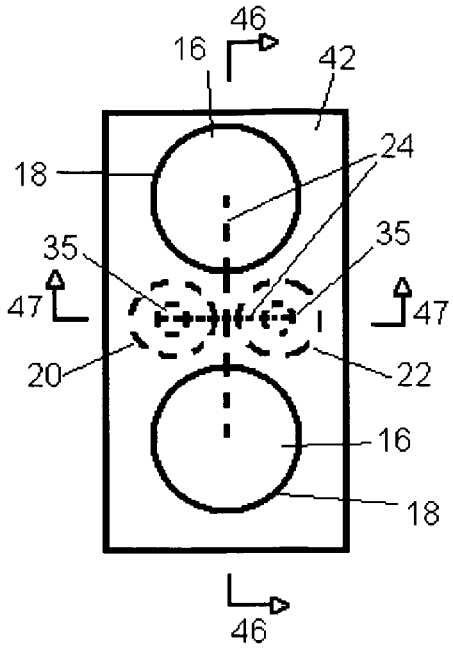
FIG. 37 illustrates a front plan view of a loudspeaker driver according to another embodiment of the present invention.
Figure 38:
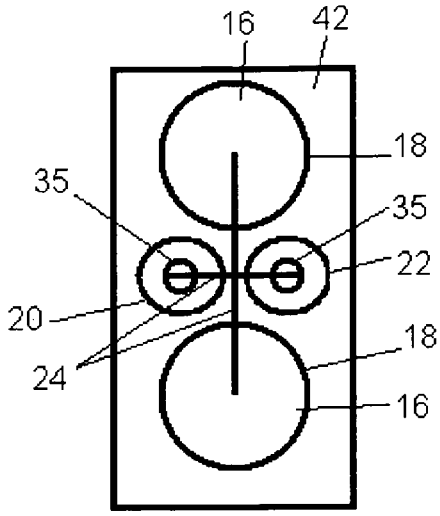
FIG. 38 illustrates a back plan view of a loudspeaker driver according to FIG. 37.
Figure 35:
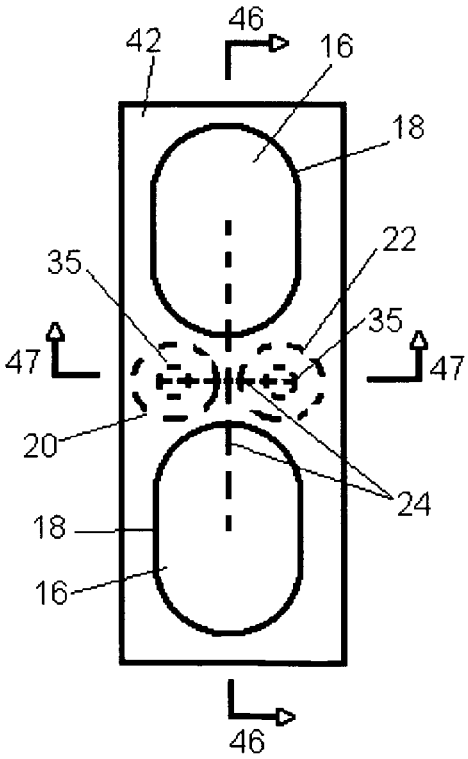
FIG. 35 illustrates a front plan view of a loudspeaker driver according to another embodiment of the present invention.
Figure 36:
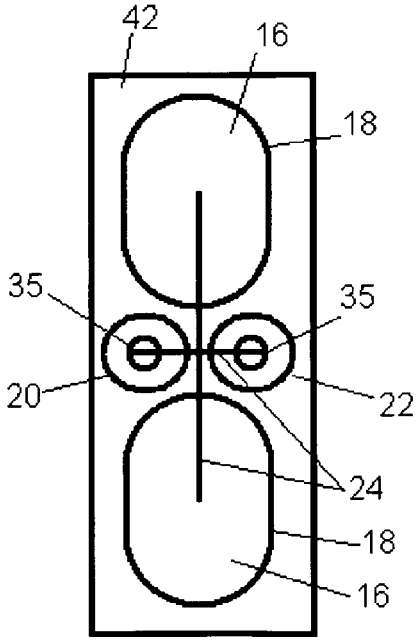
FIG. 36 illustrates a back plan view of a loudspeaker driver according to FIG. 35.

Note that in the embodiment illustrated by FIGS. 35 and 36 diaphragms 16 are oval or racetrack shaped while in the embodiment illustrated by FIGS. 37 and 38 diaphragms 16 are conical. Note further than motors 20,22 can be connected electrically in series, in parallel, or each may be connected to a different signal source.

Figure 40:
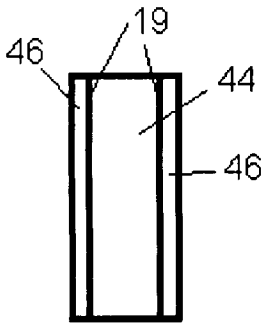
FIG. 40 shows a cross-sectional view along line 40-40 in FIG. 39 viewed in the direction of the arrows.
Figure 41:
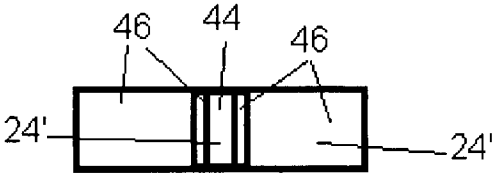
FIG. 41 shows a cross-sectional view along line 41-41 in FIG. 39 viewed in the direction of the arrows.
Figure 39:
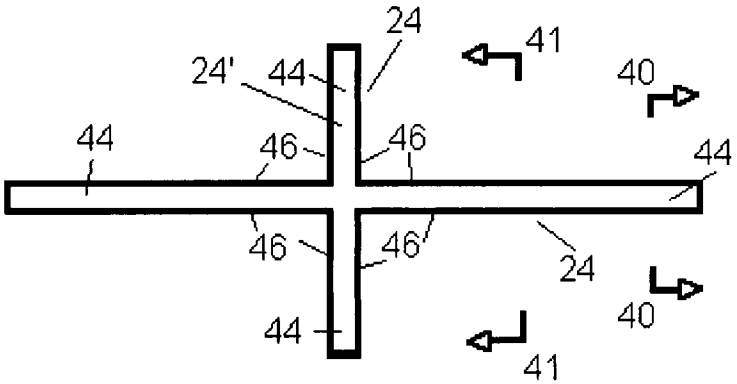
FIG. 39 shows a top plan view of a cross-shaped transmission as used in some embodiments of the present invention.

Referring now to FIGS. 39 to 41, a cross-shaped transmission 24, which may include two bar-shaped portions 24', is preferably constructed by adhering two metallic webs 46 (example aluminum webs 46) to the opposing outside surfaces of a core 44 using preferably an adhesive. Note that core 44 may be comprised of foam core, cardboard, or styrofoam. Other constructions such as the construction disclosed above can also be used without deviating from the present invention.

Figure 42:
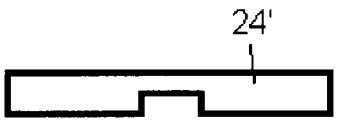
FIGS. 42 and 43 illustrate side plan views of transmission portions of a cross-shaped transmission according to one arrangement.
Figure 43:
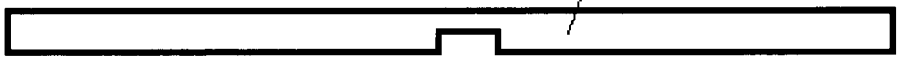

Referring now to FIGS. 42 and 43, to construct a transmission 24 using two separate portions 24' a recess or notch 24" is provided in each portion 24'. Each recess or notch 24" is aligned with the other and an adhesive or the like may be then used to secure portions 24" to one another to obtain a cross-shaped transmission 24.

Figure 44:
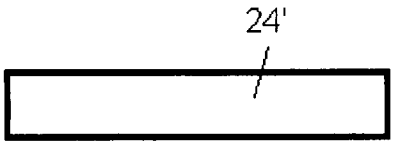
FIGS. 44 and 45 illustrate side plan views of transmission portions of a cross-shaped transmission according to another arrangement.
Figure 45:
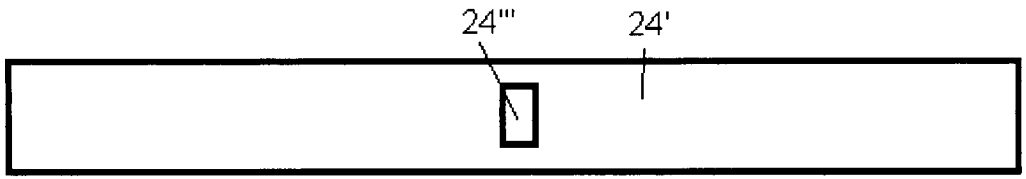
Figure 46:
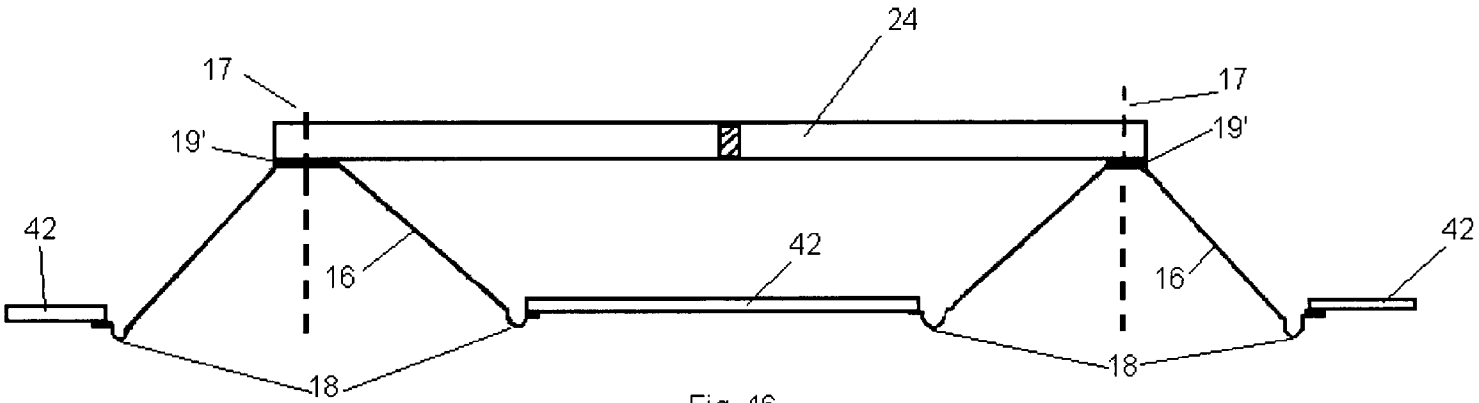
FIG. 46 shows a cross-sectional view along line 46-46 in FIGS. 35 and 37 viewed in the direction of the arrows.
Figure 47:
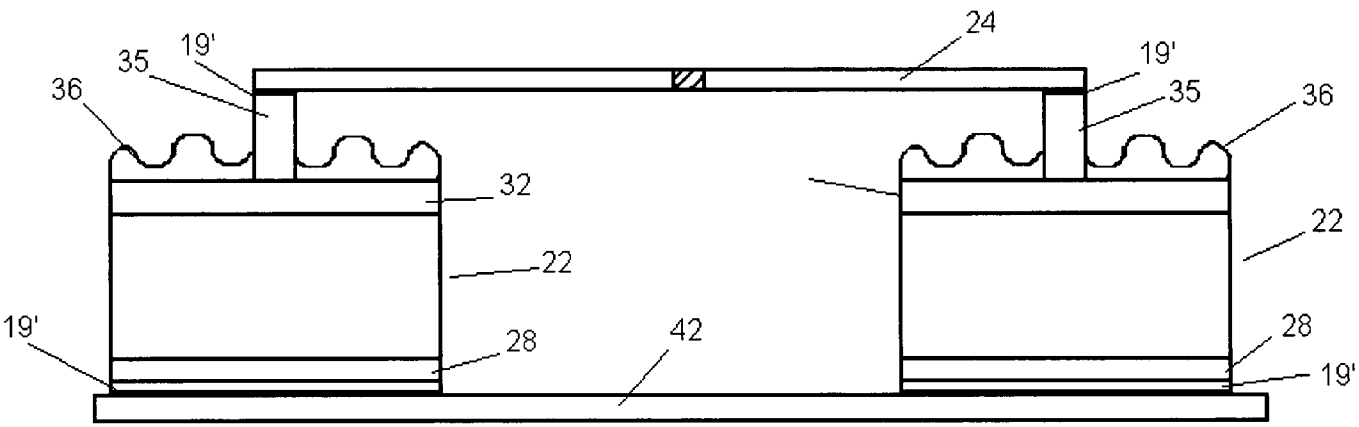
FIG. 47 shows a cross-sectional view along line 47-47 in FIGS. 35 and 37 viewed in the direction of the arrows.

Referring to FIGS. 44 and 45, alternatively, one of the portions 24" (preferably the longer of the two portions 24") can be provided with an opening 24" to receive the other of the two portions 24" to obtain a cross-shaped transmission 24. Adhesive or the like may be then used to further secure the two portions to one another.

Alternatively, a single cross-shaped transmission shape may be punched out of a sheet of aluminum metal.

It should be noted that in each of the embodiments depicted by FIGS. 26-27, the loudspeaker driver includes a plurality of diaphragms that are spaced laterally from one another, and a driving section (that includes at least one motor) that drives the diaphragms is disposed only in the space between the diaphragms. That is, a driving section is located in a position lateral to and between the open mouths of the diaphragms.

Note that a motor 20 or motors 20,22 may be partially or fully received or embedded in the support 42. That is, for example, support 42 may be provided with a recess (partial embedding) or a through opening (full embedding which allows the back of the motor to be exposed through support 42) in which a motor may be received.

Referring now to FIGS. 48A-48B, and 48C-48E, a loudspeaker driver according to another embodiment of the present invention includes a pan-shaped support 360, which may be formed with stamped metal or the like. Support 360 includes a circular opening 460 therein at the bottom thereof. The opening is large enough to receive a diaphragm/cone 340 (e.g. paper cone or the like) having a surround 380 (e.g. foam or rubber surround) attached to the edge of the base thereof (i.e. the large mouth of cone 340). The outer edge of surround 380 is then attached to the edge of opening 460 (identified as flange 440), whereby cone 340 is attached to support 360 for movement along the cental axis thereof much like a conventional cone-based loudspeaker driver. At least two motors 100 are attached using a proper adhesive, for example, to the bottom interior surface of pan-shaped support 360 opposite one another and at the edge of opening 460. Note that preferably motors 100 extend partially over opening 460 to be as close as possible to one another without interfering with the motion of cone 340. A transmission 420 is coupled to a back surface (surface facing away from interior of support 360) of cone 340 as close to the central axis of cone 340. Each end of transmission 420 is coupled to a respective former 220 of a motor 100, whereby the motion of formers 220 along the central axis thereof will cause the corresponding motion of cone 340 along its central axis. Examples of proper transmissions are disclosed above. Support 360 includes a plurality of mounting holes disposes along the bottom surface thereof for mounting a driver according to the present invention on a front board of a speaker cabinet or the like such that the interior of cone 340 faces the outside of the cabinet. Note that a seal or the like may be disposed inside support 360 along the edges thereof to prevent or at least hinder the free transmission of air into and out of the speaker cabinet.

Figures 48A, 48B, 48C:
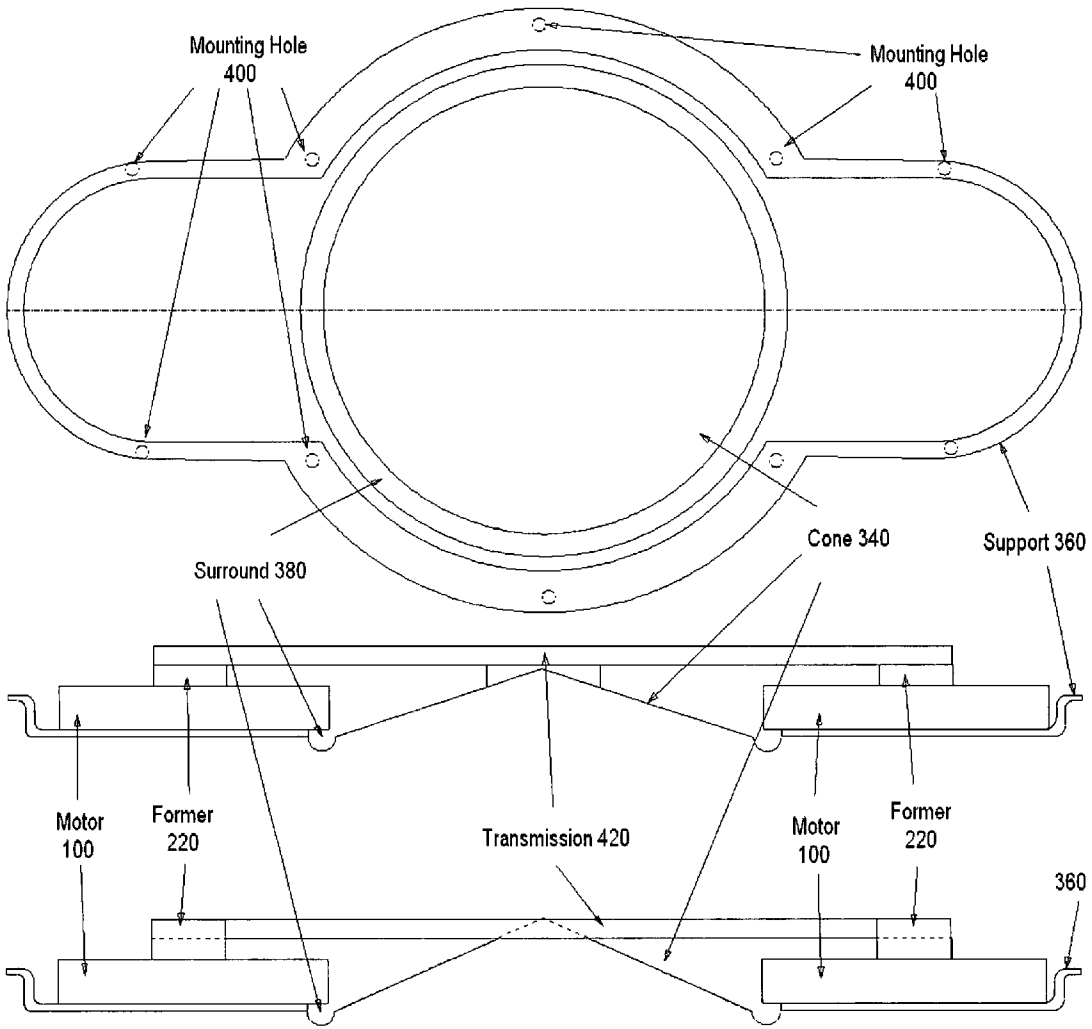
FIG. 48A shows a front plan view of a driver according to another embodiment of the present invention.
FIG. 48B shows a cross-sectional view of a driver according to one variation of the embodiment shown by FIG. 48A along the broken line in FIG. 48A.
FIG. 48C shows a cross-sectional view of a driver according to another variation of the embodiment shown by FIG. 48A along the broken line in FIG. 48A.
Figures 48D, 48E:
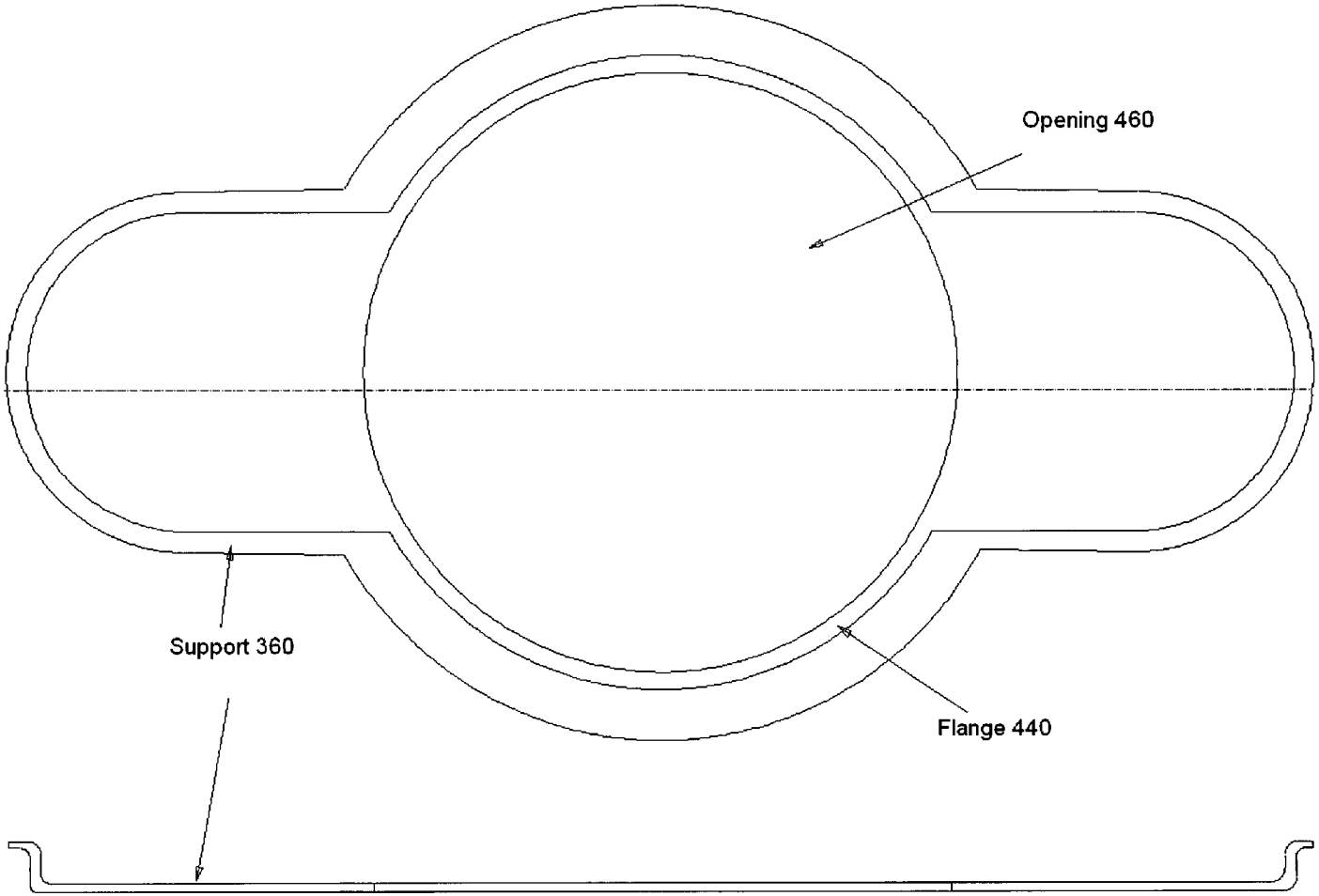
FIG. 48D shows a front plan view of a support for the embodiments shown by FIGS. 48A-48C.
FIG. 48E shows a cross-sectional view of the support shown in FIG. 48D along the broken line shown therein.
Figure 49A:
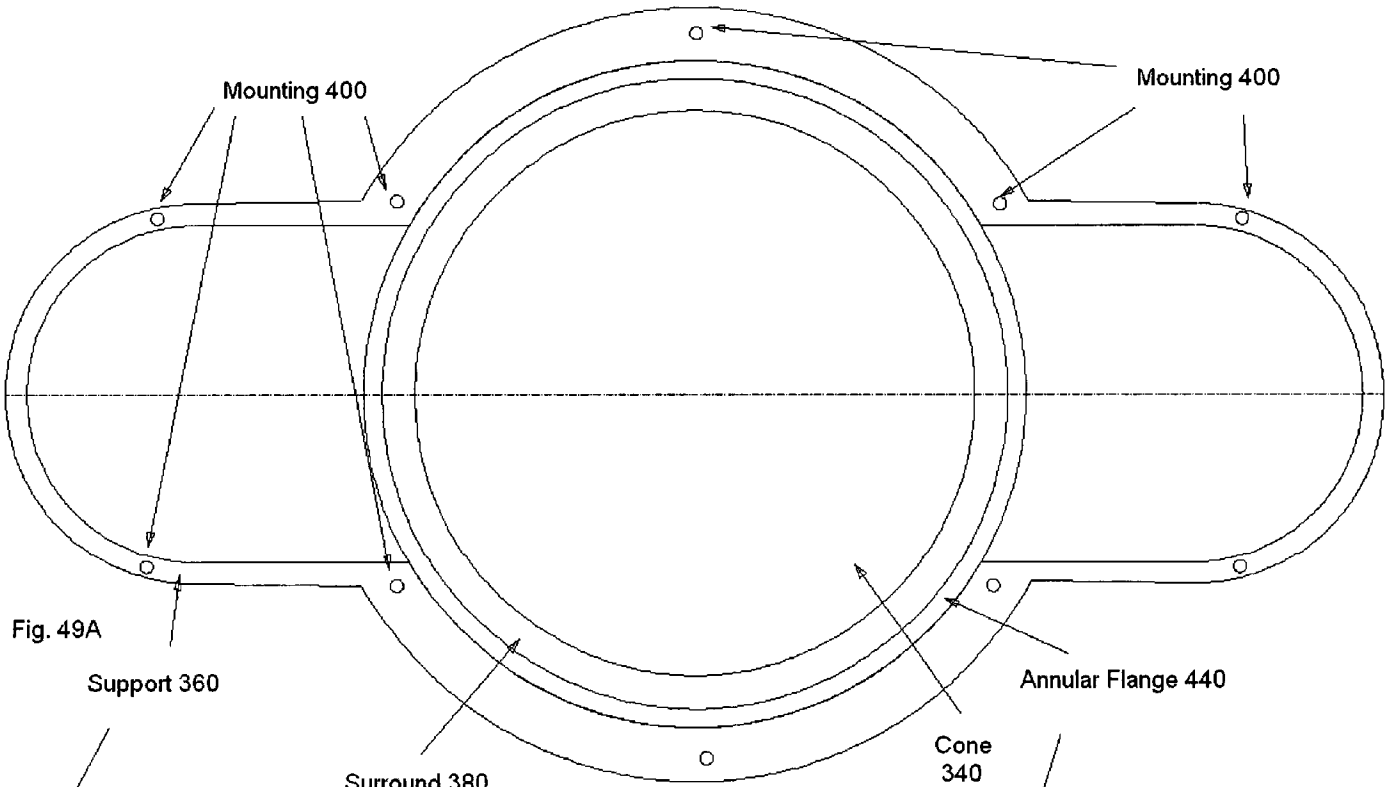
FIG. 49A shows a front plan view of a driver according to another embodiment of the present invention.
Figure 49B:
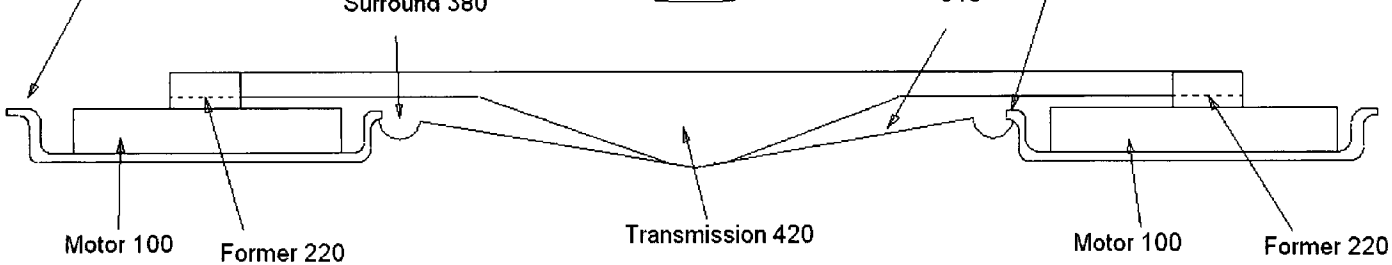
FIG. 49B shows a cross-sectional view of a driver according to a variation of the embodiment illustrated by FIG. 49A along the broken line in FIG. 49A.
Figures 49C, 49D:
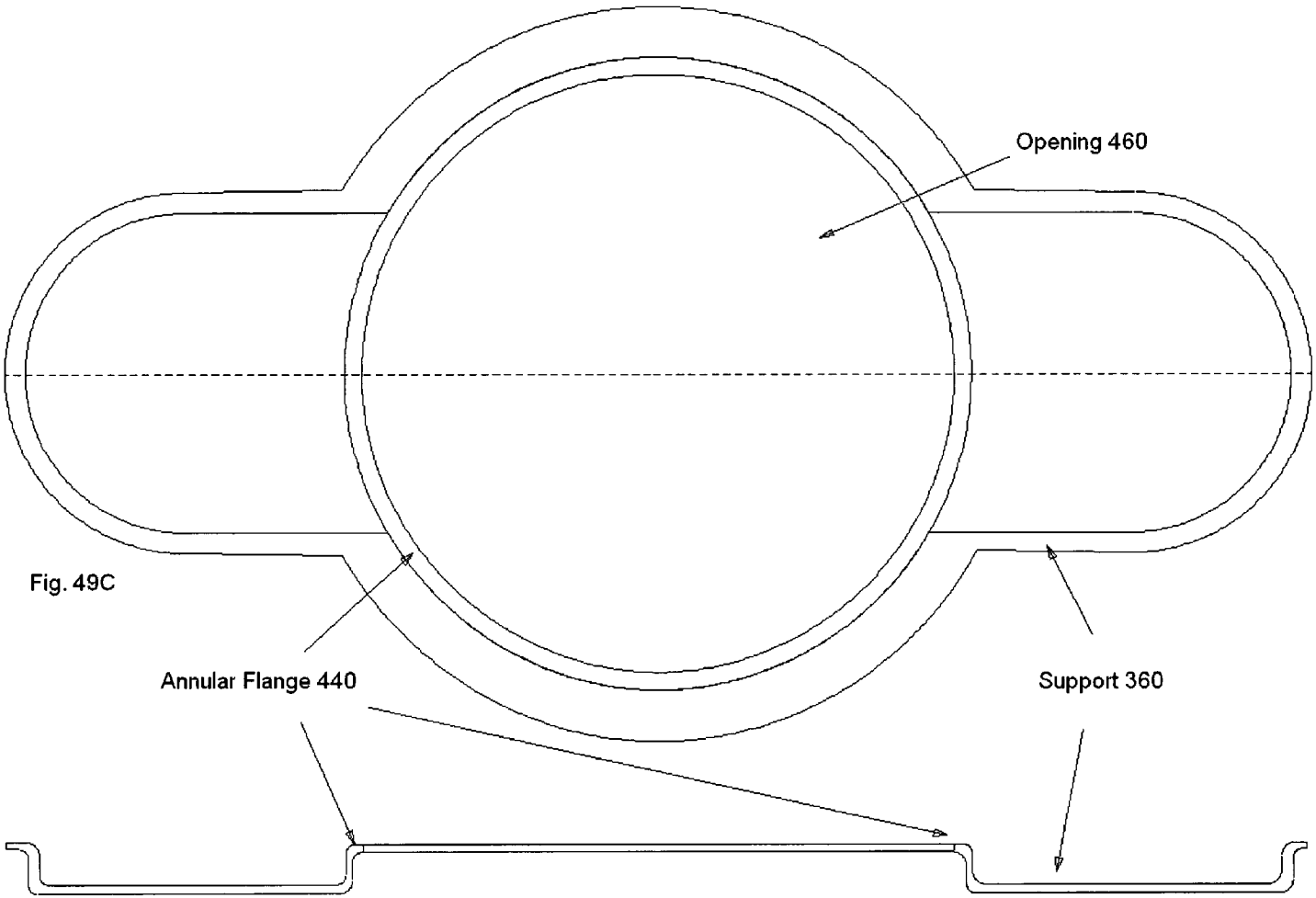
FIG. 49C shows a front plan view of a support for the embodiment shown by FIGS. 49A and 49B.
FIG. 49D shows a cross-sectional view of the support shown in FIG. 49C along the broken line shown therein.

The embodiment illustrated by FIG. 48B includes a transmission which is coupled to the exterior surface of back surface of cone 340, and the top edge of each former.

Referring to FIG. 48C, in which like numerals identify like features, transmission 420 may be embedded in the body of either cone 340, or each former 220, or both as illustrated. Thus, for example, a cut may be made in the body of cone 340 and transmission 420 may be received therein and coupled to the body of cone 340. Similarly, a cut may be made in each former 220 and an end of transmission 420 may be received therein and coupled to the body of former 220.

Referring now to FIGS. 49A-49D, in which like numerals identify like features, a loudspeaker driver according to another embodiment includes a support 360 having two oppositely disposed depressions at flange 440 that defines opening 460. A motor 100 is coupled using an adhesive or the like to the bottom of each depression. Consequently, motors 100 are disposed opposite one another at flange 440.

Furthermore, in a driver as depicted by FIGS. 49A-49D cone 340 is assembled such that the interior thereof, upon installation in a speaker cabinet, faces the interior of the cabinet. That is, cone 340 is inverted. Transmission 420 is then coupled to the interior surface of cone 340 as close to the central axis of cone 340. Optionally, and as illustrated, each end of transmission 420 is received in the body of a respective former 220 and coupled thereto as described above. An arrangement according to the present invention may reduce the mounting depth of the driver, and may allow for an increase in the volume of air within the cabinet in that the interior surface of cone 340 would face the interior of the cabinet upon installation of the driver. Note that support 360 includes a flanged peripheral edge that receives mounting holes 400 for the installation of the driver. A seal or the like may be optionally applied to the flanged edge of support 360 in order to prevent/hinder transmission of air into and out of the cabinet once the driver is installed.

Referring now to FIGS. 50A-50B, and 50C-50E, in which like numerals identify like features, a driver according to yet another embodiment includes all features of the first embodiment shown by FIGS. 48A-48C, except that support 360 thereof further includes a ring shaped depression disposed around opening 460 and spaced from annular flange 440. Ring shaped depression extends outwardly, i.e. away from the interior of the cabinet once the driver is installed. The ring shaped depression may add strength to support 360, and may also function as a frame for the installation of a dust cover or the like.

Figure 50A:
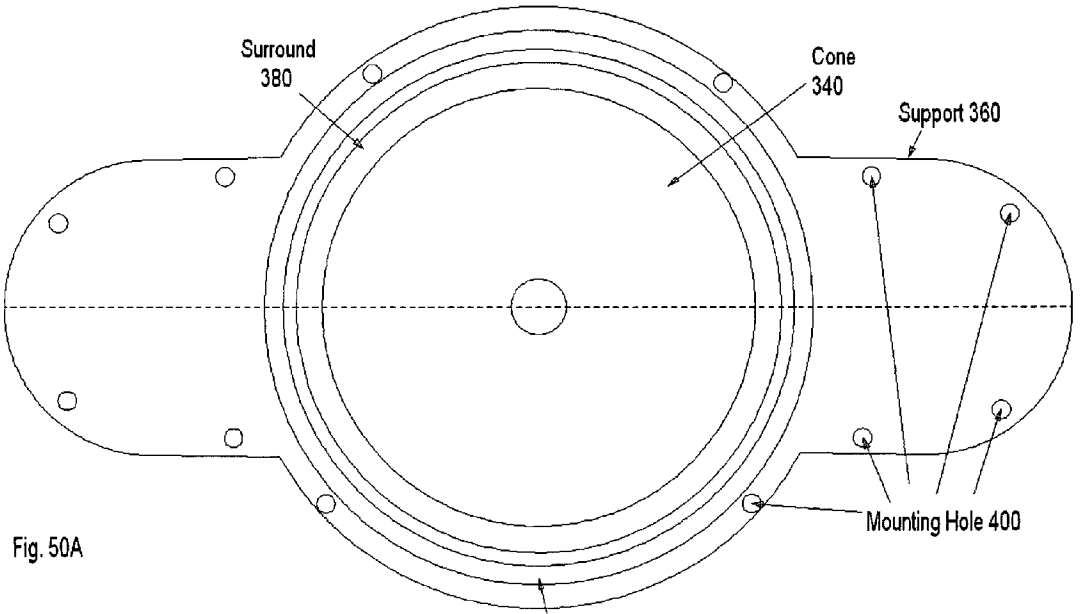
FIG. 50A shows a front plan view of a driver according to another embodiment of the present invention.
Figure 50B:
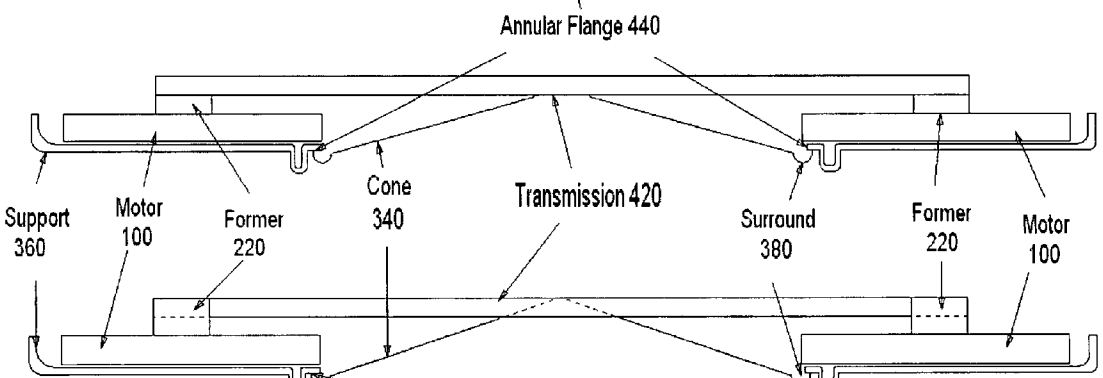
FIG. 50B shows a cross-sectional view of a driver according to a variation of the embodiment shown by FIG. 50A along the broken line in FIG. 50A.
Figure 50C:
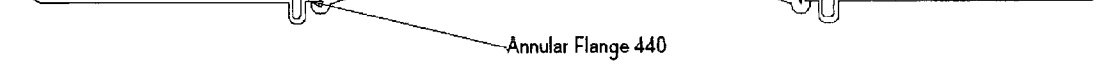
FIG. 50C shows a cross-sectional view of a driver according to a variation of the embodiment shown by FIG. 50A along the broken line in FIG. 50A.
Figures 50D, 50E:
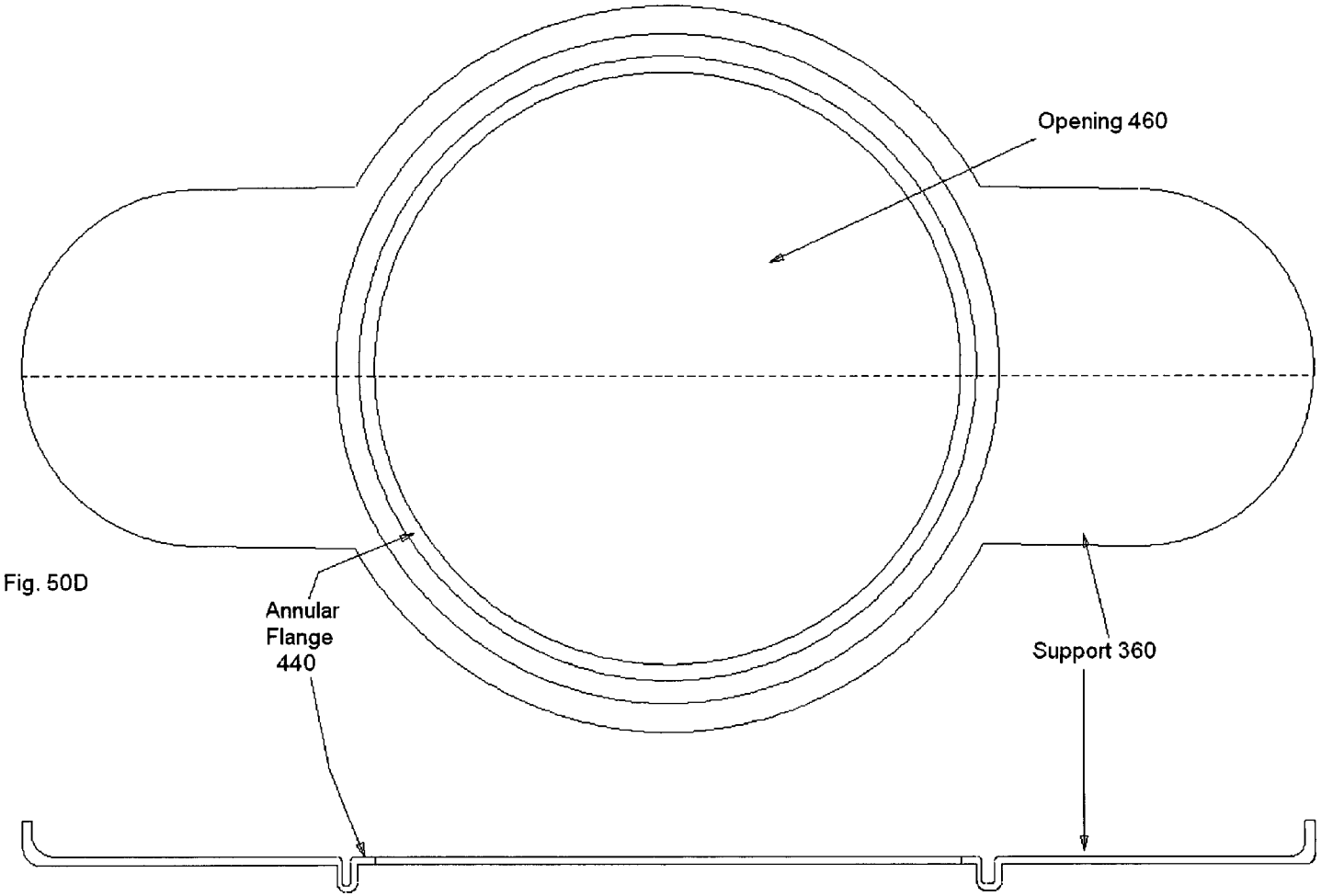
FIG. 50D shows a front plan view of a support for the embodiments shown by FIGS. 50A-50C.
FIG. 50E shows a cross-sectional view of the support shown in FIG. 50D along the broken line shown therein.

Referring now to FIG. 50C, in which like numerals identify like features, transmission 420 is received in the body of cone 340 and/or the body of formers 220 as described earlier.

In each embodiment, transmission 420 may be coupled to formers 220 and cone 340 using an appropriate adhesive, e.g. an epoxy glue or the like. Similarly, surround 380 may be coupled to support 360 and to cone 340 using appropriate adhesives, and motors 100 can be secured to support 360 using an appropriate adhesive applied to back plate 140 thereof. A cone 340 in a driver according to the present invention may be large, e.g. five inches or more in diameter, and made from pressed paper or any other suitable material including aluminum or a polymer.

With the exception of the embodiments depicted by FIGS. 22C-22E, and 23C the above embodiments have been disclosed in U.S. Pat. No. 7,515,724 (Inventor: Kourosh Salehi) and U.S. patent application Ser. No. 12/322,969 entitled Loudspeaker Driver filed Feb. 9, 2009 by Kourosh Salehi. As set forth below the above embodiments can be further improved with a novel rearrangement of the transmission frame and novel modifications to the motors.

Figure 51A:
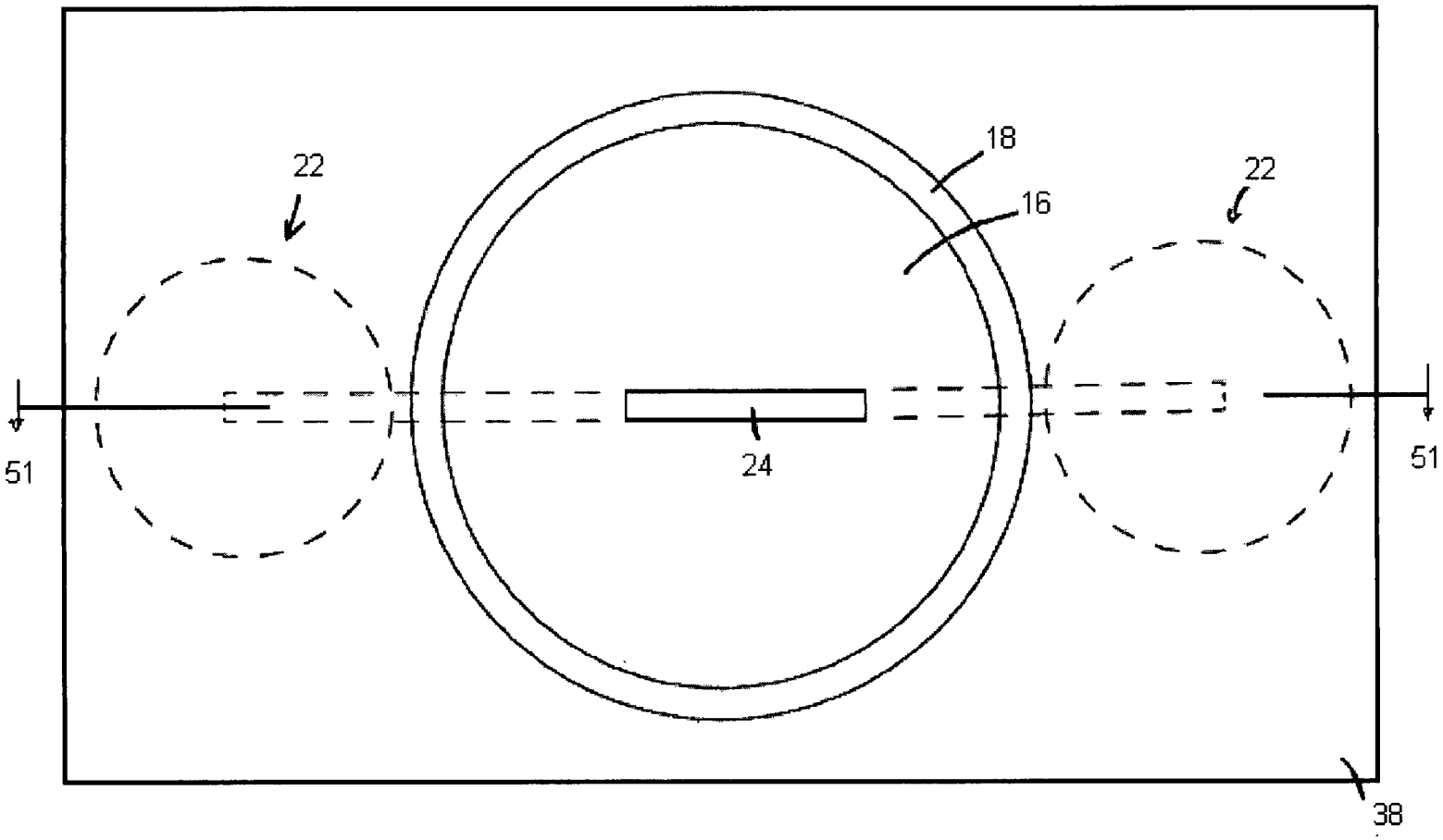
FIG. 51A illustrates a loudspeaker driver according to another embodiment of the present invention having a front board for a support thereof.

Referring now to FIGS. 51A-51C, in which like numerals identify like features, a driver according to the present invention includes a transmission frame 24 mechanically coupled at each respective terminal end portion thereof to a portion of the former 35 of a voice coil of a respective motor 20,22 positioned below the spider 36 and top plate 32 (between the top plate 32 and back plate 28) as opposed to the portion of the former 35 above the top plate 32 and the spider 36. Thus, for example, transmission frame 24, which can be any one of the transmission frames disclosed above but is preferably a bar-shaped body made of aluminum or the like, can extend from the former 35 of the voice coil of one motor 20 under the spider 36 and top plate 32 thereof (instead of passing over the spider 36 thereof), emerge from the side of the one motor 20, penetrate through the back (the surface that would face the interior of the cabinet) of a movable conically shaped diaphragm 16 into the interior space defined by the interior surface (the surface that would face the outside of the cabinet) of the conically shaped diaphragm 16, pass through the diaphragm 16 from the interior surface thereof and extend through a side surface of another motor 22 under its spider 36 and top plate 32 and mechanically coupled to the former 35 of the voice coil thereof. It should be noted that as illustrated by FIG. 51A the motors 20,22 can be mounted on the interior surface (the surface facing the interior of the cabinet) of front board 38 of the cabinet or as illustrated by FIG. 51B the motors 20,22 can be mounted on the interior surface (the surface facing the interior of the cabinet) of support frame 42. It should be further noted that the motors 20,22 may be partially embedded in the front board 38/support frame 42 or may extend through openings in the front board 38/support frame 42 in the manner set forth above without deviating from the scope and spirit of the present invention.

Diaphragm 16 is rendered movable along its motion axis by surround 18 which is attached to diaphragm 16 and supports the same in the opening in front board 38 or support frame 42 as described above. Thus, when the motors are operated diaphragm 16 moves along its motion axis 19 which extends in the same direction as motion axes 21,23 of the motors. Thus, in the driver illustrated by FIGS. 51A-51C, and also the drivers described below, the movable diaphragm 16 includes an open mouth defined by a terminal boundary residing at the outermost lateral edge thereof surrounding the entire interior surface area of the diaphragm and at least one driver arrangement (e.g. motor 20, 22) residing lateral to and outside the open mouth the driver arrangement including a voice coil suspended in a magnetic field of a respective magnet, the voice coil being mechanically coupled to the movable diaphragm and including a motion axis disposed lateral to and outside the outermost lateral edge of the movable diaphragm, the voice coil being movable along a respective motion axis of its associated driver arrangement and being coupled mechanically to the diaphragm through a transmission frame which is disposed below the spider and between the top and bottom plates of the motor.

Figure 52B:
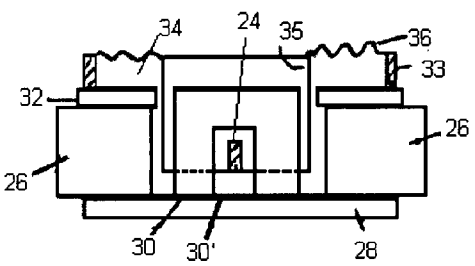
FIG. 52B is a cross-sectional view of each motor along line 51B-51B in FIG. 51C viewed in the direction of the arrows.
Figure 52A:
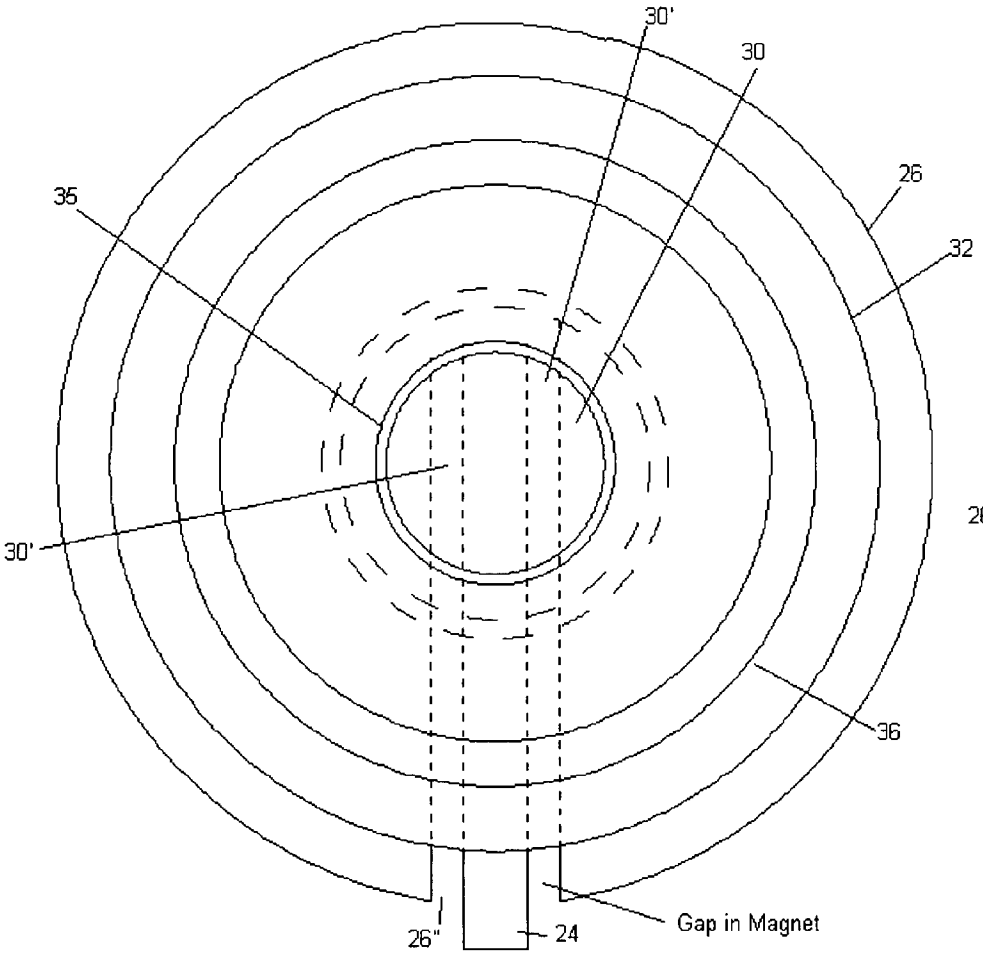
FIG. 52A is a view of the motors used in a loudspeaker driver according to FIGS. 51A-51C viewed in the direction of arrows 51A-51A.
Figure 55D:
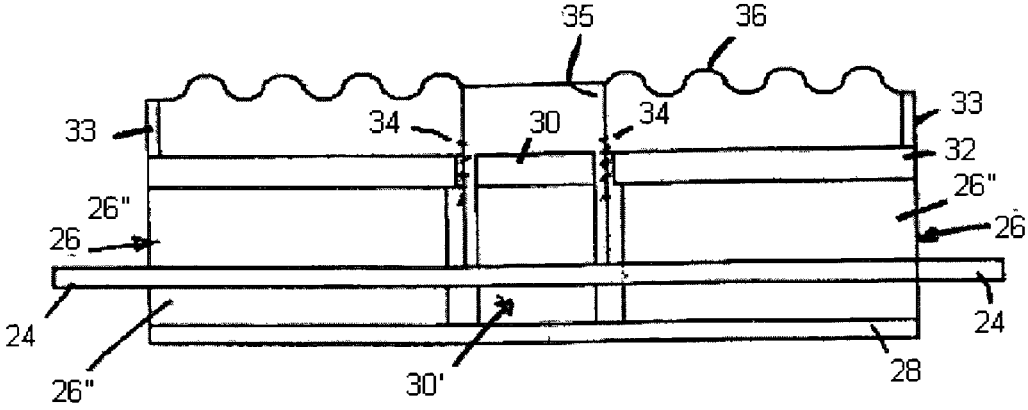
FIG. 55D shows a cross-sectional view of the motor and transmission arrangement along line 55D-55D viewed in the direction of arrows in FIG. 55B.
Figure 52C:
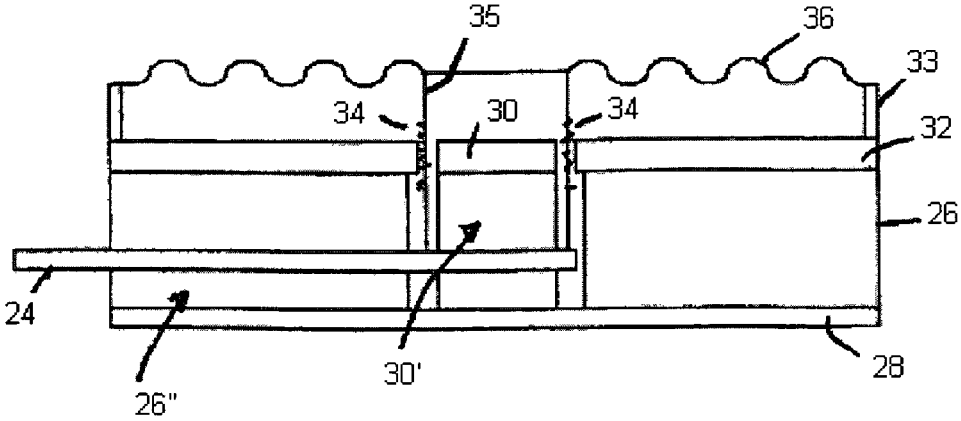
FIG. 52C is a cross-sectional view of the motors viewed along line 52C-52C viewed in the direction of the arrows.
Figure 52D:
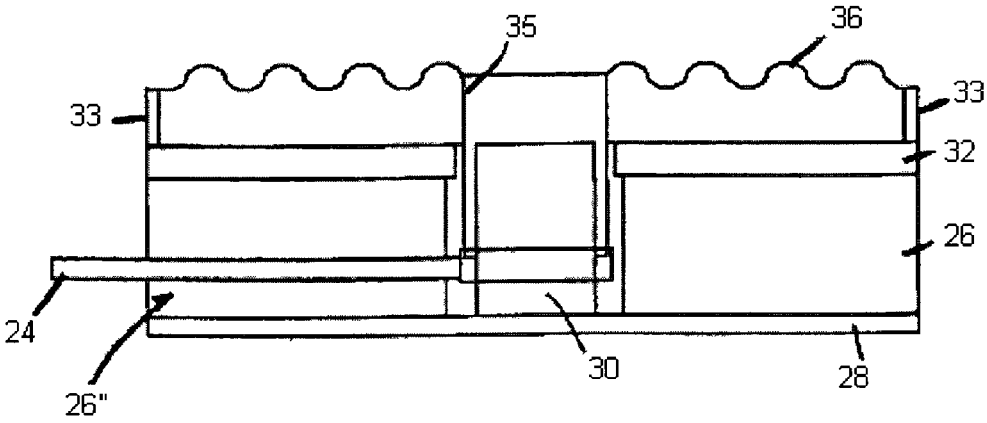
FIG. 52D is cross-sectional view of an alternative coupling arrangement coupling the transmission frame to the former of the motors in the embodiment illustrated by FIGS. 51A-51C.

Referring to FIGS. 52A-52C, in which like numerals identify like features, each motor 20,22 in a driver according to the present invention includes a magnet 26 having a radial gap or opening therein that extends from an exterior sidewall thereof to the interior sidewall thereof that is disposed around the pole piece 30. Each end of transmission frame 24 passes through gap 26" in the magnet 26 of a respective motor 20,22 and is coupled to the former 35 of the voice coil thereof. Thus, for example, as illustrated transmission frame 24 passes through the former 35 and is coupled to the same mechanically using for example glue or the like adhesive. In the preferred embodiment, pole piece 30 of each respective motor 20,22 includes an opening 30' that registers with the gap in the magnet 26 thereof which extends along a diameter of the circular cross-section of the pole piece 30 from one region on the exterior surface thereof to another directly opposite region on the exterior surface thereof. The vertical height of the gap 26" along the direction transverse to the radial direction of the gap 26" and the vertical height of the opening 30' in the pole piece 30 along the cental axis thereof are selected to allow the up and down motion of transmission body along a direction parallel to the motion axis of the voice coil and in accordance with the desired maximum excursion (so called Xmax) of the diaphragm 16. It should be noted that, although preferred, it may not be necessary to provide an opening 30' in the pole piece 30 if the terminal end of transmission body can be coupled mechanically to the exterior surface of the former 35 of the voice coil. For example, the terminal end can be glued directly to the exterior surface of the former 35 or a rigid ring or the like may be coupled to the exterior surface of the former 35 and the ring can be coupled to the terminal end of transmission body as illustrated by FIG. 52D whereby the opening in the pole piece 30 can be omitted.

Figure 53A:
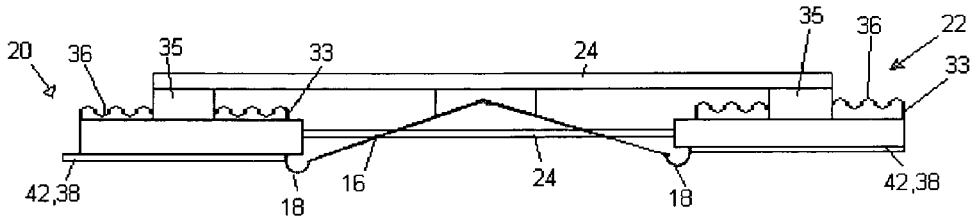
FIG. 53A illustrates a variation of a loudspeaker according to FIGS. 51A-51C further including another transmission frame coupled to the formers of the motors above the spiders and coupled to the back of the diaphragm.
Figure 53B:
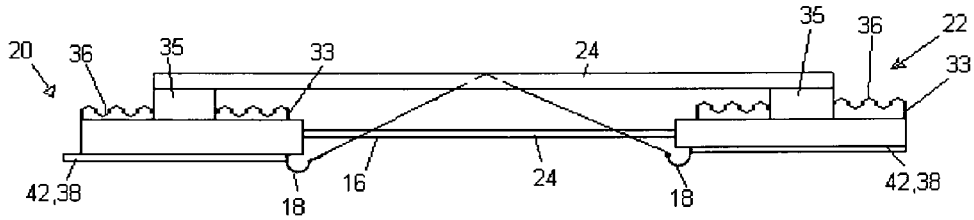
FIG. 53B illustrates a variation of a loudspeaker according to FIGS. 51A-51C further including another transmission frame coupled to the formers of the motors above the spiders and embbeded in the diaphragm.

Referring to FIG. 53A, in which like numerals identify like features, a second transmission frame 24 can be coupled to a portion of the former 35 of each motor 20,22 above the top plate 32 thereof, extend over the spider 36 thereof, and be coupled to the back of the diaphragm 16 using glue or the like. In the variation depicted by FIG. 53B, the second transmission frame 24 can be embedded in the body of diaphragm 16 and further mechanically secured to the same using a suitable glue or the like.

Figure 53C:
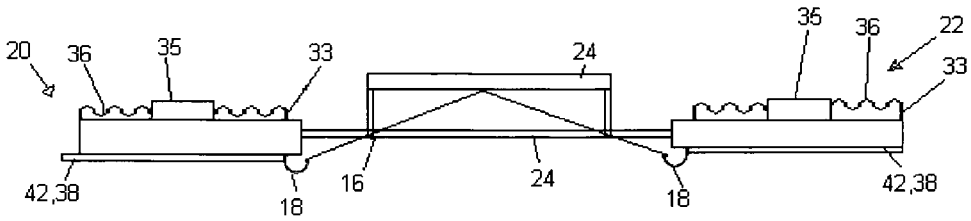
FIG. 53C illustrates a variation of a loudspeaker according to FIGS. 51A-51C including a transmission frame having one portion extendging through the body of the diaphragm and another portion coupled to the back of the diaphragm.
Figure 53D:
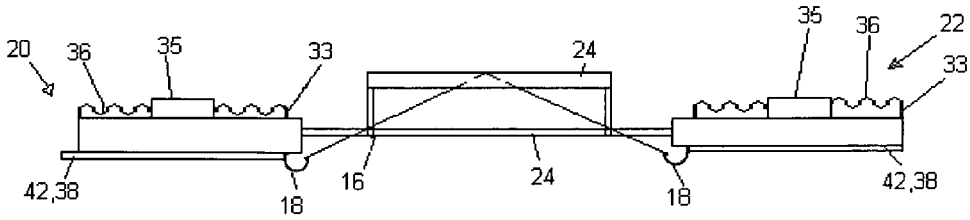
FIG. 53D illustrates a variation of a loudspeaker according to FIGS. 51A-51C including a transmission frame having one portion extendging through the body of the diaphragm and another portion coupled above the one portion and also extending through the back of the diaphragm.

Referring now to FIG. 53C, in which like numerals identify like features, transmission frame 24 may include a first portion 24A that is coupled to the former 35 of the motors 20,22 in the manner described above, and a second portion 24B which extends over and is coupled mechanically using glue or the like to the back of diaphragm 16. In the variation shown by FIG. 53D, the second portion of the transmission may be embedded in the body of diaphragm 16 and further mechanically secured to the same using glue or the like.

Figure 54A:
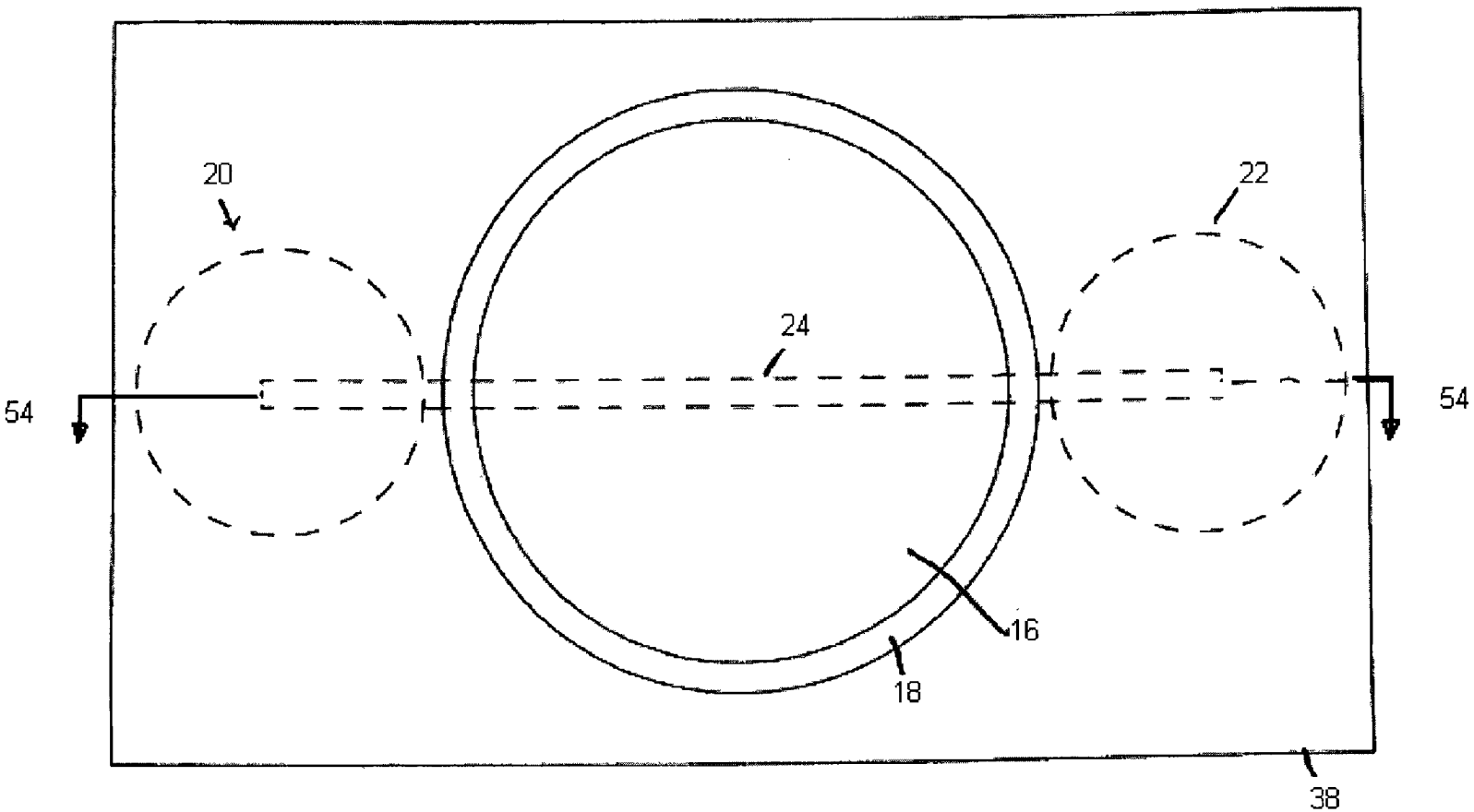
FIG. 54A illustrates a front plan view of another embodiment of a loudspeaker driver according to the present invention assembled on a front board and having a transmission frame coupled to the back surface of a diaphragm.
Figure 54B:
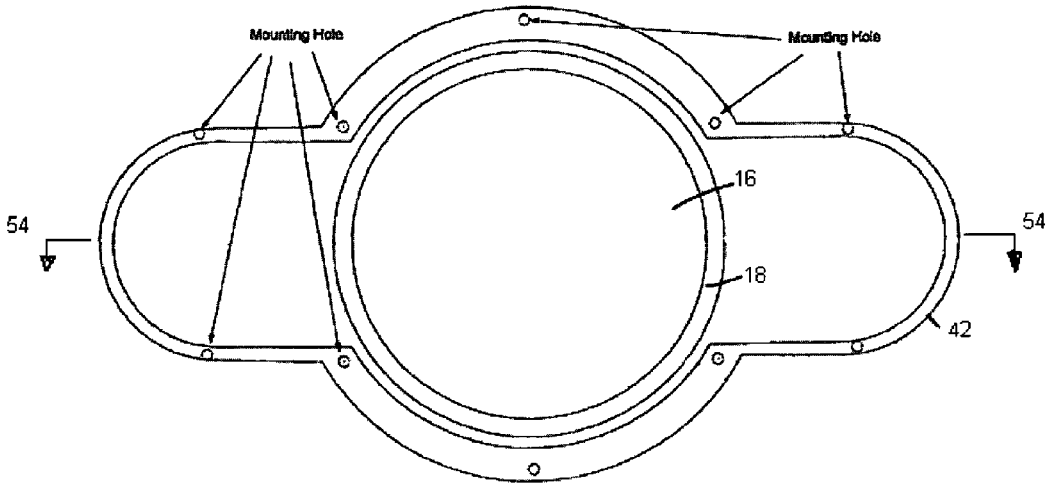
FIG. 54B illustrates a front plan view of another embodiment of a loudspeaker driver according to the present invention assembled on a support frame instead of a front board and having a transmission frame coupled to the back surface of a diaphragm.
Figure 54C:
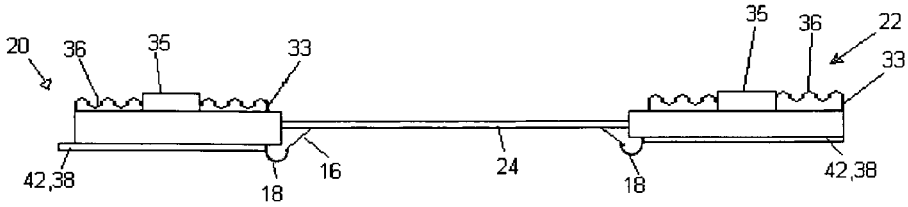
FIG. 54C illustrates a cross-sectional view along lines 54-54 in FIGS. 54A and 54B having the same transmission frame and motors arrangement as the embodiments of FIGS. 51A-53D but having a truncated cone as a diaphragm.
Figure 54D:
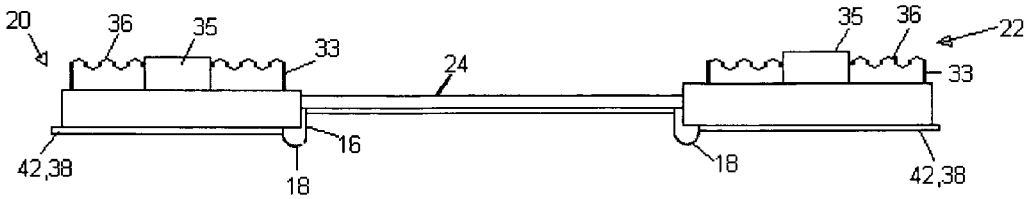
FIG. 54D illustrates a cross-sectional view along lines 54-54 in FIGS. 54A and 54B having the same transmission frame and motors arrangement as the embodiments of FIGS. 51A-53D but having a cylindrical a diaphragm.
Figure 54E:
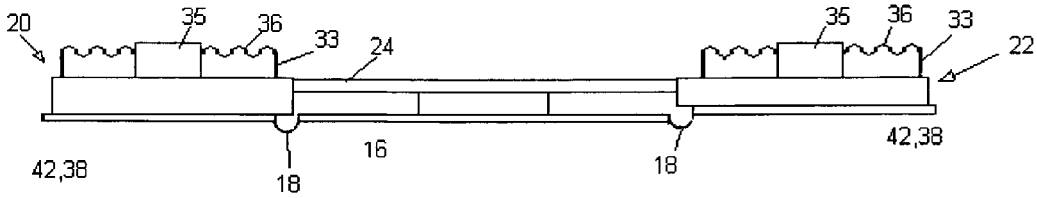
FIG. 54E illustrates a cross-sectional view along lines 54-54 in FIGS. 54A and 54B having the same transmission frame and motors arrangement as the embodiments of FIGS. 51A-53D but having a flat body as a diaphragm.

Referring to FIGS. 54A-54E, in which like numerals identify like features, in other embodiments, transmission frame 24 need not penetrate the body of diaphragm 16. Rather, transmission frame 24 may be coupled mechanically to the back surface of the diaphragm 16 using glue or the like. Thus, as illustrated by FIG. 54C, transmission frame 24 may be coupled to a back surface of a conically shaped diaphragm 16 using glue or the like. In other variations, the shape of the diaphragm 16 may be different. For example, the diaphragm 16 may be cylindrical as illustrated by FIG. 54D, or it may be flat, circular or oval rigid body as illustrated by FIG. 54E.

Referring now to FIGS. 55A-55E, in which like numerals identify like features, a driver according to another embodiment includes a motor 20 that is disposed between at least two movable diaphragms 16 and a transmission body that is mechanically coupled to the former 35 of the voice coil of the motor 20 below the spider 36 thereof, and mechanically coupled to the diaphragms 16 at respective terminal ends thereof.

Figure 55A:
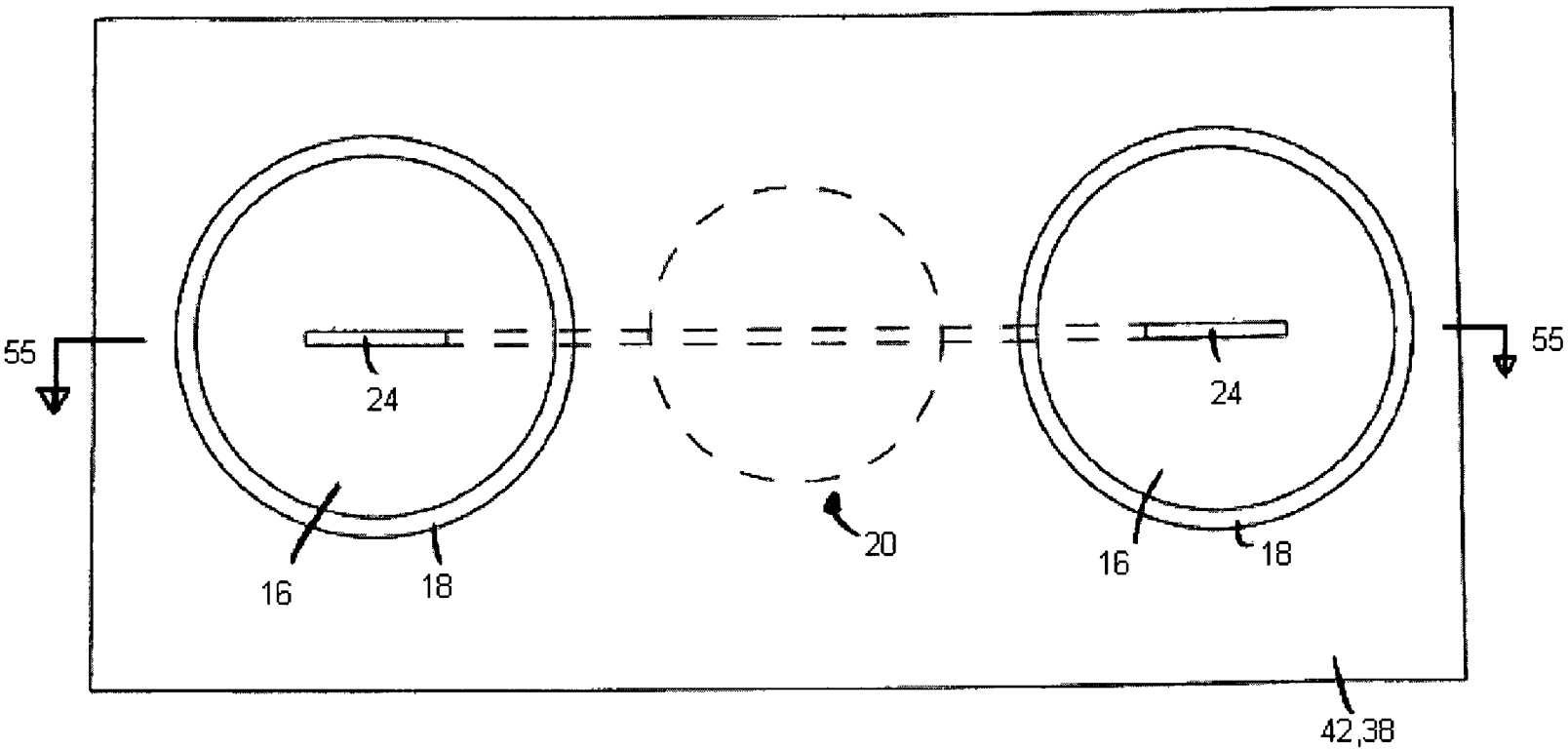
FIG. 55A illustrates a front plan view of a loudspeaker driver according to another embodiment of the present invention assembled on a front board or a support frame.
Figure 55B:
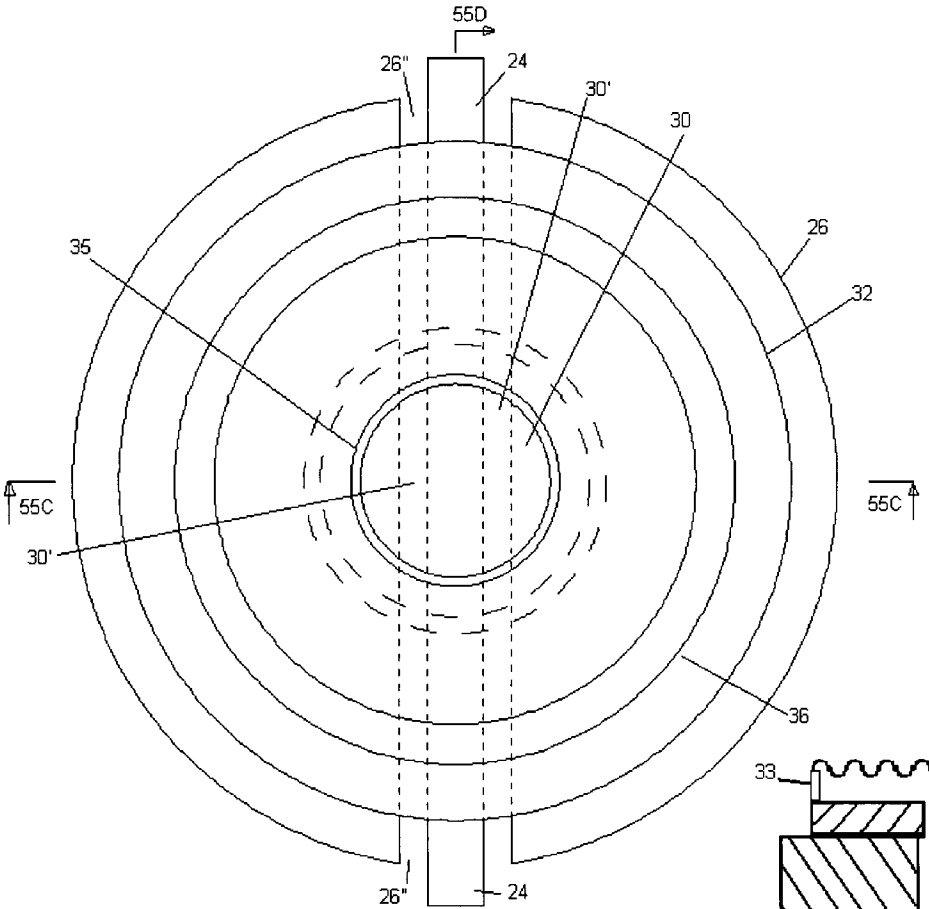
FIG. 55B shows a top plan view of a motor and transmission arrangement as would be used in the embodiment of FIG. 55A.
Figure 55C:
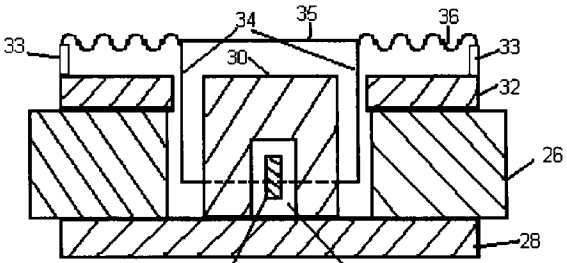
FIG. 55C shows a cross-sectional view of the motor and transmission arrangement along line 55C-55C viewed in the direction of arrows in FIG. 55B.
Figure 55E:
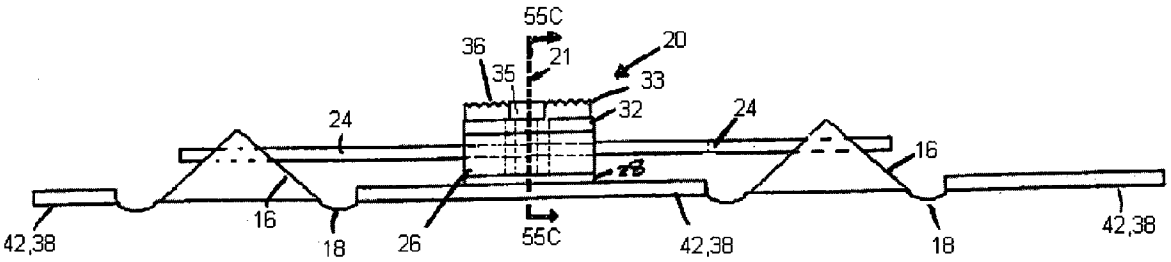
FIG. 55E illustrates a cross-sectional view of a loudspeaker driver according to the embodiment of FIG. 55A along line 55-55 viewed in the direction of the arrows.

Referring specifically to FIG. 55B, the magnet 26 of the motor 20 used in, for example, the embodiment illustrated by FIG. 55C, would include a second gap aligned with the opening in the central pole piece 30 and, in the case of two diaphragms 16, aligned with the first gap therein. Consequently, transmission frame 24 extends from one side of the motor 20 to the other opposing side of the motor 20 through the opening in the pole piece 30 and under the top plate 32 and the spider 36 thereof.

Note that the terminal ends of transmission frame 24 may penetrate the body of each respective diaphragm 16 (in the same manner as the embodiment of FIG. 51C) and further secured to the same by glue or the like.

Thus, a driver according to another embodiment of the present invention includes a plurality of movable diaphragms (i.e. rendered movable by respective surrounds 18 coupled to the terminal boundary thereof surrounding the interior surface thereof) laterally spaced from one another, each movable diaphragm having a respective open mouth defined by a respective terminal boundary residing at the outermost lateral edge thereof surrounding the entire interior surface area thereof; and a driving section to drive the movable diaphragms disposed only in the space between the movable diaphragms that includes at least one driver arrangement (i.e. a motor 20) residing lateral to, and outside the open mouths of the plurality of movable diaphragms and including a voice coil movable along a motion axis that is lateral to and outside the outermost lateral edges of the movable diaphragms, the voice coil being suspended in a magnetic field and mechanically coupled to the movable diaphragms wherein the voice coil is mechanically coupled to the diaphragms with a transmission frame at location below the spider and between the top plate and the bottom plate of the motor.

Figure 55F:
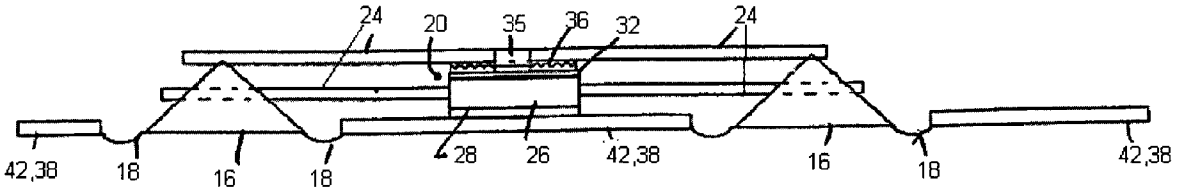
FIG. 55F illustrates a variation of a loudspeaker driver according to FIG. 55A including a second transmission frame extending over the spider of the motor and coupled to the diaphragms.

Referring now to FIG. 55F, in which like numerals identify like features, in another embodiment, a second transmission frame 24 may be coupled mechanically using glue or the like to a portion of the former 35 of the motor 20 that is above the top plate 32 and the spider 36 thereof and mechanically coupled using glue or the like to the back of respective diaphragms 16 at its terminal ends thereof.

Figure 55G:
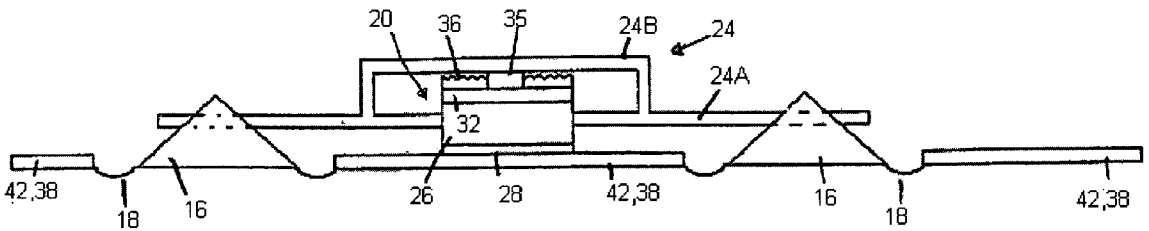
FIG. 55G illustrates a variation of a loudspeaker driver according to FIG. 55A including a transmission frame having a first portion extending under the spider of the motor according to the present invention and a second portion coupled to the former and extending over and above the spider of the motor.

Referring now to FIG. 55G, in which like numerals identify like features, transmission body may include a first portion mechanically coupled to the former 35 of the voice coil of the motor 20 at a position below the top plate 32 and the spider 36 thereof, and a second portion mechanically coupled using glue or the like to another portion of the former 35 of the voice coil of the motor 20 positioned above the spider 36 and the top plate 32 thereof.

Figure 55H:
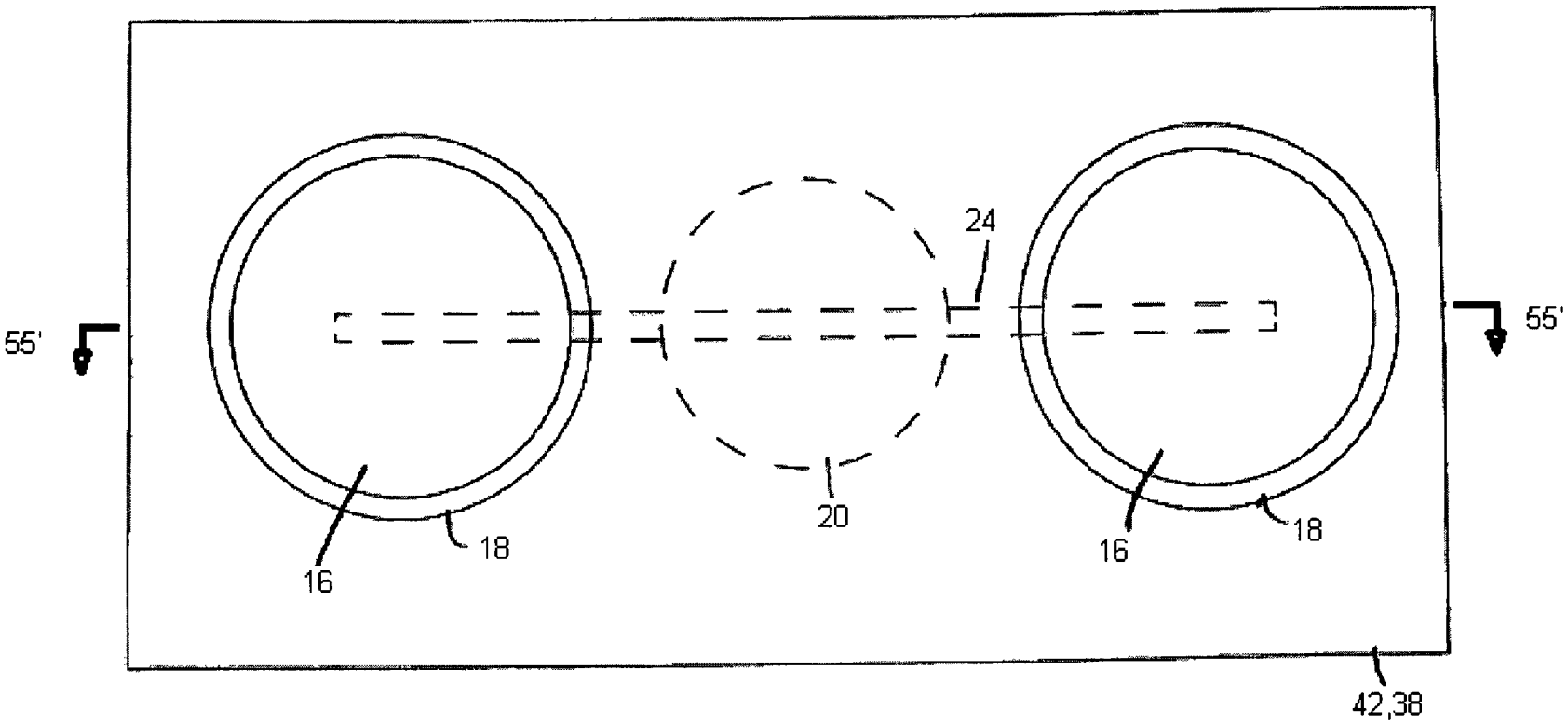
FIG. 55 H illustrates a front plan view of a loudspeaker driver according to embodiment of FIG. 55A assembled on a front board or a support frame in which the transmission frame does not penetrate the diaphragms.
FIG. 55I illustrates a cross-sectional view of variation as illustrated by FIG. 55H along line 55'-55' viewed in the direction of the arrows.
FIG. 55J illustrates a cross-sectional view of variation as illustrated by FIG. 55H along line 55'-55' viewed in the direction of the arrows.
Figure 55I:
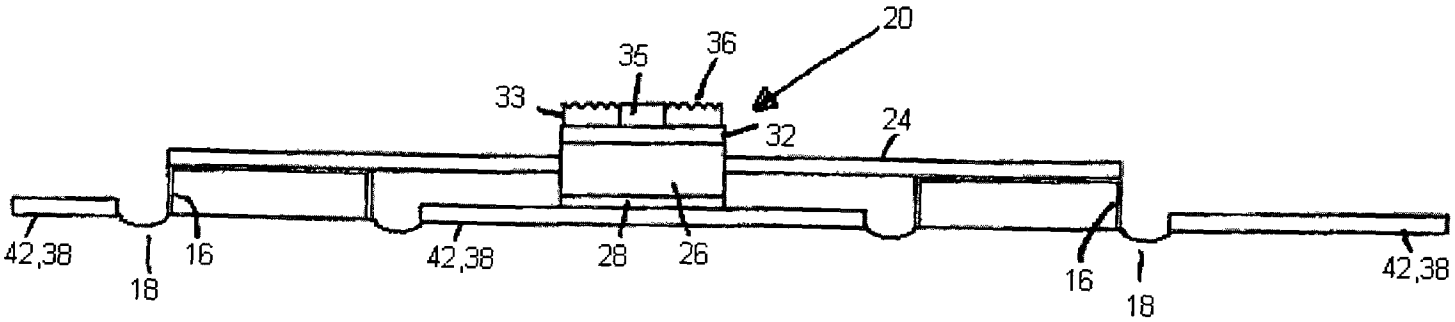
Figure 55J:
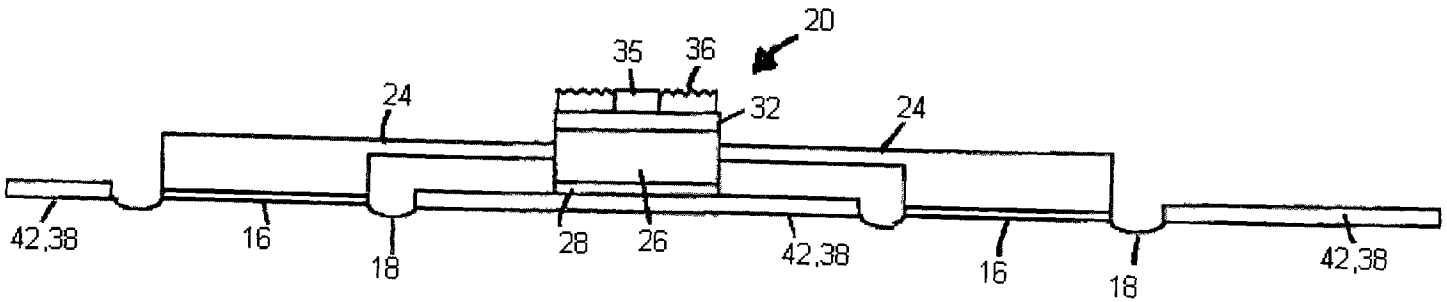

Referring now to FIGS. 55H-55J, in which like numerals identify like features, the terminal ends of transmission body need not penetrate the respective bodies of the diaphragms 16, but may be mechanically coupled to the back surface thereof using glue or the like. Furthermore, diaphragms 16 need not be conical but may be cylindrical as illustrated by FIG. 55I or may be comprised of circular or oval flat bodies as illustrated by FIG. 55J.

Figure 56A:
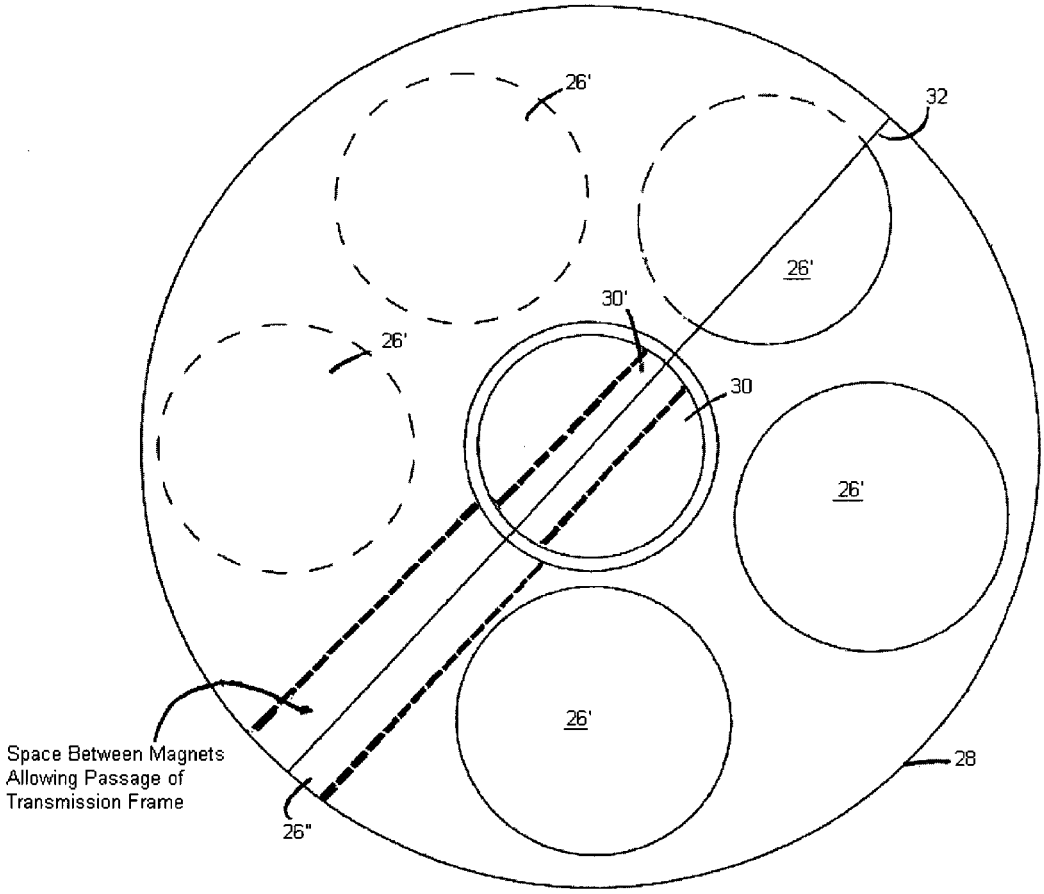
FIG. 56A illustrates a top plan view of the magnetic circuit of a variation of a motor that can be used in any of the embodiments of FIGS. 51A-54E having a portion of a top plate thereof removed for better illustration.

In the preferred embodiments disclosed above, the motor 20 (and 22) includes a ring-shaped magnet 26 which has been cut to include one gap or two gaps to allow the passage of a transmission body. While such a configuration is preferred, the motors 20,22 may be configured differently. Thus, for example, as illustrated by FIG. 56A, the motor 20,22 may include a plurality of cylindrically shaped magnets 26' arranged between the top plate 32 and the bottom plate of the motor 20,22 to realize a magnetic circuit. At least two of the magnets 26' may be spaced to provide a passage in alignment with the opening in the pole piece 30 to allow for the passage of the transmission body.

Figure 56B:
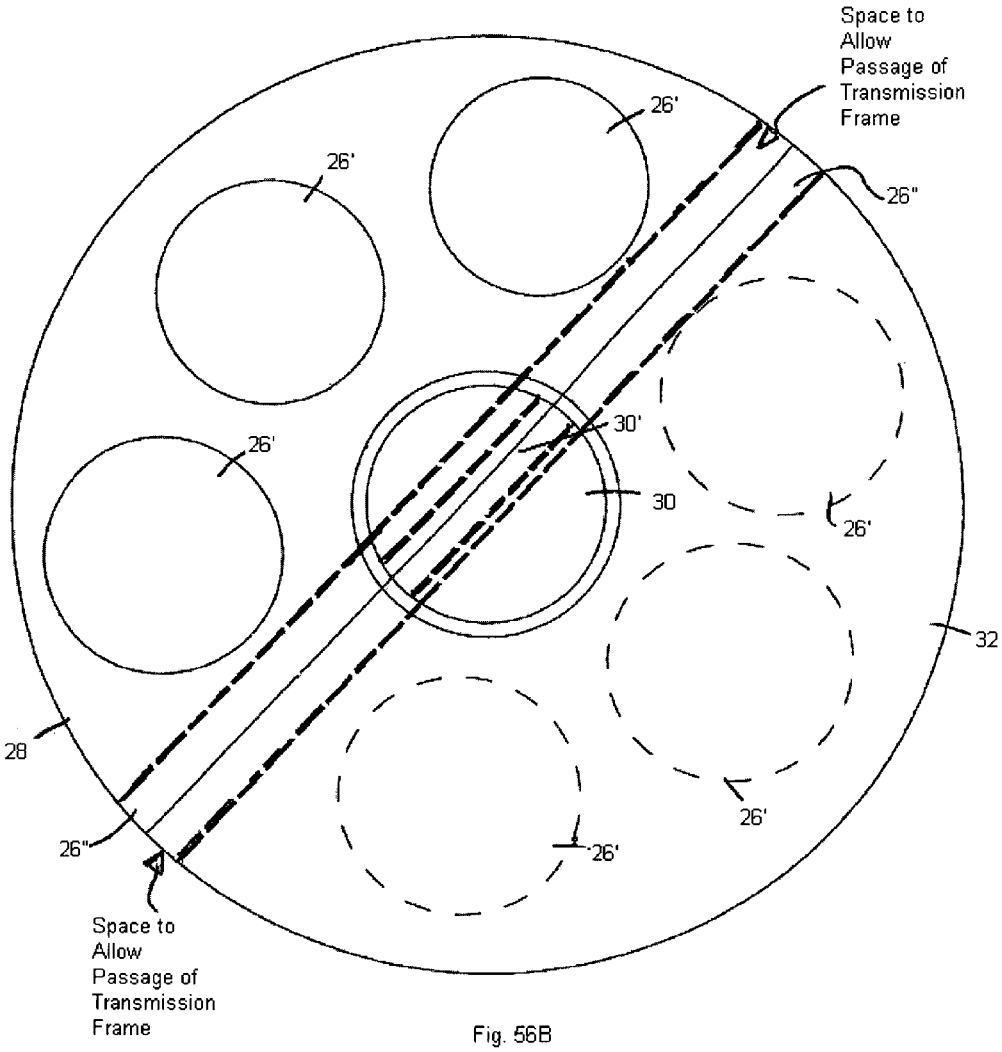
FIG. 56B illustrates a top plan view of the magnetic circuit of another variation of a motor that can be used in any of the embodiments of FIGS. 51A-55J having a portion of a top plate thereof removed for better illustration.

In an alternative embodiment, the magnets 26' may be arranged to provide space at both ends of the opening in the pole piece 30 to allow passage of the transmission frame 24 from one side of the motor 20 to another side of the motor 20 as illustrated by FIG. 56B.

Note that in a driver according to the present invention it is preferred to not have a motor arranged at the back (the side facing the interior of the cabinet) of the diaphragm 16 as is the case in prior art loudspeaker drivers in order to obtain as shallow a profile as possible.

It should be noted that in each of the embodiments disclosed the back plate 28 of the motors or the motor can be omitted and instead the support frame 42 can be used as a back plate. Thus, the magnet 26 of the motor can directly disposed on the support frame, and the material and dimensions of the back plate 28 can be selected to serve as the back plate 28 of the motor (in embodiments that use one motor) or the motors (the embodiments that use several motors) an example of which is illustrated by FIG. 23D.

Figure 57B:
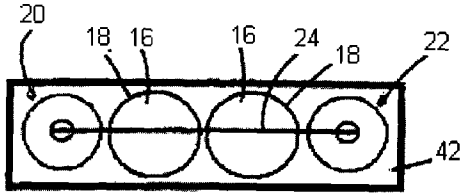
FIGS. 57A and 57B illustrate respectively the front and the back plan views of a loudspeaker driver according to another embodiment of the present invention.
Figure 57A:
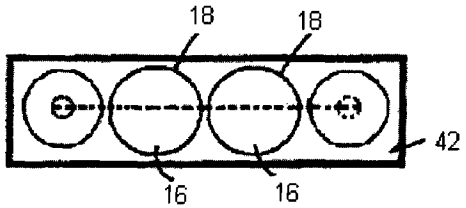

Referring now to FIGS. 57A and 57B, in which like numerals identify like features as described above, in a driver according to yet another embodiment of the present invention a plurality of adjacently disposed (i.e. no motor therebetween) diaphragms 16, each movably suspended with a respective surround 18 as described above, are located between two respective motors 20,22 and supported on a respective support 42 using any of the modalities described above. A transmission 24 then mechanically couples the voice coils of each motor 20,22 to the plurality of adjacently disposed movable diaphragms. Note that transmission 24 can be coupled to a top portion of the formers of the voice coils above the spider or below the spider as described above and shown in the figures.

Figure 58B:
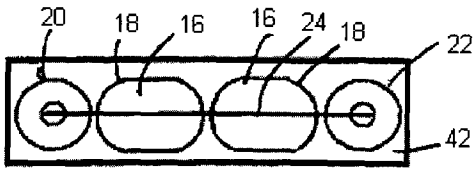
FIGS. 58A and 58B illustrate respectively the front and the back plan views of a loudspeaker driver according to another embodiment of the present invention.
Figure 58A:
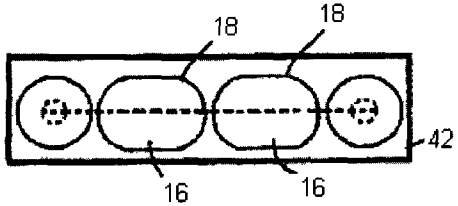

Referring to FIGS. 58A and 58B, in which like numerals identify like features as described above, according to another embodiment of the present invention, instead of having diaphragms 16 with a circular outer boundary (FIGS. 57A and 57B), diaphragms 16 having an oval or race track shaped outer boundaries may be employed without deviating from the scope and the spirit of the present invention.

Figure 59B:
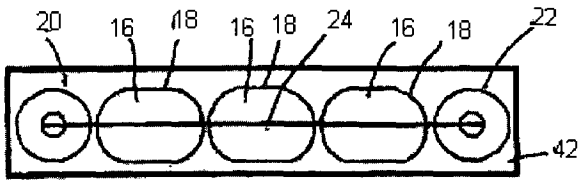
FIGS. 59A and 59B illustrate respectively the front and the back plan views of a loudspeaker driver according to another embodiment of the present invention.
Figure 59A:
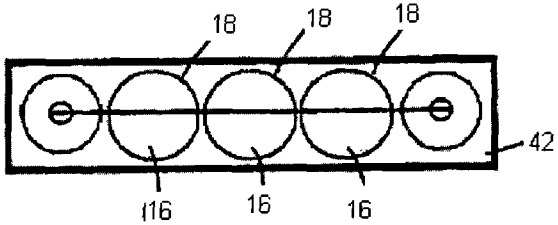

Referring to FIGS. 59A and 59B, in which like numerals identify like features as described above, according to another embodiment of the present invention, more than two adjacently disposed diaphragms 16 may be used without deviating from the scope and the spirit of the present invention.

It should be noted that although the embodiments shown by FIGS. 57A-59B show two motors 20,22 other embodiments using at least one motor are possible. For example, instead of having one diaphragm 16 on either side of a centrally disposed motor, two or more suspended diaphragms may be disposed on either side of a centrally located motor. Further note that diaphragms 16 need not be the same shape. Thus, a combination of oval and round diaphragms may also be used without deviating from the scope and the spirit of the present invention.

Referring now to FIGS. 60A-60G, in which like numerals identify like features as described above, according to yet another aspect of the present invention a transmission body 24 can be coupled to a respective former employing a disk-shaped coupling 350. Specifically, a round coupling 350 (e.g. a plastic or an aluminum washer) having a centrally located threaded opening 351 may be coupled to the top of a former 35 by glue or the like. A screw 352 or the like that can be threadably coupled to the interior of opening 351 may be then used to mechanically couple a transmission body 24 to the coupling 350, whereby transmission body 24 is secured to a former 35. Note that transmission body 24 includes a plurality of oval thru-holes 353 therein for the reception of screw 352. Further note that the same arrangement, namely the use of a coupling 350 may be used to couple transmission body 24 to the back of a diaphragm 16. Coupling 350 may be sized to have an outside diameter that is about the same as the inner diameter of former 35 whereby it may be received inside former 35 but allow enough room for an adequate application of glue. According to another variation, a top portion of coupling 350 may include a laterally extending flange which is wider than the outside diameter of former 35 (see FIGS. 60D and 60G), whereby coupling 350 may not be fully received inside former 35. The flange portion may assist in providing a surface that is leveled relative to the top of former 35 thereby providing a level surface for coupling transmission body 24.

Figure 61A:
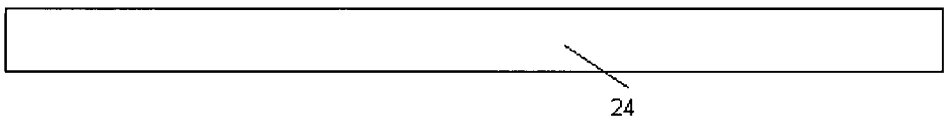
FIGS. 61A-61G illustrate another method for the mechanical coupling of a transmission frame to former(s). Specifically.
Figure 61B:
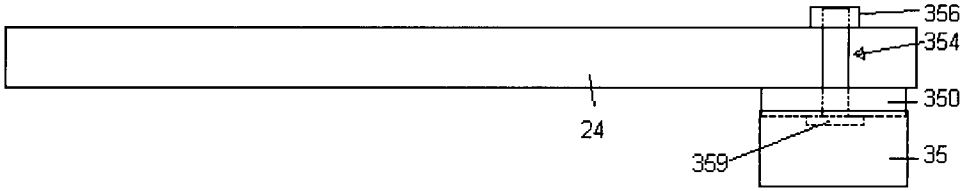
Figure 61C:
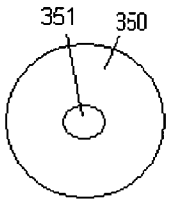
Figure 61D:
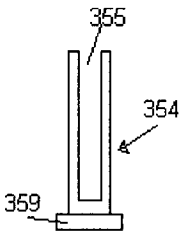
Figure 61E:
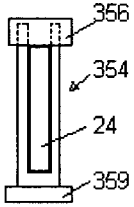
Figure 61G:
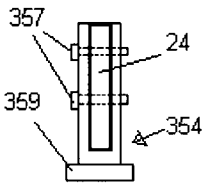
Figure 61F:
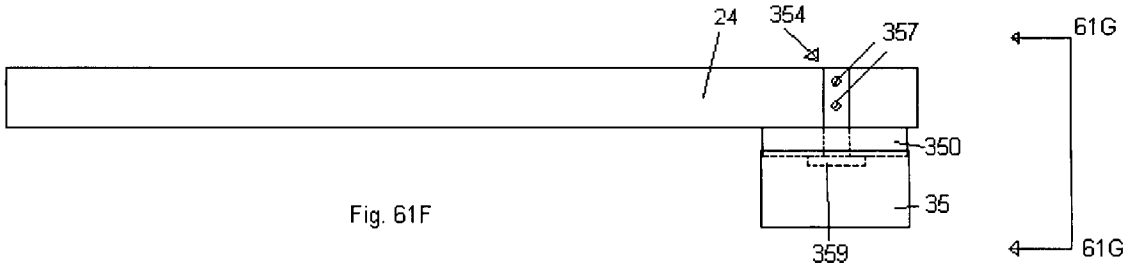

FIGS. 60A-60G illustrate a method that can employed for coupling a transmission body 24 having a wide flat bottom surface (e.g. a body having a U-shaped cross-section) to former 35. Referring now to FIGS. 61A-61G, in which like numerals identify like features as described above, according to another embodiment of the present invention a transmission body 24 that is flat may be coupled to former(s) 35. Specifically, screw 354 may be provided with a longitudinal groove 355. Groove 355 my be about the same thickness as a flat transmission body 24 in order to receive the same therein as illustrated by FIG. 61E. A nut 356 may be then used to secure transmission body 24 once it is received in groove 355.

Note that because a nut 356 is used to secure transmission body 24, groove 356 must be deeper than the width of transmission body 24. Alternatively, screws 357 may be used to secure transmission body 24 and screw 354 whereby the depth of groove 355 can be minimized. Specifically, screws 357 can pierce through screw 354 and transmission body 24 once transmission body 24 is received inside groove 355. Since a nut is not necessary screw 354 need not have a threaded exterior and indeed may be replaced with any body having an elongated portion with a groove 355 therein. Note that screw 357 may include an enlarged head 359 that is too large to fit through an opening 351 in coupling 350.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A loudspeaker driver, comprising: at least one movable diaphragm having an open mouth defined by a terminal boundary residing at the outermost lateral edge of said diaphragm surrounding the entire interior surface area of said diaphragm; and at least one driver arrangement residing lateral to and outside said open mouth of said one movable diaphragm and including a voice coil movable along a motion axis that is lateral to and outside said outermost lateral edge, said voice coil being suspended in a magnetic field and disposed lateral to said movable diaphragm, a transmission body extending from a side of said at least one driver arrangement and mechanically coupled to said movable diaphragm and to said voice coil, wherein said driver arrangement includes a plurality of spaced magnets, said transmission body residing in a space between a pair of said magnets.

2. The loudspeaker driver of claim 1, further comprising another movable diaphragm having an open mouth defined by a terminal boundary residing at the outermost lateral edge of said another movable diaphragm surrounding the entire interior surface area of said another movable diaphragm, wherein said motion axis is lateral to and outside said open mouth of said another movable diaphragm and said voice coil is mechanically coupled to said another movable diaphragm.

3. The loudspeaker driver of claim 1, further comprising a plurality of movable diaphragms, in addition to said one movable diaphragm, each movable diaphragm of said plurality of movable diaphragms having a respective open mouth defined by a respective terminal boundary residing at the outermost lateral edge thereof surrounding the entire interior surface area thereof, wherein said motion axis is lateral to and outside said open mouths of said plurality of movable diaphragms and said voice coil is mechanically coupled to said plurality of movable diaphragms.

4. A loudspeaker driver, comprising: at least one movable diaphragm having an open mouth defined by a terminal boundary residing at the outermost lateral edge of said diaphragm surrounding the entire interior surface area of said diaphragm; and at least one driver arrangement residing lateral to and outside said open mouth of said one movable diaphragm and including a voice coil movable along a motion axis that is lateral to and outside said outermost lateral edge, said voice coil being suspended in a magnetic field and disposed lateral to said movable diaphragm, a transmission body extending from a side of said at least one driver arrangement and mechanically coupled to said movable diaphragm and to said voice coil; and another driver arrangement residing lateral to and outside said open mouth of said one movable diaphragm and including a voice coil movable along a respective motion axis that is lateral to and outside said outermost lateral edge of said at least one movable diaphragm, said voice coil being suspended in a magnetic field, and mechanically coupled to said at least one movable diaphragm by said transmission body, wherein each said driver arrangement includes a magnet having a gap in the body thereof, said transmission body residing inside each said gap.

5. A loudspeaker driver, comprising: at least one movable diaphragm having an open mouth defined by a terminal boundary residing at the outermost lateral edge of said diaphragm surrounding the entire interior surface area of said diaphragm; at least one driver arrangement residing lateral to and outside said open mouth of said one movable diaphragm and including a voice coil movable along a motion axis that is lateral to and outside said outermost lateral edge, said voice coil being suspended in a magnetic field and disposed lateral to said movable diaphragm; a transmission body extending from a side of said at least one driver arrangement and mechanically coupled to said movable diaphragm and to said voice coil; and another driver arrangement residing lateral to and outside said open mouth of said one movable diaphragm and including a voice coil movable along a respective motion axis that is lateral to and outside said outermost lateral edge of said at least one movable diaphragm, said voice coil being suspended in a magnetic field, and mechanically coupled to said at least one movable diaphragm by said transmission body, wherein each said driver arrangement includes a plurality of spaced magnets, said transmission body residing inside a respective space between a respective pair of magnets in each said driver arrangement.

* * * * *